US009968237B2

(12) United States Patent
Lee et al.

(10) Patent No.: US 9,968,237 B2
(45) Date of Patent: May 15, 2018

(54) DISH WASHING MACHINE

(71) Applicant: SAMSUNG ELECTRONICS CO., LTD., Suwon-si, Gyeonggi-do (KR)

(72) Inventors: Chang Wook Lee, Seoul (KR); Chan Young Park, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 450 days.

(21) Appl. No.: 14/585,843

(22) Filed: Dec. 30, 2014

(65) Prior Publication Data

US 2015/0182095 A1 Jul. 2, 2015

(30) Foreign Application Priority Data

Dec. 31, 2013 (KR) ..... 10-2013-0169543

(51) Int. Cl.
*A47L 15/02* (2006.01)
*A47L 15/16* (2006.01)
*A47L 15/42* (2006.01)

(52) U.S. Cl.
CPC ..... *A47L 15/4282* (2013.01); *A47L 15/16* (2013.01)

(58) Field of Classification Search
CPC .. A47L 15/16; A47L 15/4282; A47L 2501/20; A47L 15/23; A47L 15/4278; A47L 15/428; A47L 15/14; A47L 15/18
See application file for complete search history.

(56) References Cited

U.S. PATENT DOCUMENTS 2,236,791 A * 4/1941 Forsberg ..... A47L 15/18 134/172
2,704,084 A * 3/1955 James ..... A47L 15/16 134/183
3,903,911 A * 9/1975 Guth ..... A47L 15/16 134/148
3,915,182 A * 10/1975 Payne ..... A47L 15/23 134/176
4,993,444 A * 2/1991 Toriyama ..... A47L 15/18 134/181
5,131,419 A * 7/1992 Roberts ..... A47L 15/0078 134/113
2007/0246078 A1* 10/2007 Purtilo ..... A47L 15/14 134/25.2

(Continued)

FOREIGN PATENT DOCUMENTS

DE 1191527 B * 4/1965 ..... A47L 15/18

OTHER PUBLICATIONS

Machine English Translation of Description of DE 1191527 B (Gibson, Apr. 1965).*

*Primary Examiner* — Joseph L. Perrin
*Assistant Examiner* — Irina Graf
(74) *Attorney, Agent, or Firm* — Staas & Halsey LLP

(57) ABSTRACT

A dish washing machine includes a main body, a washing tub provided in the main body, a basket provided in the washing tub to store a dish, a stationary nozzle fixed to one side of the washing tub to spray washing water, and a plurality of vanes which change a direction of the washing water sprayed from the stationary nozzle toward the basket. At least one of the plurality of vanes are rotatably provided and operate so that the washing water sprayed from the stationary nozzle is reflected toward the basket. Through such a configuration, a dead region in which the dish is not washed may be minimized.

12 Claims, 57 Drawing Sheets

(56) References Cited

U.S. PATENT DOCUMENTS

| | | | | |
|---|---|---|---|---|
| 2009/0056754 | A1* | 3/2009 | Rolek | A47L 15/0018 134/18 |
| 2013/0319487 | A1* | 12/2013 | Hong | A47L 15/06 134/183 |
| 2016/0106295 | A1* | 4/2016 | Thiyagarajan | A47L 15/4282 134/183 |

* cited by examiner

DISH WASHING MACHINE

CROSS-REFERENCE TO RELATED APPLICATIONS

This application claims the priority benefit of Korean Patent Application No. 10-2013-0169543, filed on Dec. 31, 2013 in the Korean Intellectual Property Office, the disclosure of which is incorporated herein by reference.

BACKGROUND

1. Field

Embodiments of the disclosure relate to a dish washing machine which may include a spray nozzle fixed to one side of a washing tub and a vane movably provided in the washing tub to reflect washing water sprayed from the spray nozzle toward dishes.

2. Description of the Related Art

A dish washing machine generally refers to a home or commercial appliance which may include a main body having a washing tub therein, a basket configured to store dishes, a sump configured to store washing water, a spray nozzle configured to spray the washing water, and a pump configured to supply the washing water in the sump to the spray nozzle, and sprays the high-pressure washing water onto the dishes to wash the dishes.

In general, a dish washing machine adopts a rotor type spray structure having a rotating spray nozzle. The rotating nozzle sprays washing water while rotating by hydraulic pressure. Since the rotating nozzle sprays the washing water within a range of a radius of rotation thereof, a region in which no washing water is sprayed may be generated. Thus, a so-called linear type spray structure has been proposed such that the region in which no washing water is sprayed is not generated.

The linear type spray structure may include a stationary nozzle fixed to one side of a washing tub and a vane which reflects washing water sprayed from the stationary spray nozzle toward dishes while moving in the washing tub, thereby spraying the washing water throughout an entire region of the washing tub according to movement of the vane which includes a reflective plate.

The stationary nozzle may have a plurality of spray holes which are horizontally arranged in the washing tub and may be fixed to a rear wall of the washing tub. The vane may horizontally extend in the washing tub so as to reflect the washing water sprayed from the plurality of spray holes, and may be provided so as to linearly reciprocate in the horizontal direction of the washing tub.

The linear type spray structure further may include a drive device which may drive the vane. The drive device may be realized in various manners. For example, the drive device may include a motor, a belt connected to the motor to transfer a driving force to the vane, and a rail configured to guide movement of the vane, and may be provided such that the vane moves on the rail while the belt rotates when the motor is driven.

In a distribution device which distributes washing water stored in a sump to spray nozzles, the linear type spray structure may be provided with a distribution device having a different structure from that provided in the rotor type spray structure.

When the spray nozzle disposed at a lower portion of the washing tub corresponds to a rotating nozzle, the distribution device may have an outlet provided facing upward. Consequently, the length of a passage through which the outlet of the distribution device is connected to the rotating nozzle may be shortened and a pressure loss of washing water may be minimized.

On the other hand, when the spray nozzle disposed at the lower portion of the washing tub is a stationary nozzle, an outlet of the distribution device need not be provided facing upward since the stationary nozzle is arranged adjacent to the rear wall of the washing tub. If the outlet of the distribution device is provided to be directed upward, a passage through which the outlet of the distribution device is connected to the stationary nozzle has to be bent rearward immediately from the outlet of the distribution device. For this reason, a pressure loss of washing water may be increased.

Meanwhile, since the linear type spray structure has stationary spray nozzles, divided washing in which washing water is sprayed to only a partial region of the washing tub may be performed by distributing the washing water to only a portion of the entire spray nozzles.

SUMMARY

Therefore, it is an aspect of the disclosure to provide a dish washing machine capable of minimizing a dead region (a region which does not receive washing water from a spray nozzle) by using a stationary nozzle.

Additional aspects of the disclosure will be set forth in part in the description which follows and, in part, will be apparent from the description, or may be learned by practice of the disclosure.

In accordance with an aspect of the disclosure, a dish washing machine may include a main body, a washing tub provided in the main body, a basket provided in the washing tub to store a dish, a stationary nozzle fixed to one side of the washing tub to spray washing water, and a plurality of vanes changing a direction of the washing water sprayed from the stationary nozzle toward the basket, at least one of the plurality of vanes rotatably provided and operating so that the washing water sprayed from the stationary nozzle is reflected toward the basket.

Each of the plurality of vanes may include a reflective surface used to reflect the washing water sprayed from the stationary nozzle, and the vane may be provided so as to rotate between a standby position at which the reflective surface is spaced from a progress direction of the washing water and a reflection position at which the reflective surface is arranged in the progress direction of the washing water by rotating the reflective surface from the standby position such that the washing water is reflected toward the basket.

Each of the plurality of vanes may be configured to independently operate between the standby position and the reflection position.

The plurality of vanes may be provided in parallel with a bottom surface of the washing tub.

The dish washing machine may further include a plurality of drive portions which are respectively coupled to the plurality of vanes so as to independently drive the vanes.

The dish washing machine may further include a drive portion configured to drive the plurality of vanes, the plurality of vanes may include a plurality of protrusion portions protruding in longitudinal directions of the respective vanes, and the drive portion may include a motor configured to generate a driving force, a belt rotatably connected to a pulley so as to rotate the vanes by the driving force of the motor, and a pushing protrusion provided on the belt, and configured to sequentially rotate each of the plurality of vanes from the standby position to the reflection position by pushing at least one of the plurality of protrusion portions.

The vane rotated from the standby position to the reflection position by the pushing protrusion may return to the standby position due to self-weight thereof (i.e., by a gravitational force).

The dish washing machine may further include a drive portion configured to drive the plurality of vanes, the drive portion may include a motor configured to generate a driving force, and a belt rotatably connected to a plurality of pulleys so as to rotate the vanes by the driving force of the motor, and the plurality of vanes may be rotatably coupled to the plurality of pulleys so as to have different phase differences.

The plurality of pulleys may include a drive pulley connected to the motor and configured to receive the driving force, and a plurality of idle pulleys configured to receive the driving force from the drive pulley.

The plurality of vanes may be coupled to the plurality of pulleys such that an end portion of each vane is spaced apart from a center of rotation of each pulley.

The plurality of vanes may be arranged in parallel with each other in a longitudinal direction perpendicular to a progress direction of the washing water.

In accordance with an aspect of the disclosure, a dish washing machine may include a main body, a washing tub provided in the main body, a basket provided in the washing tub to store a dish, and a plurality of washing mechanisms, each including a stationary nozzle fixed to the washing tub to spray washing water and a reflective portion provided to correspond to the stationary nozzle, the reflective portion being arranged in a progress direction of the washing water sprayed from the stationary nozzle so as to change the direction of the washing water sprayed from the stationary nozzle toward the basket.

Each of the plurality of washing mechanisms may operate to independently spray the washing water.

The reflective portion may be rotatably provided.

In each of the plurality of washing mechanisms, the stationary nozzle may be arranged at a center of the washing tub and radially spray the washing water, and the reflective portion may be arranged so as to change the direction of the washing water sprayed from the stationary nozzle toward the basket.

In each of the plurality of washing mechanisms, the stationary nozzle may be arranged at a corner of the washing tub and spray the washing water toward the inside of the washing tub, and the reflective portion may be arranged so as to change the direction of the washing water sprayed from the stationary nozzle toward the basket.

The basket may include a plurality of baskets which are arranged adjacent to each other, and the reflective portion may be provided in at least one of the plurality of baskets and change the direction of the washing water toward another adjacent basket.

In each of the plurality of washing mechanisms, the stationary nozzle and the reflective portion may be integrally formed.

Each of the plurality of washing mechanisms may include a settling frame formed on one side surface of the washing tub in a wire shape and configured such that the reflective portion is settled.

The settling frame may be provided so as to be separable from the washing tub.

The stationary nozzle may include one or a plurality of spray holes. The plurality of spray holes may be separated from one another by a predetermined angle.

In accordance with an aspect of the disclosure, a dish washing machine may include a main body, a washing tub disposed in the main body, a stationary nozzle fixed to a side of the washing tub to spray washing water, vanes disposed such that a longitudinal axis of the vanes is perpendicular to a spray direction of the stationary nozzle, and a driving mechanism disposed at an end of at least one of the vanes to rotate the at least one vane such that a reflective portion of the at least one vane reflects washing water sprayed from the stationary nozzle.

The driving mechanism may includes one or more of a motor, a belt, a driving pulley, and one or more idle pulleys. The vanes may be rotated using the driving mechanism between a standby position and one or more reflection positions, the standby position corresponding to a position at which a reflective portion of a vane is offset from a direction of spray by the stationary nozzle so that a vane in the standby position does not reflect the washing water sprayed from the stationary nozzle, and the one or more reflection positions corresponding to one or more positions at which a reflective portion of a vane is in the direction of spray by the stationary nozzle so that a vane in the one or more reflection positions reflects the washing water sprayed from the stationary nozzle.

The vanes may be independently rotated by the driving mechanism between the standby position and the one or more reflection positions such that a first vane is capable of being in the standby position, a second vane is capable of being in a first reflection position, and a third vane is capable of being in a second reflection position, simultaneously.

The vanes may be respectively rotated by the driving mechanism in sequence between the standby position and the one or more reflection positions.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
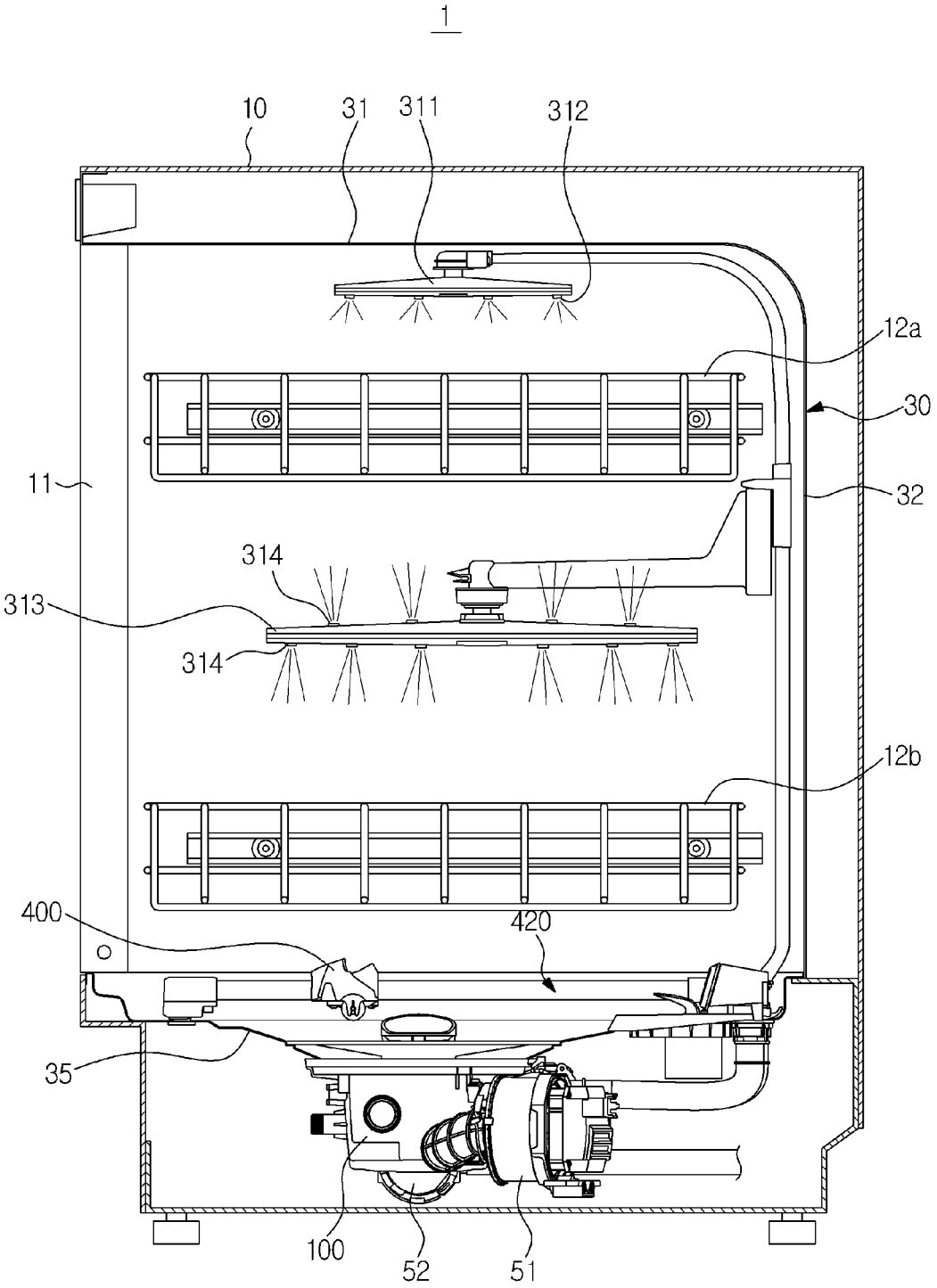
FIG. 1 is a cross-sectional view schematically illustrating a dish washing machine according to an embodiment of the disclosure.

Reference will now be made in detail to the embodiments of the disclosure, examples of which are illustrated in the accompanying drawings, wherein like reference numerals refer to like elements throughout. Where the term "configured" is used to describe any aspect of the disclosure, terms such as suitable for, adapted to, capable of, arranged to, operable to, provided to, etc., may also be applicable to describe that aspect of the disclosure.

Figure 2:
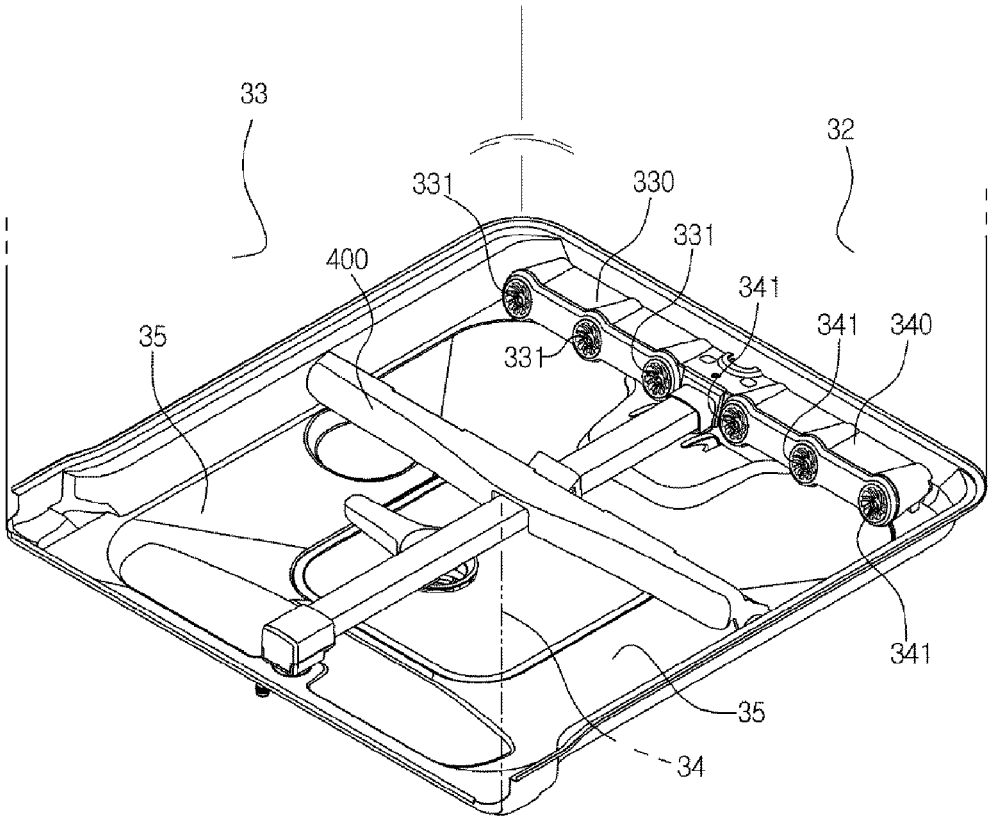
FIG. 2 is a view illustrating a lower portion of the dish washing machine in FIG. 1.

FIG. 1 is a cross-sectional view schematically illustrating a dish washing machine according to an embodiment of the disclosure. FIG. 2 is a view illustrating a lower portion of the dish washing machine in FIG. 1.

A whole structure of a dish washing machine according to an embodiment of the disclosure will be schematically and generally described with reference to FIGS. 1 and 2.

A dish washing machine 1 may include a main body 10 defining an external or outer appearance thereof, a washing tub 30 provided in the main body 10, baskets 12*a* and 12*b* provided in the washing tub 30 so as to store dishes, spray nozzles 311, 313, 330, and 340 configured to spray washing water, a sump 100 configured to store the washing water, a circulation pump 51 configured to pump the washing water in the sump 100 to supply the pumped washing water to the spray nozzles 311, 313, 330, and 340, a drainage pump 52 configured to discharge the washing water in the sump 100 to the outside of the main body 10, together with contaminants, a vane 400 configured to reflect the washing water toward the dishes while moving in the washing tub 30, and a drive device 420 configured to drive the vane 400.

The washing tub 30 may have a substantial box shape and have a front opening through which the dishes are able to be loaded and unloaded. The front opening of the washing tub 30 may be opened and closed by a door 11. The washing tub 30 may have an upper wall 31, a rear wall 32, a left wall 33, a right wall 34, and a bottom plate 35.

The baskets 12*a* and 12*b* may be wire racks configured of or including wires such that the washing water is not collected in the baskets 12*a* and 12*b* but passes through the baskets 12*a* and 12*b*. The baskets 12*a* and 12*b* may be detachably provided in the washing tub. The baskets 12*a* and 12*b* may include an upper basket 12*a* arranged at an upper portion of the washing tub 30 and a lower basket 12*b* arranged at a lower portion of the washing tub 30.

The spray nozzles 311, 313, 330, and 340 may spray the washing water at high pressure to wash the dishes. The spray nozzles 311, 313, 330, and 340 may include an upper rotating nozzle 311 arranged at the upper portion of the washing tub 30, an intermediate rotating nozzle 313 arranged at a central portion of the washing tub 30, and stationary nozzles 330 and 340 arranged at the lower portion of the washing tub 30.

The upper rotating nozzle 311 may be arranged above the upper basket 12*a* and spray the washing water downward while rotating by hydraulic pressure. To this end, the upper rotating nozzle 311 may have spray holes 312 provided at a lower end thereof. The upper rotating nozzle 311 may directly spray the washing water toward the dishes stored in the upper basket 12*a*.

The intermediate rotating nozzle 313 may be arranged between the upper basket 12*a* and the lower basket 12*b* and vertically spray the washing water while rotating by hydraulic pressure. To this end, the intermediate rotating nozzle 313 may have spray holes 314 provided at upper and lower ends thereof. The intermediate rotating nozzle 313 may directly spray the washing water toward the dishes in the upper basket 12*a* and the lower basket 12*b*.

The stationary nozzles 330 and 340 are provided so as not to move (i.e., they may be fixed) unlike the rotating nozzles 311 and 313, and are fixed to one side of the washing tub 30. The stationary nozzles 330 and 340 may be substantially arranged adjacent to the rear wall 32 of the washing tub 30 and spray the washing water toward the front of the washing tub 30. Accordingly, the washing water sprayed from the stationary nozzles 330 and 340 may not directly face or spray the dishes, and instead the wash water sprayed by the stationary nozzles 330 and 340 may be redirected by the vane 400 as explained below.

The washing water sprayed from the stationary nozzles 330 and 340 may be reflected toward the dishes by the vane 400. The stationary nozzles 330 and 340 may be arranged under the lower basket 12*b* and the vane 400 may reflect the washing water sprayed from the stationary nozzles 330 and 340 upward. That is, the washing water sprayed from the stationary nozzles 330 and 340 may be reflected toward the dishes stored (contained or held) in the lower basket 12*b* by the vane 400.

The stationary nozzles 330 and 340 may have a plurality of spray holes 331 and 341 arranged in the horizontal direction of the washing tub 30, respectively. The washing water may be sprayed forward through the plurality of spray holes 331 and 341. As shown in FIG. 2, there are three spray holes 331 and three spray holes 341. However, the disclosure is not so limited and there may be less than or more than three spray holes for each stationary nozzle. The spray holes may be evenly or regularly distributed, and/or may be of the same size, or the spray holes may be irregularly distributed, and/or may be of a different size.

The vane 400 may extend along in the horizontal direction of the washing tub 30 (i.e., from left-to-right sides 33, 34 or right-to-left sides 34, 33) so as to entirely reflect the washing water sprayed from the plurality of spray holes 331 and 341 of the stationary nozzles 330 and 340. That is, one longitudinal end portion of the vane 400 may be provided adjacent to the left wall 33 of the washing tub 30 and the other longitudinal end portion of the vane 400 may be provided adjacent to the right wall 34 of the washing tub 30.

The vane 400 may linearly reciprocate in a spray direction of the washing water sprayed from the stationary nozzles 330 and 340. That is, the vane 400 may linearly reciprocate in the forward and rearward directions of the washing tub 30.

Accordingly, a linear spray structure including the stationary nozzles 330 and 340 and the vane 400 may wash entire regions of the washing tub 30 without a dead region. The linear spray structure differs from the rotation nozzles capable of spraying the washing water within a range of a radius of rotation thereof.

The stationary nozzles 330 and 340 may include a left stationary nozzle 330 arranged to the left of the washing tub 30 and a right stationary nozzle 340 arranged to the right of the washing tub 30. However, the disclosure is not so limited and there may be more than two stationary nozzles disposed in the dish washing machine. Further, there may be more than two stationary nozzles which are disposed adjacent to one another.

Although it will be described later, the rotating nozzles 311 and 313 and the stationary nozzles 330 and 340 may independently spray the washing water. Furthermore, the left stationary nozzle 330 and the right stationary nozzle 340 may also independently spray the washing water. For example, the left stationary nozzle 330 may be controlled to spray washing water alone, and the right stationary nozzle 340 may be controlled to spray washing water alone. For example, the left stationary nozzle 330 may be controlled to spray washing water at the same time that the right stationary nozzle 340 sprays washing water. For example, when the left stationary nozzle 330 and the right stationary nozzle 340 are controlled to spray washing water at the same time, the left stationary nozzle 330 and the right stationary nozzle 340 may be controlled independently or differently (e.g., the right stationary nozzle 340 may spray washing water at a different flow rate or using a different pattern than the left stationary nozzle 330), or the left stationary nozzle 330 and the right stationary nozzle 340 may be controlled in the same manner.

The washing water sprayed from the left stationary nozzle 330 may be reflected to only a left region of the washing tub 30 by the vane 400 and the washing water sprayed from the right stationary nozzle 340 may be reflected to only a right region of the washing tub 30 by the vane 400.

Thus, the dish washing machine may independently wash the left and right of the washing tub 30 in a divided manner. Of course, instead of the division of the washing tub into left and the right regions, the washing tub may be minutely divided as necessary. For example, there may be more than two stationary nozzles which are disposed adjacent to one another and the number of regions which are washed may correspond to the number of stationary nozzles (e.g., for the case of three stationary nozzles, there may be a left region, central region, and a right region). Alternatively, it may be possible that some of the wash water sprayed from a stationary nozzle of the dish washing machine 1 may be reflected by the vane into a region which is primarily washed by wash water sprayed from another nozzle and reflected by the vane. For example, there may be other nozzles (e.g., rotary nozzles) which are disposed in the bottom portion of the dish washing machine which may be disposed to wash regions independently from the regions washed by the stationary nozzles, or which may have some overlap with regions washed by the stationary nozzles.

Hereinafter, a main configuration of the dish washing machine according to the embodiment of the disclosure will be sequentially described in detail.

Figure 3:
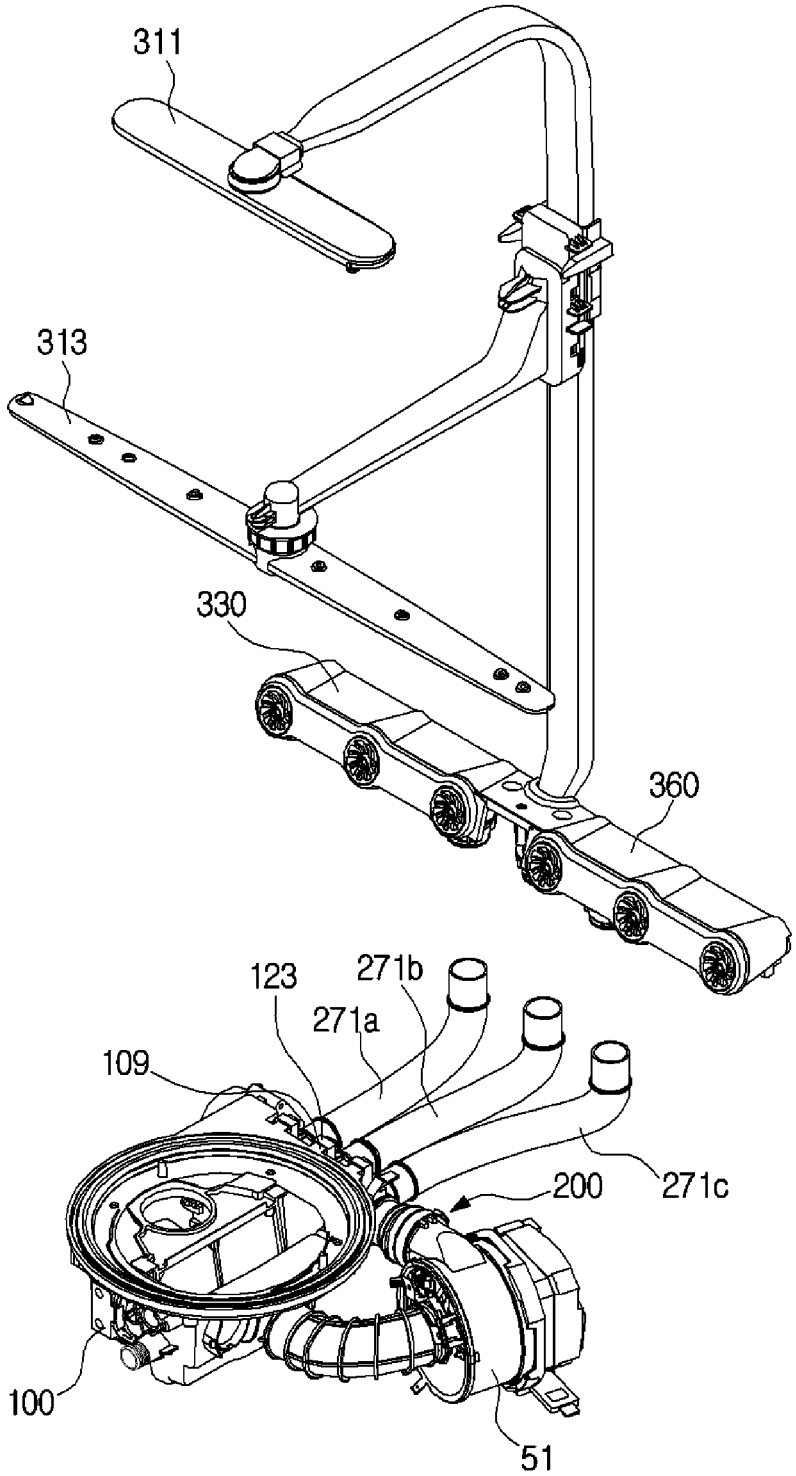
FIG. 3 is a view illustrating a passage structure of the dish washing machine in FIG. 1.
Figure 4:
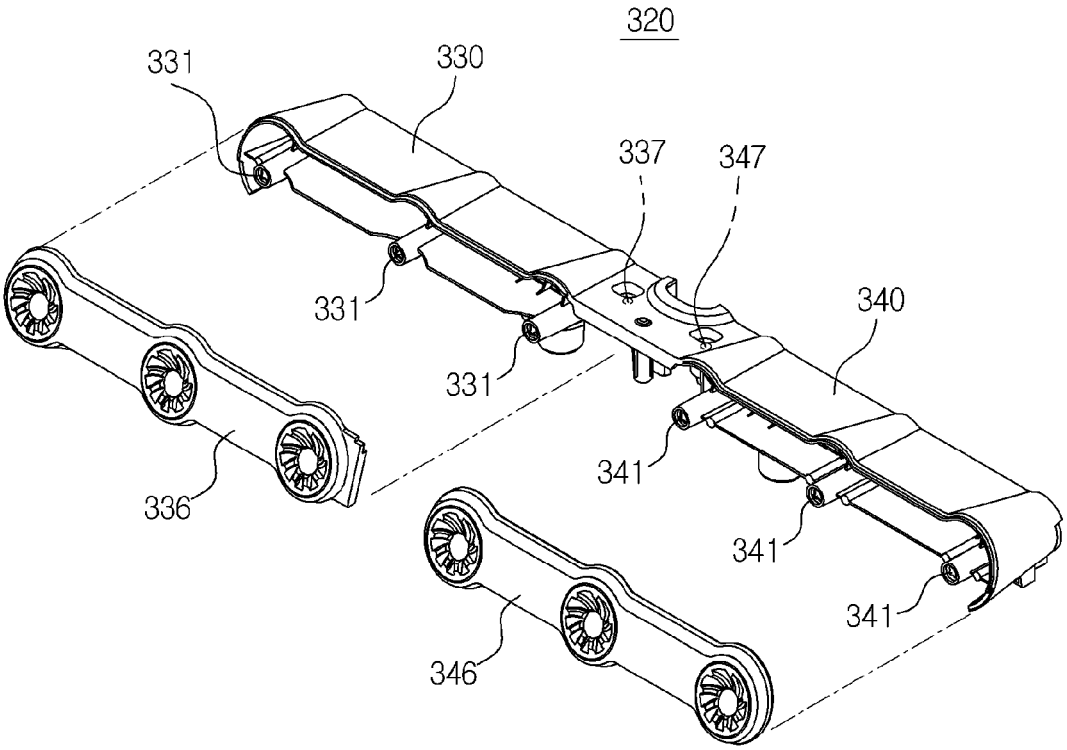
FIG. 4 is an exploded view illustrating a stationary nozzle assembly of the dish washing machine in FIG. 1.
Figure 5:
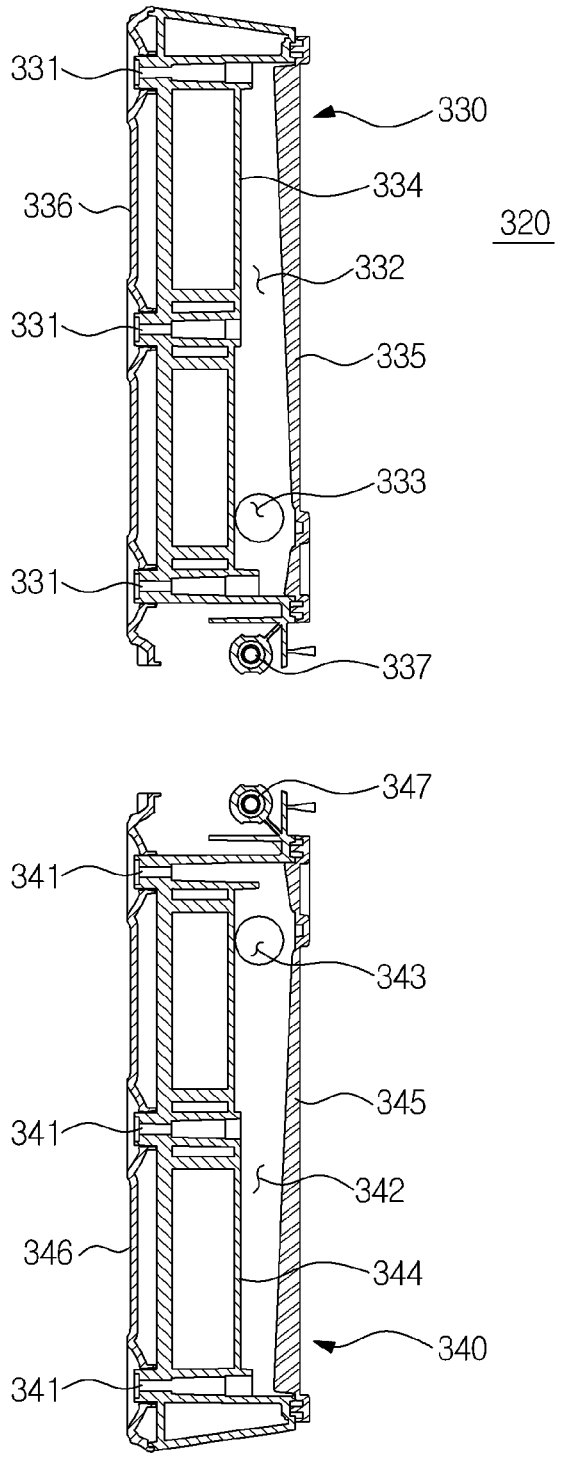
FIG. 5 is a cross-sectional view illustrating the stationary nozzle assembly of the dish washing machine in FIG. 1.

FIG. 3 is a view illustrating a passage structure of the dish washing machine in FIG. 1. FIG. 4 is an exploded view illustrating a stationary nozzle assembly of the dish washing machine in FIG. 1. FIG. 5 is a cross-sectional view illustrating the stationary nozzle assembly of the dish washing machine in FIG. 1.

Processes, a passage structure, a structure of the stationary nozzle assembly, and a washing water distribution structure in the dish washing machine according to an embodiment of the disclosure will be described with reference to FIGS. 3 to 5.

The dish washing machine may have a water supply process, a washing process, a drainage process, and a drying process.

In the water supply process, the washing water may be supplied into the washing tub 30 through a water supply pipe (not shown). The washing water supplied to the washing tub 30 may flow to the sump 100 provided at the lower portion of the washing tub 30 due to a gradient of the bottom plate 35 of the washing tub 30 so as to be stored in the sump 100.

In the washing process, the washing water in the sump 100 may be pumped when the circulation pump 51 operates. The washing water pumped by the circulation pump 51 may be distributed to the rotating nozzles 311 and 313, the left stationary nozzle 330, and the right stationary nozzle 340 through a distribution device 200. The washing water may be sprayed from the spray nozzles 311, 313, 330, and 340 at high pressure by a pumping force of the circulation pump 51 so as to wash the dishes.

Here, the washing water may be supplied to the upper rotating nozzle 311 and the intermediate rotating nozzle 313 from the distribution device 200 through a second hose 271*b*. The washing water may be supplied to the left stationary nozzle 330 from the distribution device 200 through a first hose 271*a*. The washing water may be supplied to the right stationary nozzle 340 from the distribution device 200 through a third hose 271*c*.

In an embodiment, the distribution device 200 may be provided to have a total of four distribution modes.

In the first mode, the distribution device 200 supplies the washing water to only the rotating nozzles 311 and 313 through the second hose 271*b*.

In the second mode, the distribution device 200 supplies the washing water to only the right stationary nozzle 340 through the third hose 271*c*.

In the third mode, the distribution device 200 supplies the washing water to only the left stationary nozzle 330 and the right stationary nozzle 340 through the first and third hoses 271*a* and 271*c*.

In the fourth mode, the distribution device 200 supplies the washing water to only the left stationary nozzle 330 through the first hose 271*a*.

However, of course, the distribution device 200 may also be provided to have more various distribution modes than four distribution modes, or may be provided to have less than four distribution modes.

The washing water sprayed from the spray nozzles 311, 313, 330, and 340 may strike the dishes to remove contaminants on the dishes, and may be stored in the sump 100 again by dropping together with the contaminants. The circulation pump 51 pumps and circulates the washing water stored in the sump 100 again. The circulation pump 51 may repeatedly operate and stop several times in the washing process. In this process, the contaminants dropping into the sump 100 together with the washing water may be collected by a filter mounted to the sump 100, and may be left in the sump 100 instead of being circulated to the spray nozzles 311, 313, 330, and 340.

In the drainage process, both of the washing water and the contaminants left in the sump 100 may be discharged to the outside of the main body 10 when the drainage pump 52 operates.

In the drying process, the dishes may be dried when a heater (not shown) mounted in the washing tub 30 operates.

The structures of the left and right stationary nozzles 330 and 340 will be described in detail.

The left stationary nozzle 330 may include one or more spray holes 331 through which the washing water is sprayed, a nozzle passage 332 through which the washing water is supplied to the spray holes 331, a nozzle inlet 333 through which the washing water is introduced into the nozzle passage 332, a nozzle body 334 defining an external appearance thereof, a nozzle cover 335 coupled to the rear of the nozzle body 334 so as to form the nozzle passage 332, a decoration member 336 coupled to the front of the nozzle body 334, and a coupling hole 337 formed on the nozzle body 334 so as to couple the left stationary nozzle 330 to a bottom plate cover 600 (see FIG. 20) to be described later.

The right stationary nozzle 340 may include spray holes 341 through which the washing water is sprayed, a nozzle passage 342 through which the washing water is supplied to the spray holes 341, a nozzle inlet 343 through which the washing water is introduced into the nozzle passage 342, a nozzle body 344 defining an external appearance thereof, a nozzle cover 345 coupled to the rear of the nozzle body 344 so as to form the nozzle passage 342, a decoration member 346 coupled to the front of the nozzle body 334, and a coupling hole 347 formed on the nozzle body 344 so as to couple the right stationary nozzle 340 to the bottom plate cover 600 to be described later. As can be seen from FIG. 4 and FIG. 5, the coupling hole 337 of the left stationary nozzle 330 may be disposed adjacent to the coupling hole 347 of the right stationary nozzle 340.

Here, the nozzle body 334 of the left stationary nozzle 330 may be integrally formed with the nozzle body 344 of the right stationary nozzle 340. Thus, the left and right stationary nozzles 330 and 340 may be integral with each other.

As such, as the left and right stationary nozzles 330 and 340 are provided to be integral with each other, it may be easier for the left and right stationary nozzles 330 and 340 to be horizontally aligned and it may be easier for the left and right stationary nozzles 330 and 340 to be coupled to the bottom plate cover 600.

A stationary nozzle assembly 320 may include the left stationary nozzle 330 and the right stationary nozzle 340. A nozzle assembly 300 may include the stationary nozzle assembly 320, the upper rotating nozzle 311, and the intermediate rotating nozzle 313.

Figure 6:
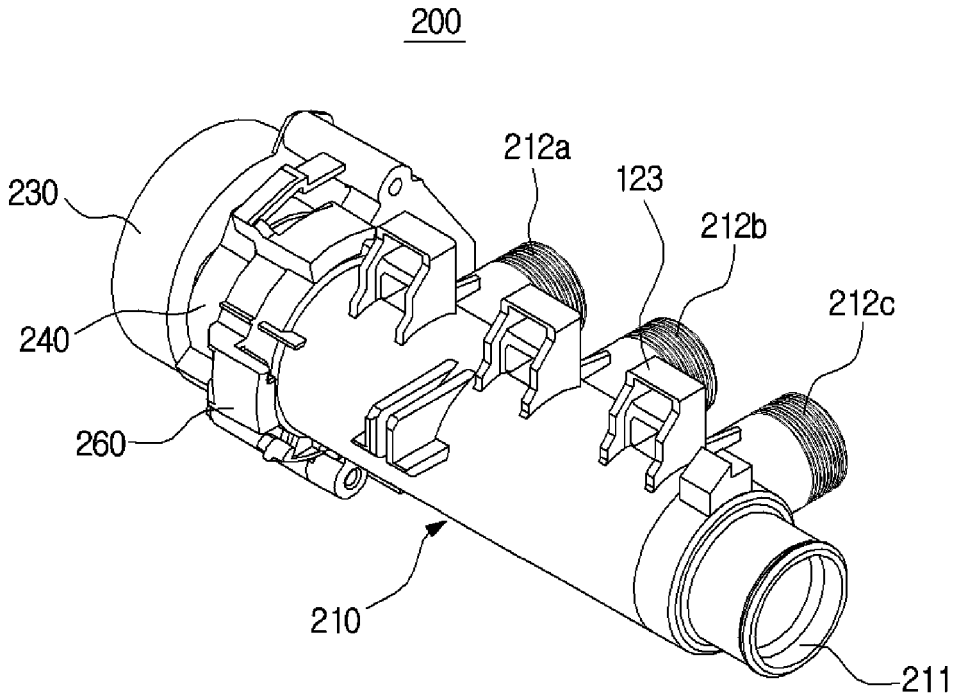
FIG. 6 is a view illustrating a distribution device of the dish washing machine in FIG. 1.
Figure 7:
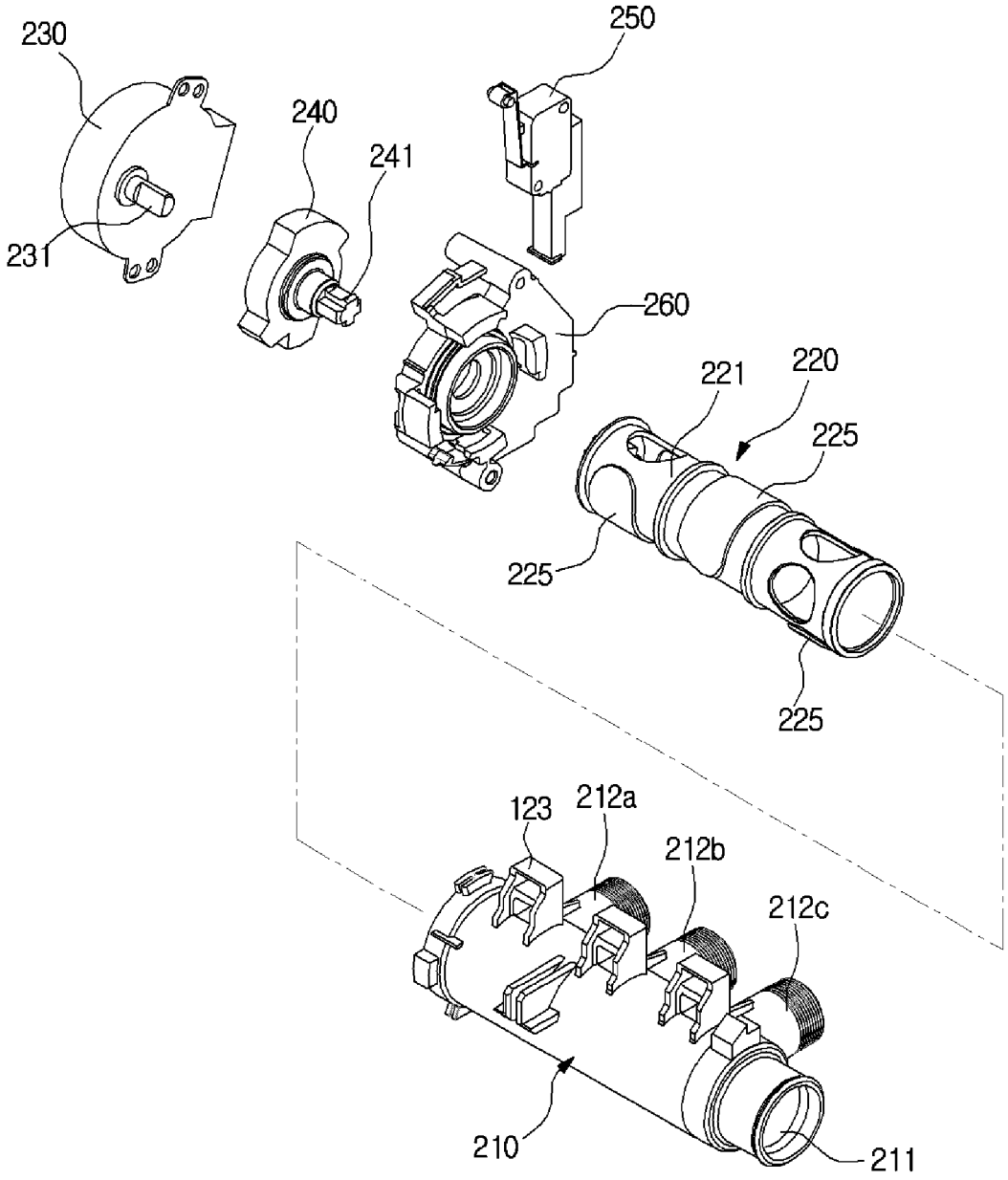
FIG. 7 is an exploded view illustrating a configuration of the distribution device of the dish washing machine in FIG. 1.
Figure 8:
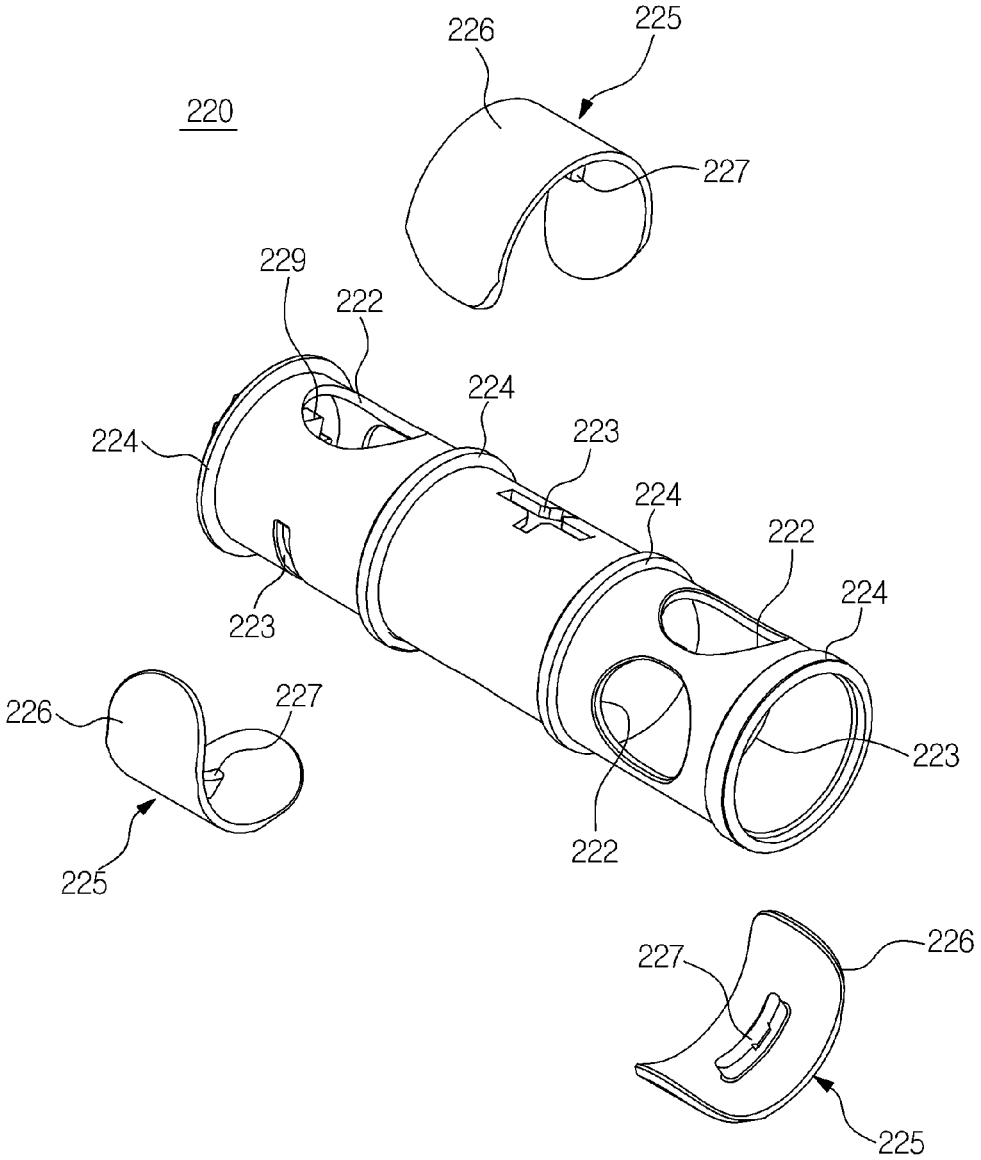
FIG. 8 is an exploded view illustrating a configuration of an opening and closing member of the distribution device of the dish washing machine in FIG. 1.
Figure 9:
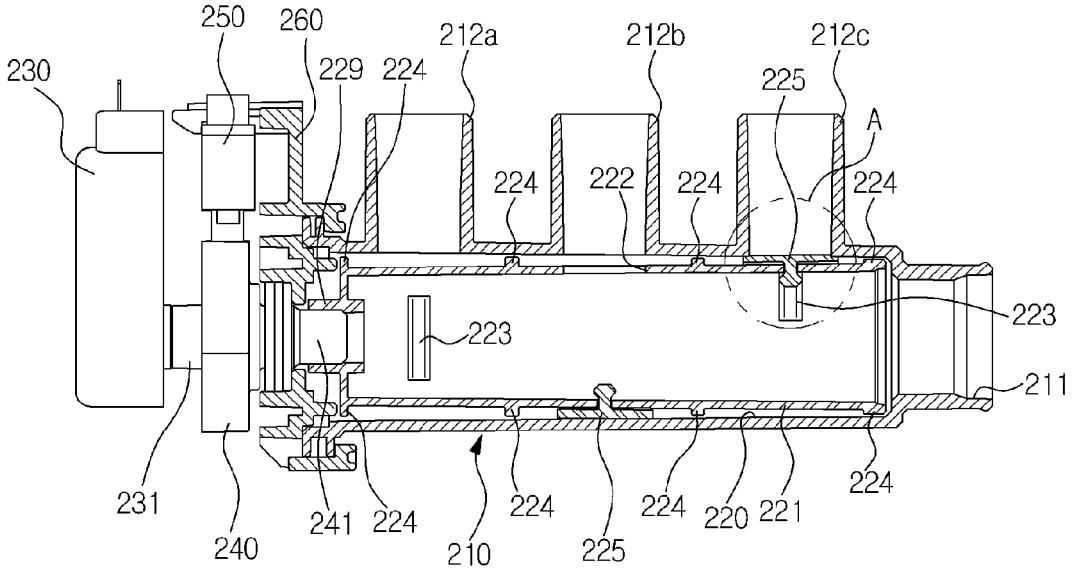
FIG. 9 is a cross-sectional view illustrating the distribution device of the dish washing machine in FIG. 1.
Figure 10:
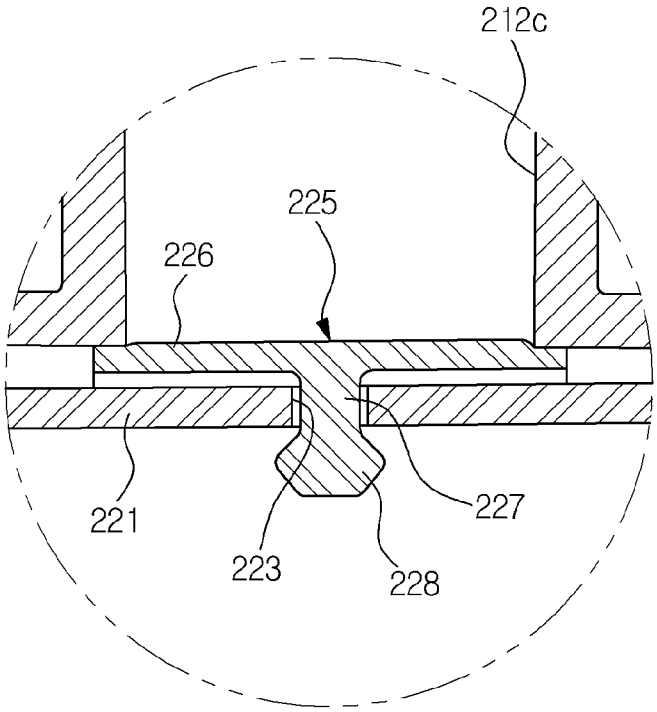
FIG. 10 is an enlarged view illustrating portion "A" in FIG. 9.

FIG. 6 is a view illustrating the distribution device of the dish washing machine in FIG. 1. FIG. 7 is an exploded view illustrating a configuration of the distribution device of the dish washing machine in FIG. 1. FIG. 8 is an exploded view illustrating a configuration of an opening and closing member of the distribution device of the dish washing machine in FIG. 1. FIG. 9 is a cross-sectional view illustrating the distribution device of the dish washing machine in FIG. 1. FIG. 10 is an enlarged view illustrating portion "A" in FIG. 9.

The distribution device of the dish washing machine according to an embodiment of the disclosure will be described with reference to FIGS. 6 to 10.

The distribution device 200 may have a substantially cylindrical shape (pipe shape, tubular shape).

The distribution device 200 may include a housing 210 which has a substantially hollow cylindrical shape and defines an external appearance thereof, an opening and closing member 220 rotatably provided in the housing 210, a motor 230 to rotate the opening and closing member 220, a support member 260 to support the motor 230 and the housing 210, a cam member 240 coupled to the motor 230 and the opening and closing member 220 so as to rotate along with the opening and closing member 220, and a micro switch 250 which comes into contact with the cam member 240 to detect a rotation position of the opening and closing member 220.

The housing 210 may be disposed longitudinally toward both side walls 33 and 34 (see FIG. 2) of the washing tub 30. Hereinafter, the longitudinal direction of the housing 210 is referred to as an axial direction. One axial end portion of the housing 210 may be formed with an inlet 211 through which the washing water is introduced into the housing 210. The motor 230 may be arranged at the other axial end portion of the housing 210.

Specifically, the inlet 211 may be provided to face toward the right wall 34 of the washing tub 30. When the circulation pump 51 is connected to the inlet 211 and operates, the washing water stored in the sump 100 may be introduced into the housing 210 through the inlet 211.

A plurality of outlets 212*a*, 212*b*, and 212*c* may be formed on a circumferential surface of the housing 210. The plurality of outlets 212*a*, 212*b*, and 212*c* may be arranged at regular intervals in the axial direction. The plurality of outlets 212*a*, 212*b*, and 212*c* may include a first outlet 212*a*, a second outlet 212*b*, and a third outlet 212*c*. Alternatively, the plurality of outlets may be irregularly arranged. Additionally, or alternatively, the plurality of outlets may have the same or different diameters from one another through which washing water flows.

Here, the plurality of outlets 212*a*, 212*b*, and 212*c* may be arranged to face toward the rear wall 32 (see FIG. 2) of the washing tub 30. As such, the plurality of outlets 212*a*, 212*b*, and 212*c* may be provided to face toward the rear wall 32 of the washing tub 30. This is because the distribution device 200 according to an embodiment of the disclosure has a structure in which the housing 210 has a cylindrical shape, the housing 210 is disposed longitudinally toward both side walls 33 and 34, and the opening and closing member 220 opens and closes the outlets 212*a*, 212*b*, and 212*c* while rotating about the axial direction of the housing 210.

In other words, since a typical distribution device used in a conventional dish washing machine has a housing having a hemispheric shape and a flat disk type opening and closing device rotatably provided at an upper portion of the housing, outlets have to be provided at an upper portion of the distribution device. That is, in a typical distribution device, the outlets are placed in the upper portion of the housing to face toward the upper wall of the dish washing machine. Thus, the flow path connected to the outlets is sharply curved backward as soon as the flow path starts from the outlets, resulting in reduced pressure.

As describe above, since the outlets 212*a*, 212*b*, and 212*c* may be provided toward the rear wall 32 of the washing tub 30 in the distribution device 200 according to an embodiment of the disclosure, it may be possible to decrease a pressure loss of the washing water supplied to the stationary nozzles 330 and 340 arranged adjacent to the rear wall 32 of the washing tub 30 in the distribution device 200.

This is because a passage through which the outlets 212*a*, 212*b*, and 212*c* are connected to the stationary nozzles 330 and 340 may be gently formed without a tight bent portion.

On the other hand, if the conventional distribution device provided such that the outlets face the upper portion of the distribution device is applied to the stationary nozzles 330 and 340 according to an embodiment of the disclosure, the passage connected to the outlets has to be tightly bent rearward immediately from the outlets. For this reason, the pressure loss is increased.

The first, second, third outlets 212*a*, 212*b*, and 212*c* may be sequentially arranged to the right from the left of the washing tub 30.

That is, the first outlet 212*a* may be relatively closer to the left stationary nozzle 330, the third outlet 212*c* may be relatively closer to the right stationary nozzle 340, and the second outlet 212*b* may be disposed at the center between the left stationary nozzle 330 and the right stationary nozzle 340.

The first outlet 212*a* may be connected to the left stationary nozzle 330 through the first hose 271*a* (see FIG. 3). The second outlet 212*b* may be connected to the rotating nozzles 311 and 313 through the second hose 271*b* (see FIG. 3). The third outlet 212*c* may be connected to the right stationary nozzle 340 through the third hose 271*c* (see FIG. 3).

As such, since the outlets 212*a*, 212*b*, and 212*c* are respectively connected to the spray nozzles 311, 313, 330, and 340 relatively closer to the outlets 212*a*, 212*b*, and 212*c*, the lengths of the hoses 271*a*, 271*b*, and 271*c* may be shortened, the twist thereof may not be generated, and the pressure loss of the washing water may be reduced.

The housing 210 may be provided with a sump coupling portion 123 to be coupled to the sump 100, and the sump 100 may be provided with a distribution device coupling portion 109 (see FIG. 3) coupled to the sump coupling portion 123. In an embodiment, the sump coupling portion 123 may be provided in a groove shape and the distribution device coupling portion 109 may be provided in a protrusion shape.

The positions of the distribution device 200 and the sump 100 may be aligned by coupling of the sump coupling portion 123 and the distribution device coupling portion 109.

The opening and closing member 220 may selectively open and close the outlets 212*a*, 212*b*, and 212*c* while rotating about the axial direction of the housing 210 within the housing 210. Thus, the opening and closing member 220 substantially serves to distribute the washing water to the spray nozzles 311, 313, 330, and 340.

The opening and closing member 220 may have a substantially hollow cylindrical shape. The opening and closing member 220 may include a rotation body 221 which rotates in the housing 210 and sealing members 225 coupled to the rotation body 221 so as to close the outlets 212*a*, 212*b*, and 212*c*.

Communication holes 222 may be formed on a circumferential surface of the rotation body 221. The communication holes may be circular in shape, for example. However, the disclosure is not so limited and the communication holes may be differently shaped (e.g., oval, square, triangular, etc.). When the communication holes 222 are located to correspond to the outlets 212*a*, 212*b*, and 212*c*, the washing water may be smoothly discharged through the outlets 212*a*, 212*b*, and 212*c*.

In addition, the circumferential surface of the rotation body 221 may be formed with spacing protrusions 224 through which an inner peripheral surface of the housing 210 is spaced a predetermined distance from an outer peripheral surface of the rotation body 221, such that the opening and closing member 220 may smoothly rotate by minimized friction with the housing 210 when the opening and closing member 220 rotates in the housing 210. A gap between the inner peripheral surface of the housing 210 and the outer peripheral surface of the rotation body 221 may be always uniformly maintained by the spacing protrusions 224. As shown in FIG. 9, spacing protrusions 224 may be provided at both ends of the opening and closing member 220 and at one or more positions between the ends of the opening and closing member 220.

In addition, the circumferential surface of the rotation body 221 may be formed with one or more catching holes 223 coupled with the sealing members 225. Catching protrusion portions 227 of the sealing members 225 may be coupled to the catching holes 223. The catching holes 223 may have different shapes so as to correspond to the shapes of the catching protrusion portions 227 of the sealing members 225.

For example, the central catching hole 223 may have a substantially cross shape, and the catching holes 223 on both sides may have a substantially straight shape. Similarly, the catching protrusion portion of the central sealing member 225 may be provided to have a cross shape, and the catching protrusion portions 227 on both sides may be provided to have a straight shape. Alternatively, the central catching hole and catching protrusion of the central sealing member 225 may have a straight shape and the other portions of the rotation body and corresponding sealing members may have catching holes and catching protrusions with cross shapes. Alternatively, different shapes may be used.

This enables the sealing members 225 to be easily identified when the sealing member 225 coupled at the central side has a different shape from the sealing members 225 coupled at both sides during assembly of them.

One end portion of both axial end portions of the rotation body 221 corresponding to the inlet 211 of the housing 210 is opened. The other end portion of both axial end portions of the rotation body 221 may be provided with a cam shaft coupling portion 229 coupled with a cam shaft 241 of the cam member 240.

The sealing members 225 may be coupled on the circumferential surface of the rotation body 221 so as to close the outlets 212*a*, 212*b*, and 212*c*. The sealing members 225 may be coupled to the catching holes 223 of the rotation body 221. The sealing members 225 may be coupled to the catching holes 223 of the rotation body 221 so as to be slightly movable in the radial direction. This enables the sealing members 225 to come into close contact with the outlets 212*a*, 212*b*, and 212*c* so as to reinforce sealing of the outlets 212*a*, 212*b*, and 212*c*.

That is, each of the sealing members 225 may move between an opened position at which the sealing member 225 comes into close contact with the rotation body 221 and a closed position at which the sealing member 225 comes into close contact with the associated outlet 212*a*, 212*b*, and 212*c*. When the washing water is introduced into the housing 210, the sealing member 225 may smoothly move from the opened position to the closed position by hydraulic pressure of the washing water. Thus, reliability of the distribution device 200 may be enhanced due to improvement in sealing force of the 212*a*, 212*b*, and 212*c*.

The sealing member 225 may include a sealing portion 226 (see FIG. 8) having a curved shape so as to come into close contact with the associated outlet 212*a*, 212*b*, and 212*c*, and the catching protrusion portion 227 protruding from the sealing portion 226 so as to be inserted into the associated catching hole 223 of the rotation body 221.

The catching protrusion portion 227 and the catching hole 223 may be provided to be slightly spaced apart from each other such that the sealing member 225 is radially movable. Instead, a stopper portion 228 having a larger diameter than the catching hole 223 may be formed at an end portion of the catching protrusion portion 227 so as to prevent the sealing member 225 from being fully decoupled from the catching hole 223.

The sealing member 225 may be integrally made of a resin material. The sealing member 225 may be easily assembled to the rotation body 221 in such a way that the sealing member 225 is inserted into the catching hole 223 by forcibly pressing the catching protrusion portion 227. After the sealing member 225 is assembled, the stopper portion 228 is caught by the catching hole 223 and thus the sealing member 225 is not decoupled from the rotation body 221 unless a force is manually applied thereto (e.g., by a user).

Figure 11:
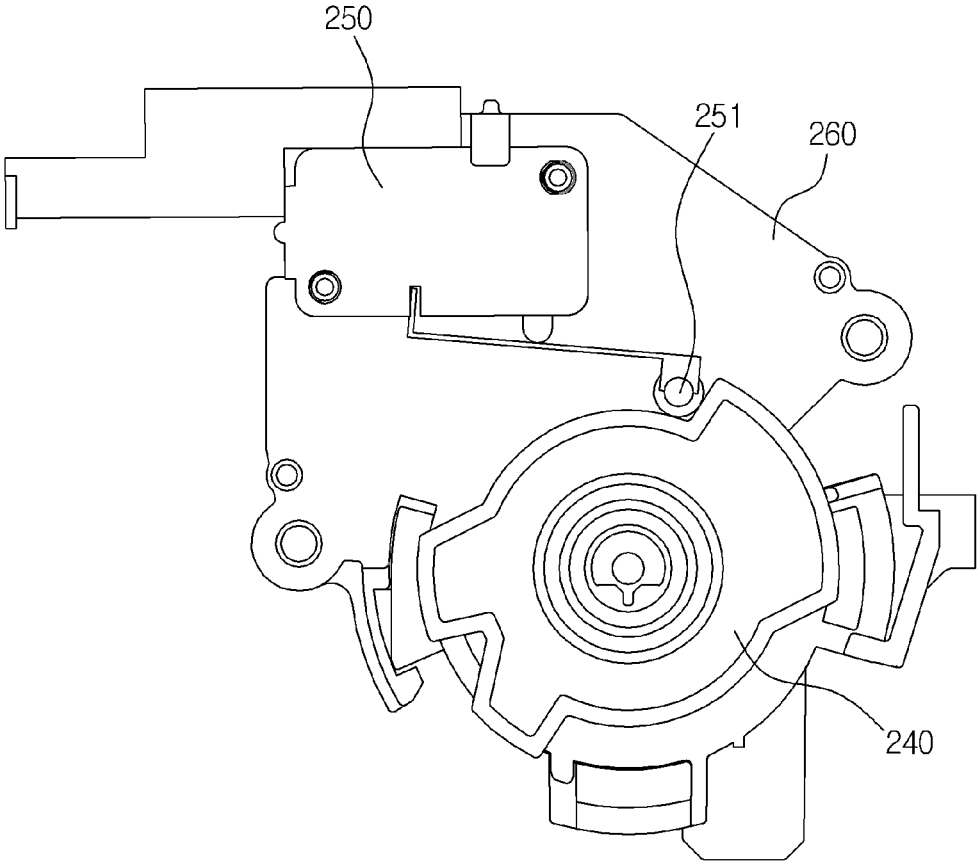
FIG. 11 is side view illustrating the distribution device of the dish washing machine in FIG. 1 (here, a motor being omitted)
Figure 12:
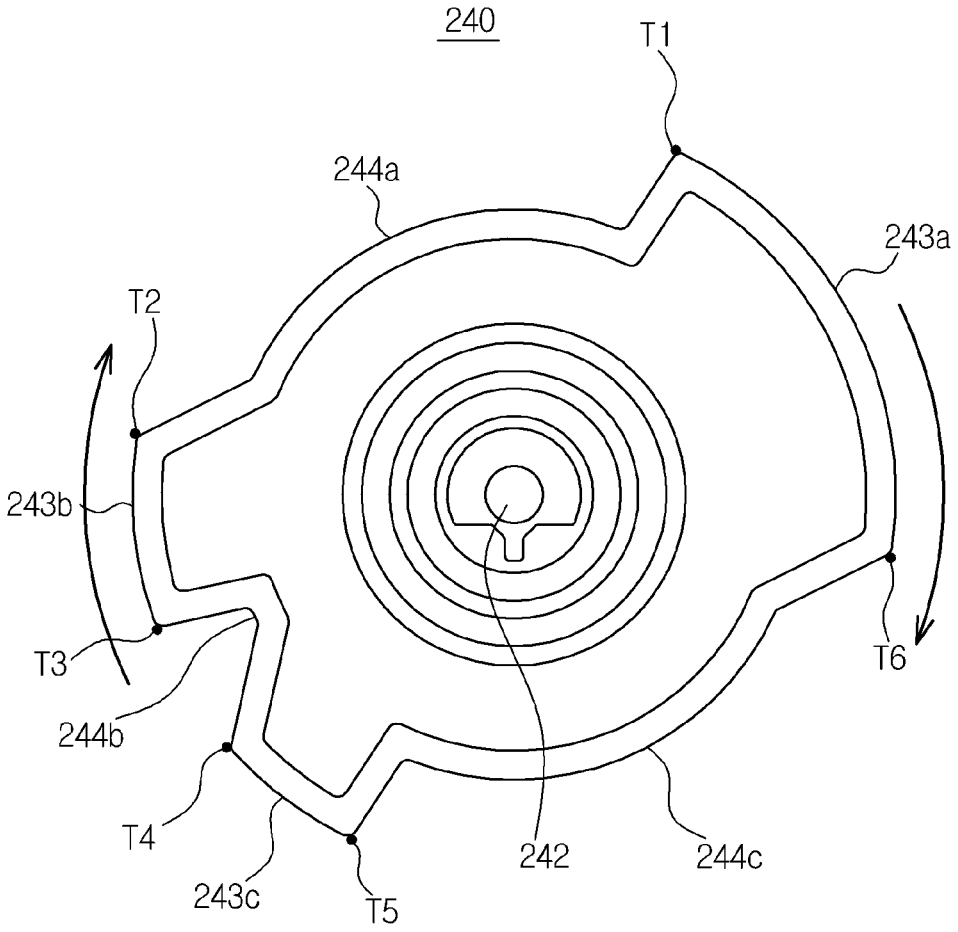
FIG. 12 is an enlarged view illustrating a cam member of the distribution device of the dish washing machine in FIG. 1.
Figure 13:
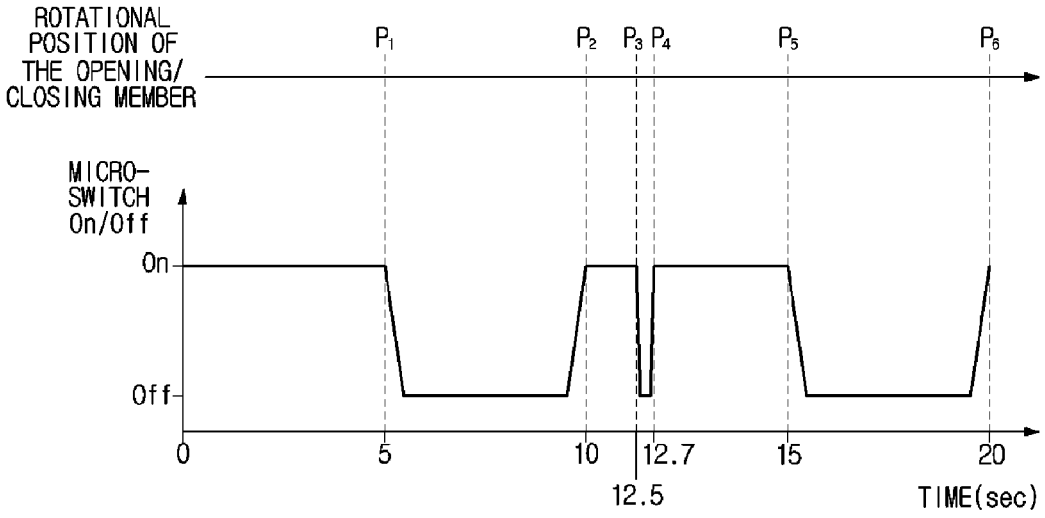
FIG. 13 is a diagram illustrating a relationship between an on/off time of a micro switch and a rotation position of the opening and closing member in the distribution device of the dish washing machine in FIG. 1.
Figure 14:
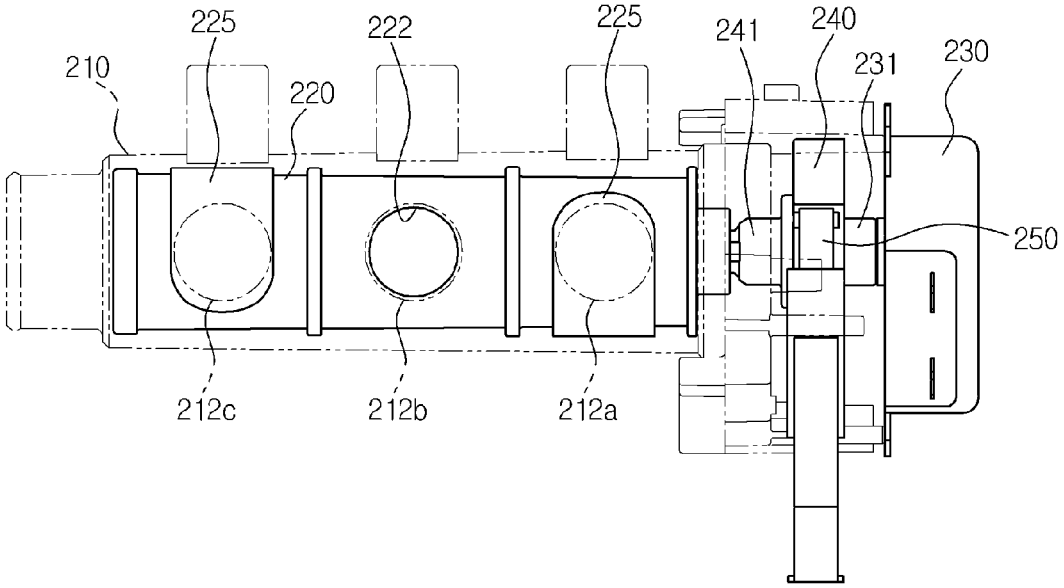
FIG. 14 is a view illustrating an operation of the distribution device of the dish washing machine in FIG. 1, and an operation in which washing water is distributed only to rotating nozzles by opening of only a second outlet.
Figure 15:
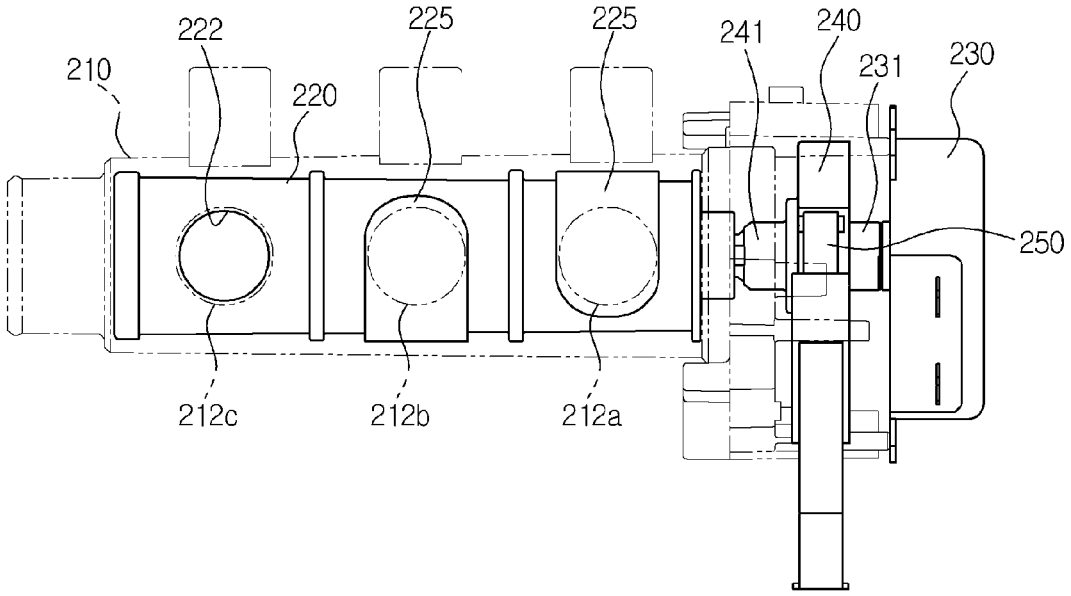
FIG. 15 is a view illustrating an operation of the distribution device of the dish washing machine in FIG. 1, and an operation in which washing water is distributed only to a right stationary nozzle by opening of only a third outlet.
Figure 16:
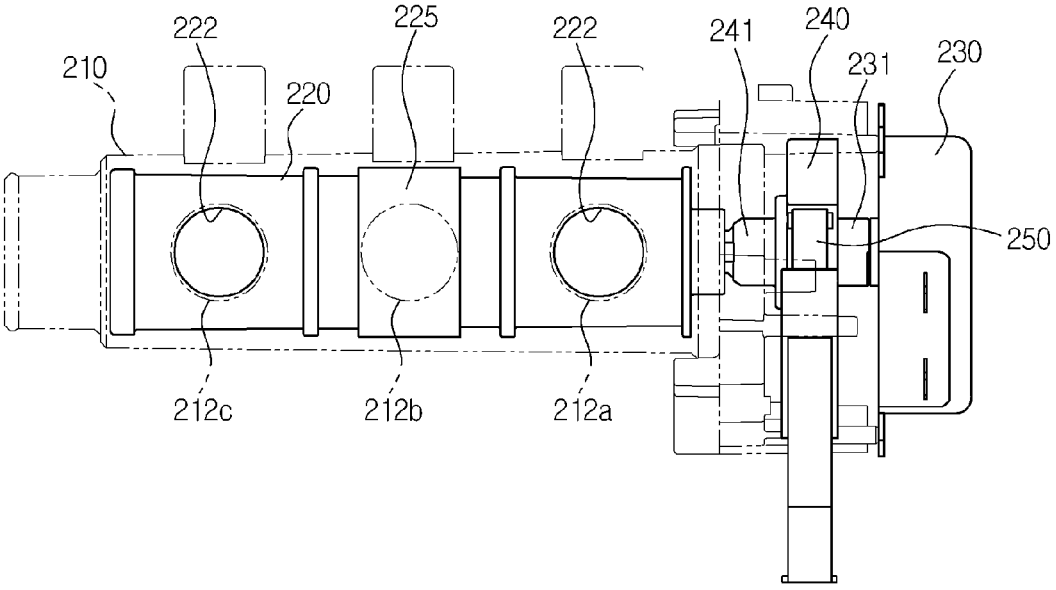
FIG. 16 is a view illustrating an operation of the distribution device of the dish washing machine in FIG. 1, and an operation in which washing water is distributed only to a left stationary nozzle and a right stationary nozzle by opening of only a first outlet and a third outlet.
Figure 17:
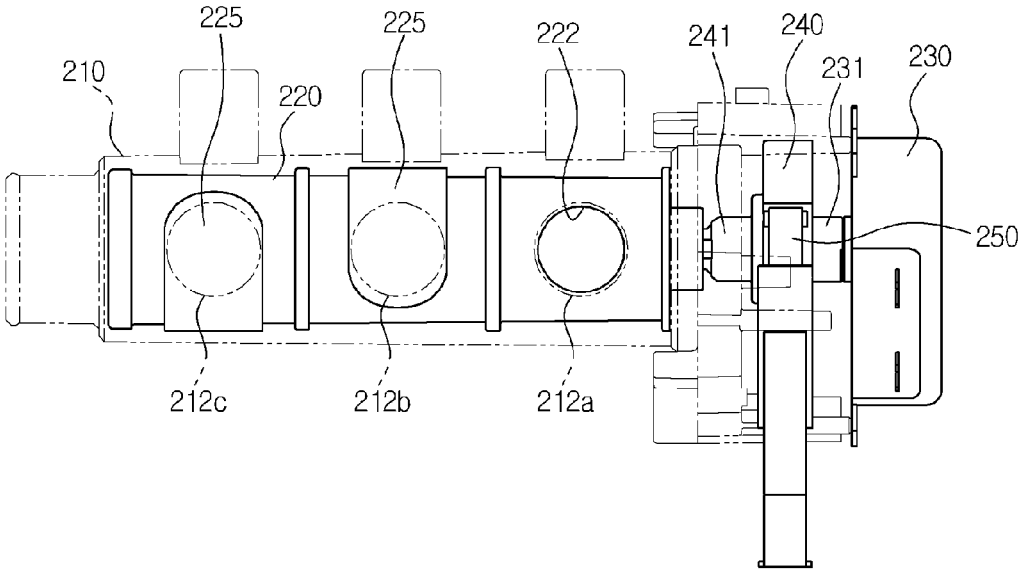
FIG. 17 is a view illustrating an operation of the distribution device of the dish washing machine in FIG. 1, and an operation in which washing water is distributed only to a left stationary nozzle by opening of only a first outlet.

FIG. 11 is side view illustrating the distribution device of the dish washing machine in FIG. 1 (here, the motor being omitted). FIG. 12 is an enlarged view illustrating the cam member of the distribution device of the dish washing machine in FIG. 1. FIG. 13 is a diagram illustrating a relationship between an on/off time of the micro switch and a rotation position of the opening and closing member in the distribution device of the dish washing machine in FIG. 1. FIG. 14 is a view illustrating an operation of the distribution device of the dish washing machine in FIG. 1, and an operation in which the washing water is distributed only to the rotating nozzles when only the second outlet is opened. FIG. 15 is a view illustrating an operation of the distribution device of the dish washing machine in FIG. 1, and an operation in which the washing water is distributed only to the right stationary nozzle when only the third outlet is opened. FIG. 16 is a view illustrating an operation of the distribution device of the dish washing machine in FIG. 1, and an operation in which the washing water is distributed only to the left stationary nozzle and the right stationary nozzle when only the first outlet and the third outlet are opened. FIG. 17 is a view illustrating an operation of the distribution device of the dish washing machine in FIG. 1, and an operation in which the washing water is distributed only to the left stationary nozzle when only the first outlet is opened.

The operation of the distribution device according to the embodiment of the disclosure will be described with reference to FIGS. 11 to 17.

When the motor 230 operates, a rotational force is transferred to the cam member 240 through a motor shaft 231 and the cam member 240 rotates. The motor 230 may be a one-way motor rotating only in one direction. For example, the cam member 240 may rotate in a counterclockwise or clockwise direction.

For convenience, it is assumed that the cam member 240 rotates about a rotation center 242 in the clockwise direction based on FIG. 12. When the cam member 240 rotates, the rotational force is transferred to the opening and closing member 220 through the cam shaft 241 and the opening and closing member 220 rotates together with the cam member 240.

A contact terminal 251 of the micro switch 250 may be provided for the cam member 240 so as to come into contact with the cam member 240. The cam member 240 may include convex portions 243*a*, 243*b*, and 243*c* which radially protrude to turn on/off the micro switch 250, and concave portions 244*a*, 244*b*, and 244*c* which are radially recessed.

The convex portions 243*a*, 243*b*, and 243*c* may include a first convex portion 243*a*, a second convex portion 243*b*, and a third convex portion 243*c* which are sequentially arranged in the counterclockwise direction. The concave portions 244*a*, 244*b*, and 244*c* may include a first concave portion 244*a*, a second concave portion 244*b*, and a third concave portion 244*c* which are sequentially arranged in the counterclockwise direction. As shown in FIG. 12, the concave portions may be arranged alternately with the convex portions It is assumed that the micro switch 250 is turned on when the contact terminal 251 comes into contact with the convex portions 243*a*, 243*b*, and 243*c* of the cam member 240 and the micro switch 250 is turned off when the contact terminal 251 comes into contact with the concave portions 244*a*, 244*b*, and 244*c* of the cam member 240. Thus, when the motor 230 is driven, the micro switch 250 may be alternately turned on/off.

Meanwhile, the distribution device 200 further may include a control unit (a controller) which designates rotation positions of the opening and closing member 220 according to the on/off time of the micro switch 250 and rotates or stops the motor 230 so as to rotate the opening and closing member 220 to a required specific rotation position of the designated rotation positions. The control unit may be configured as an electronic circuit and may include one or more processors.

For example, the control unit may designate six rotation positions P1, P2, P3, P4, P5, and P6 of the opening and closing member 220, as shown in FIG. 13.

The control unit may designate a rotation position of the opening and closing member 220 at a point of time at which the micro switch 250 is turned on for five seconds and then turned off as a first rotation position P1 of the six rotation positions P1, P2, P3, P4, P5, and P6 of the opening and closing member 220.

In accordance with an aspect of the disclosure, since the point of time at which the micro switch 250 is turned on for five seconds and then turned off is the only one, a section during which the micro switch 250 is turned on for five seconds may become a reference reset section.

In addition, the control unit may designate a rotation position of the opening and closing member 220 at a point of time at which the micro switch 250 is turned on for five seconds, turned off for five seconds, and then turned on again as a second rotation position P2.

In such a manner, the control unit may designate the rotation positions as the first rotation position P1 to a sixth rotation position P6.

At the six rotation positions P1, P2, P3, P4, P5, and P6 of the opening and closing member 220, the contact terminal 251 of the micro switch 250 is located at each of contact terminal positions T1, T2, T3, T4, T5, and T6 shown in FIG. 12.

Rotation position information of the opening and closing member 220 according to the on/off time of the micro switch 250 may be previously stored in a memory (e.g., a ROM form) in the control unit.

In addition, opening and closing information of the outlets 212*a*, 212*b*, and 212*c* of the distribution device 200 according to the respective rotation positions of the opening and closing member 220 and spray information of the spray nozzles 311, 313, 330, and 340 according to opening and closing of the outlets 212*a*, 212*b*, and 212*c* may also be previously stored in a memory (e.g., a ROM form) in the control unit.

Accordingly, when a user inputs or selects a specific spray nozzle 311, 313, 330, or 340 intended for use, the control unit may accordingly determine an outlet 212*a*, 212*b*, or 212*c* to be opened and closed and thus determine a specific rotation position of the opening and closing member 220.

The control unit may drive the motor 230 so as to rotate the opening and closing member 220 to a determined specific rotation position, and stop the driving of the motor 230 when the rotation of the opening and closing member 220 to the specific rotation position is completed.

In an embodiment, when the opening and closing member 220 is at the first rotation position P1, only the second outlet 212*b* is opened and thus the washing water may be distributed to only the rotating nozzles 311 and 313, as shown in FIG. 14.

When the opening and closing member 220 is at the second rotation position P2, only the third outlet 212*c* is opened and thus the washing water may be distributed to only the right stationary nozzle 340, as shown in FIG. 15.

The third and fourth rotation positions P3 and P4 of the opening and closing member 220 may not be used.

When the opening and closing member 220 is at the fifth rotation position P5, only the first and third outlets 212*a* and 212*c* are opened and thus the washing water may be distributed to only the left and right stationary nozzles 330 and 340, as shown in FIG. 16.

When the opening and closing member 220 is at the sixth rotation position P6, only the first outlet 212*a* is opened and thus the washing water may be distributed to only the left stationary nozzle 330, as shown in FIG. 17.

Figure 18:
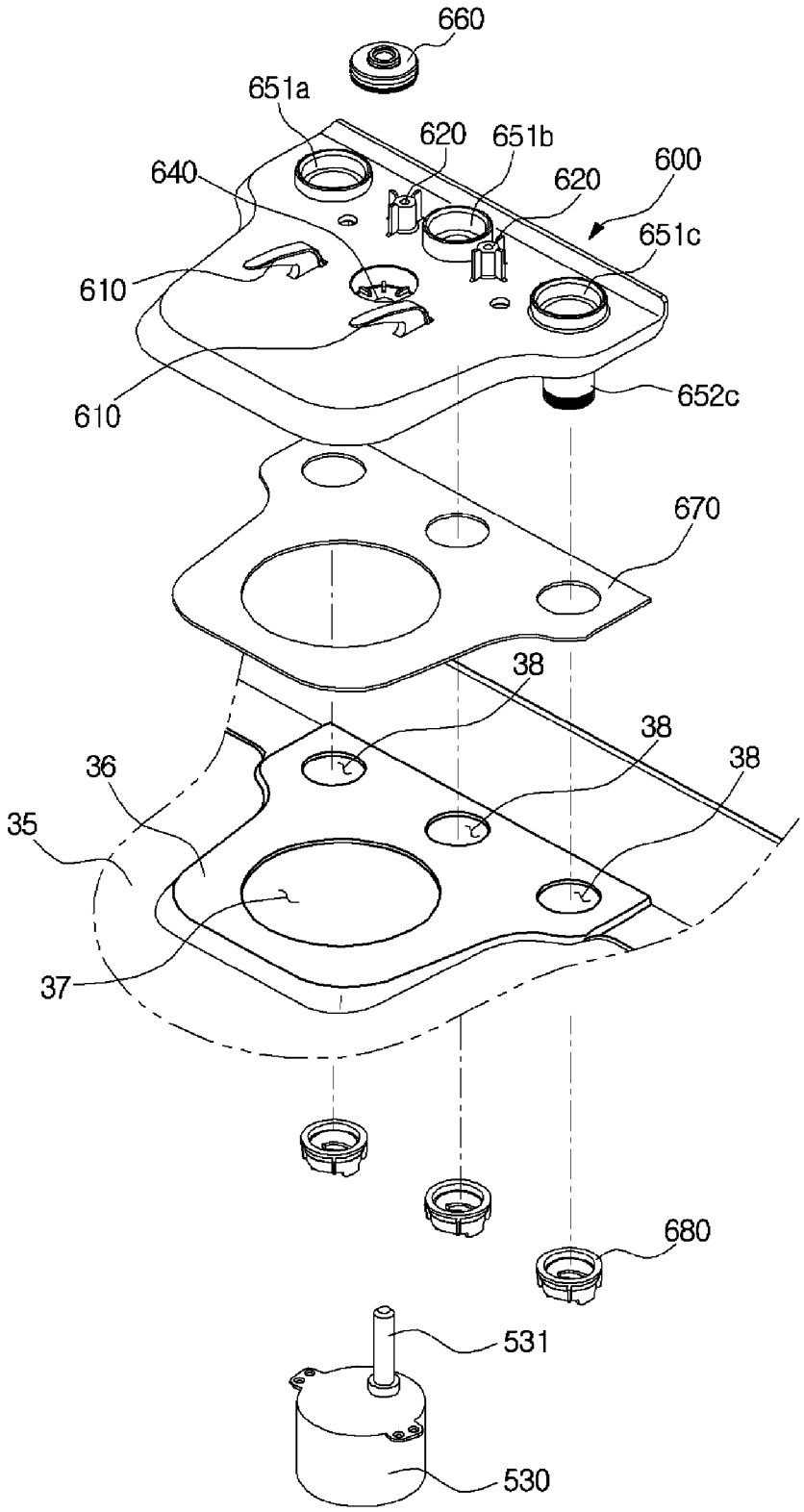
FIG. 18 is an exploded view illustrating a bottom plate of a washing tub, a bottom plate cover, and a motor of the dish washing machine in FIG. 1.
Figure 19:
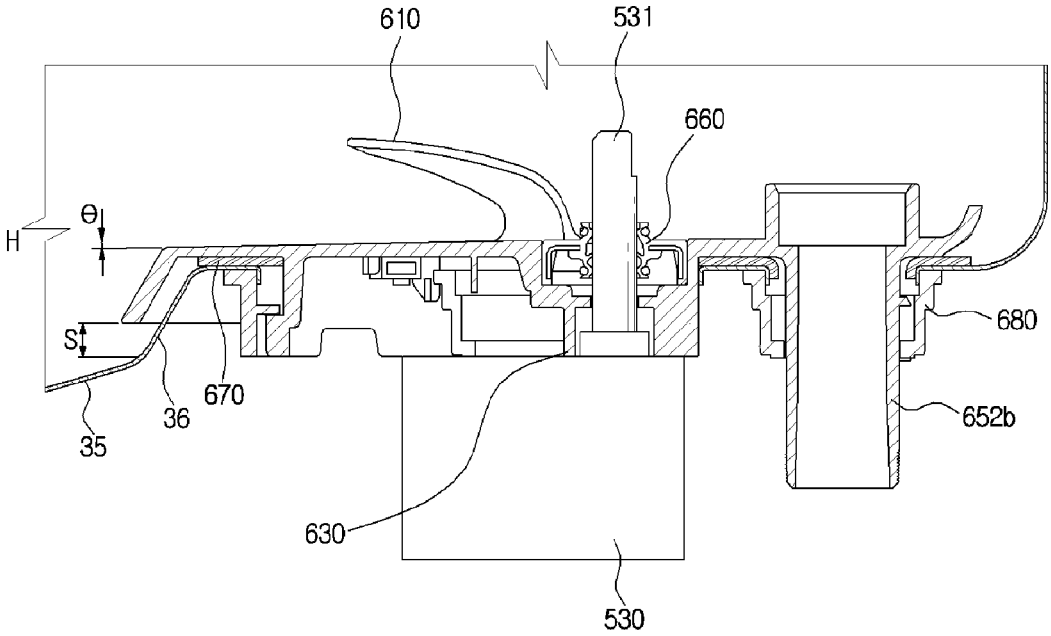
FIG. 19 is a cross-sectional view illustrating the bottom plate, the bottom plate cover, and the motor of the dish washing machine in FIG. 1.
Figure 20:
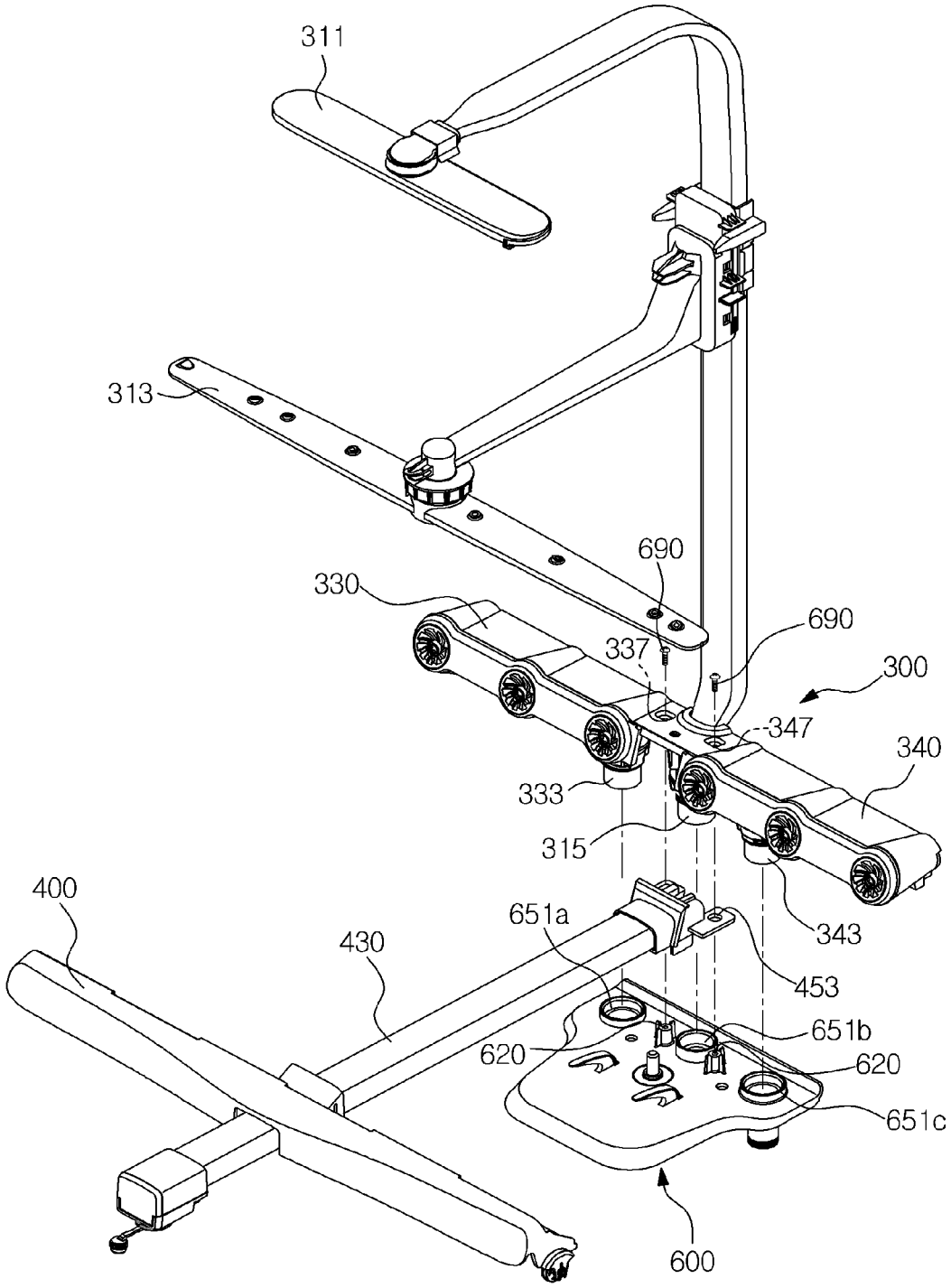
FIG. 20 is an exploded view illustrating a vane, a rail assembly, a spray nozzle assembly, and a bottom plate cover of the dish washing machine in FIG. 1.

FIG. 18 is an exploded view illustrating the bottom plate of the washing tub, the bottom plate cover, and the motor of the dish washing machine in FIG. 1. FIG. 19 is a cross-sectional view illustrating the bottom plate, the bottom plate cover, and the motor of the dish washing machine in FIG. 1. FIG. 20 is an exploded view illustrating a vane, a rail assembly, a spray nozzle assembly, and the bottom plate cover of the dish washing machine in FIG. 1.

The bottom plate cover of the dish washing machine according to an embodiment of the disclosure will be described with reference to FIGS. 18 to 20.

The dish washing machine 1 may include the bottom plate cover 600 coupled to one side of the rear of the bottom plate 35 of the washing tub 30.

The bottom plate cover 600 may serve to seal a motor through-hole 37 and passage through-holes 38 formed on the bottom plate 35, to support a motor 530 driving the vane 400, and to fix a rail assembly 430 and the nozzle assembly 300 of the dish washing machine 1.

As described above, the nozzle assembly 300 may include the upper rotating nozzle 311, the intermediate rotating nozzle 313, the left stationary nozzle 330, and the right stationary nozzle 340.

The rail assembly 430 serves to guide movement of the vane 400 and a detailed configuration thereof will be described later.

The rear of the bottom plate 35 may be formed with a bottom plate protrusion portion 36 protruding so as to be coupled to the bottom plate cover 600. The bottom plate protrusion portion 36 may be formed with the motor through-hole 37 through which the motor 530 used to drive the vane 400 passes and the passage through-holes 38 through which the passage allowing the nozzle assembly 300 to be connected to the distribution device 200 (see FIG. 3) passes.

The motor 530 may be mounted on a back surface of the bottom plate cover 600, and the motor 530 may be withdrawn together with the bottom plate cover 600 through the motor through-hole 37 when the bottom plate cover 600 is separated from the bottom plate 35.

Specifically, a plurality of hose connection portions of the bottom plate cover 600 may pass through the passage through-holes 38.

The bottom plate cover 600 may include a shaft through-hole 640 through which a drive shaft 531 of the motor 530 passes, a plurality of hose connection portions which protrude downward such that the hoses 271*a*, 271*b*, and 271*c* extending from the distribution device 200 may be coupled thereto and are inserted into the passage through-holes 38 of the bottom plate protrusion portion 36, nozzle inlet connection portions 651*a*, 651*b*, and 651*c* which protrude upward such that inlets 315, 333, and 343 of the nozzle assembly 300 are coupled thereto, one or more fastening holes 620 through which the nozzle assembly 300 is fixed to the rail assembly 430, and one or more rotation guide 610s which protrude to guide rotation of the vane 400. As shown in FIGS. 18 and 19 hose connection portions 652*b* and 652*c* correspond to hoses 271*b* and 271*c*. An additional hose connection portion which is not visible in the drawings also corresponds to hose 271*a* and is disposed below nozzle inlet connection portion 651*a*.

The bottom plate cover 600 may be closely coupled to an upper surface of the bottom plate protrusion portion 36. Stationary caps 680 may be coupled to the plurality of hose connection portions of the bottom plate cover 600 so that the bottom plate cover 600 may be fixed to the bottom plate protrusion portion 36.

A sealing member 670 may be provided between the bottom plate cover 600 and the bottom plate protrusion portion 36 such that the washing water in the washing tub 30 does not leak through the motor through-hole 37 of the bottom plate protrusion portion 36 and the passage through-holes 38. The sealing member 670 may be made of a rubber material.

The back surface of the bottom plate cover 600 may be provided with a motor mounting portion 630 to which the motor 530 configured to drive the vane 400 is mounted. The drive shaft 531 of the motor 530 may pass through the shaft through-hole 640 of the bottom plate cover 600 and protrude into the washing tub 30. A drive pulley 500 (see FIG. 21) to be described later may be coupled to the drive shaft 531 of the motor 530 and rotate together with the drive shaft 531.

The shaft through-hole 640 may be provided with a sealing member 660 such that the washing water in the washing tub 30 does not leak through the shaft through-hole 640. The sealing member 660 may be a mechanical sealing device which serves to perform sealing together with smooth rotation of the drive shaft 531. As can be seen from FIG. 19, a portion of the shaft 531 may protrude through the shaft through-hole 640 and the sealing member 660.

The upper surface of the bottom plate cover 600 may be inclined by a predetermined angle θ (see FIG. 19) based on a reference horizontal plane H (see FIG. 19).

This is to prevent contaminants from being collected on the bottom plate cover 600 or to prevent contaminants from moving toward the stationary spray nozzles 330 and 340. In the dish washing machine 1 according to an embodiment of the disclosure, since the stationary spray nozzles 330 and 340 are not moved unlike the rotating nozzles 311 and 313, contaminants may remain and be stagnant. Therefore, through such a structure, it may be possible to prevent generation of the above problem.

The inclined angle θ between the upper surface of the bottom plate cover 600 and the reference horizontal plane H may be approximately an angle of about 3° or more.

In addition, an end portion of the bottom plate cover 600 may be spaced a predetermined distance S from the bottom plate 35 (see FIG. 19). This is to prevent a difficulty that the bottom plate cover 600 comes into full contact with the bottom plate 35 due to tolerances of manufacture and assembly and to prevent contaminants from being caught in a minute clearance (gap) formed between the end portion of the bottom plate cover 600 and the bottom plate 35. The distance S between the end portion of the bottom plate cover 600 and the bottom plate 35 may be approximately 5 mm or more.

The rail assembly 430 and the nozzle assembly 300 may be coupled to the bottom plate cover 600. The bottom plate cover 600, the rail assembly 430, and the nozzle assembly 300 may be securely fixed to each other by a fastening member 690. To this end, the bottom plate cover 600, the rail assembly 430, and the nozzle assembly 300 may be formed with fastening holes 620, 453, 337, and 347 at respective corresponding positions. The fastening member 690 may include one or more screws, for example. A fastening member may also include, for example, a bolt, a pin, a rivet, an anchor, an adhesive, and the like.

Through such a structure, the rail assembly 430 and the nozzle assembly 300 may be fixed and aligned to each other.

In the dish washing machine 1 according to an embodiment of the disclosure, since the washing water sprayed from the stationary spray nozzles 330 and 340 of the nozzle assembly 300 may be reflected by the vane 400 coupled to the rail assembly 430 to wash the dishes, without the stationary spray nozzles 330 directly facing the dishes, it may be necessary to accurately align the positions of the stationary spray nozzles 330 and 340 and the rail assembly 430. Such position alignment may be satisfied through the above coupling structure.

Figure 21:
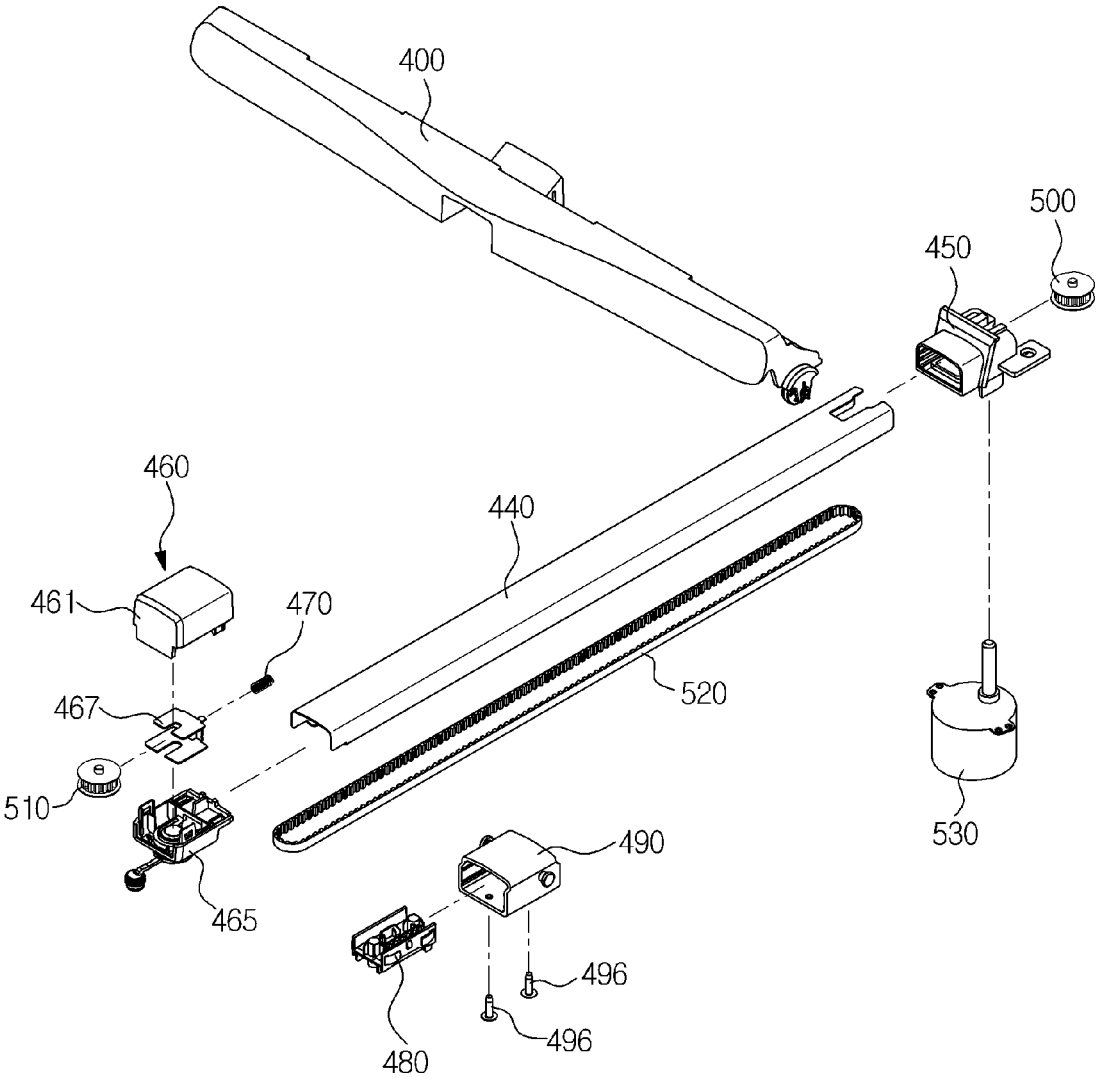
FIG. 21 is a view illustrating a vane and a drive device of the dish washing machine in FIG. 1, a configuration of the drive device being illustrated as an exploded view.
Figure 22:
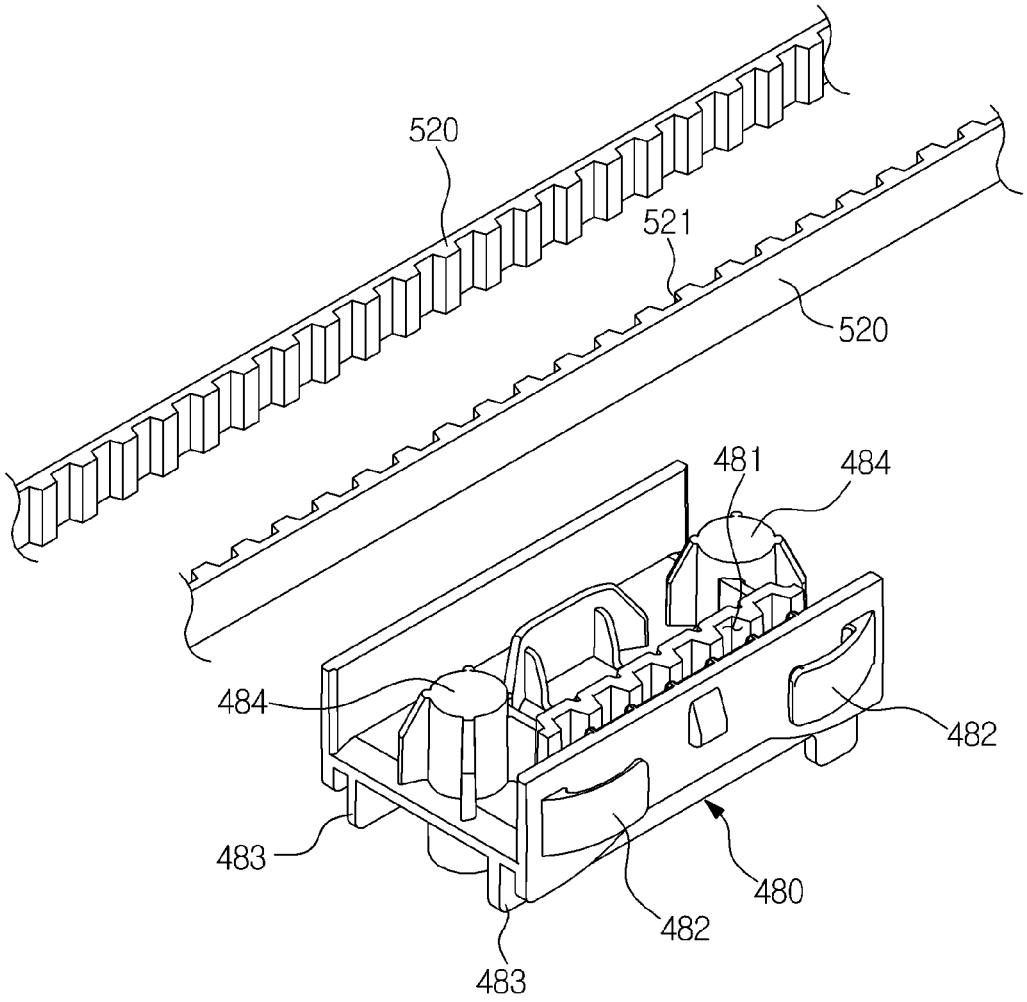
FIG. 22 is a view illustrating a belt and a belt holder of the dish washing machine in FIG. 1.
Figure 23:
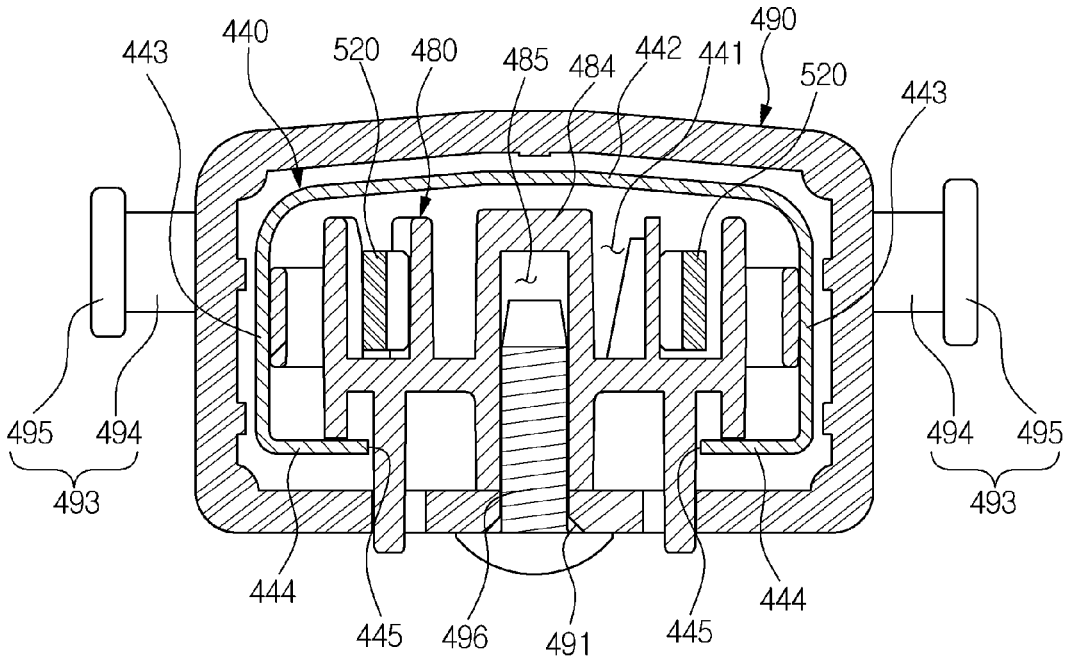
FIG. 23 is a cross-sectional view illustrating a rail, a belt, a belt holder, and a vane holder of the dish washing machine in FIG. 1.
Figure 24:
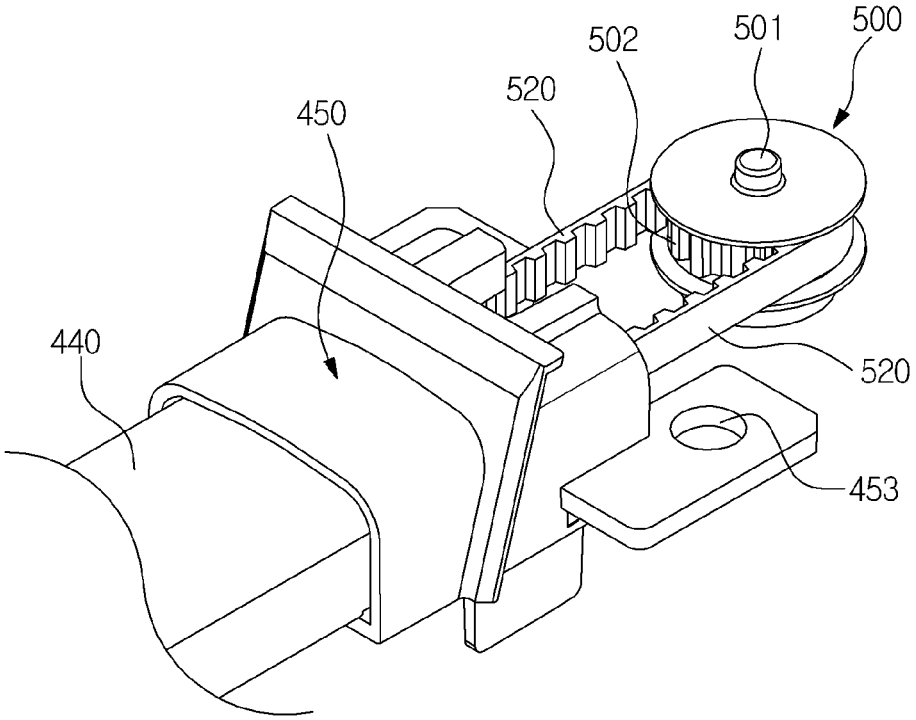
FIG. 24 is a view illustrating a rail, a belt, a drive pulley, and a rear holder of the dish washing machine in FIG. 1.
Figure 25:
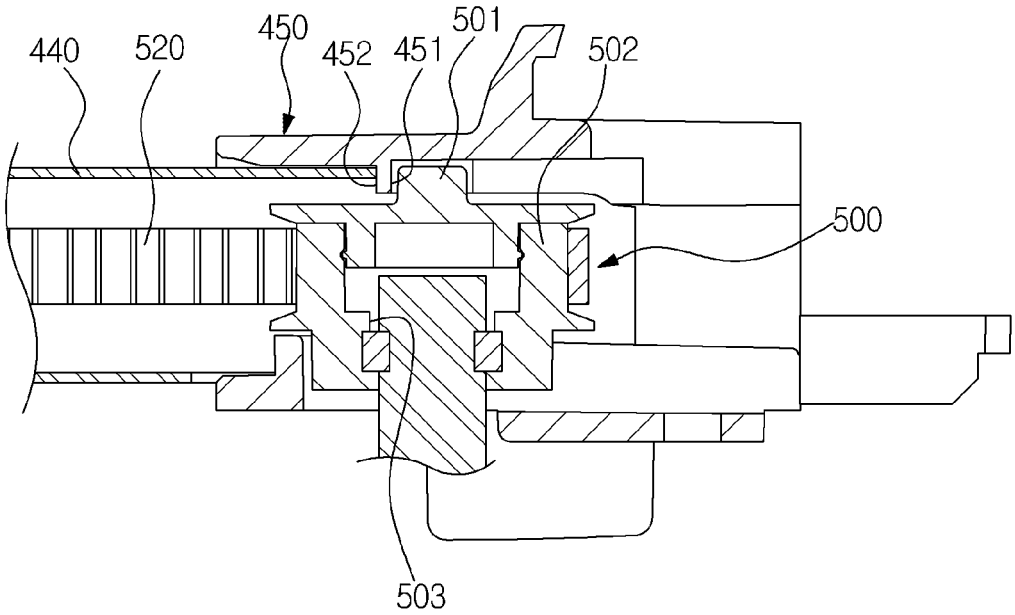
FIG. 25 is a cross-sectional view illustrating the rail, the belt, the drive pulley, and the rear holder of the dish washing machine in FIG. 1.
Figure 26:
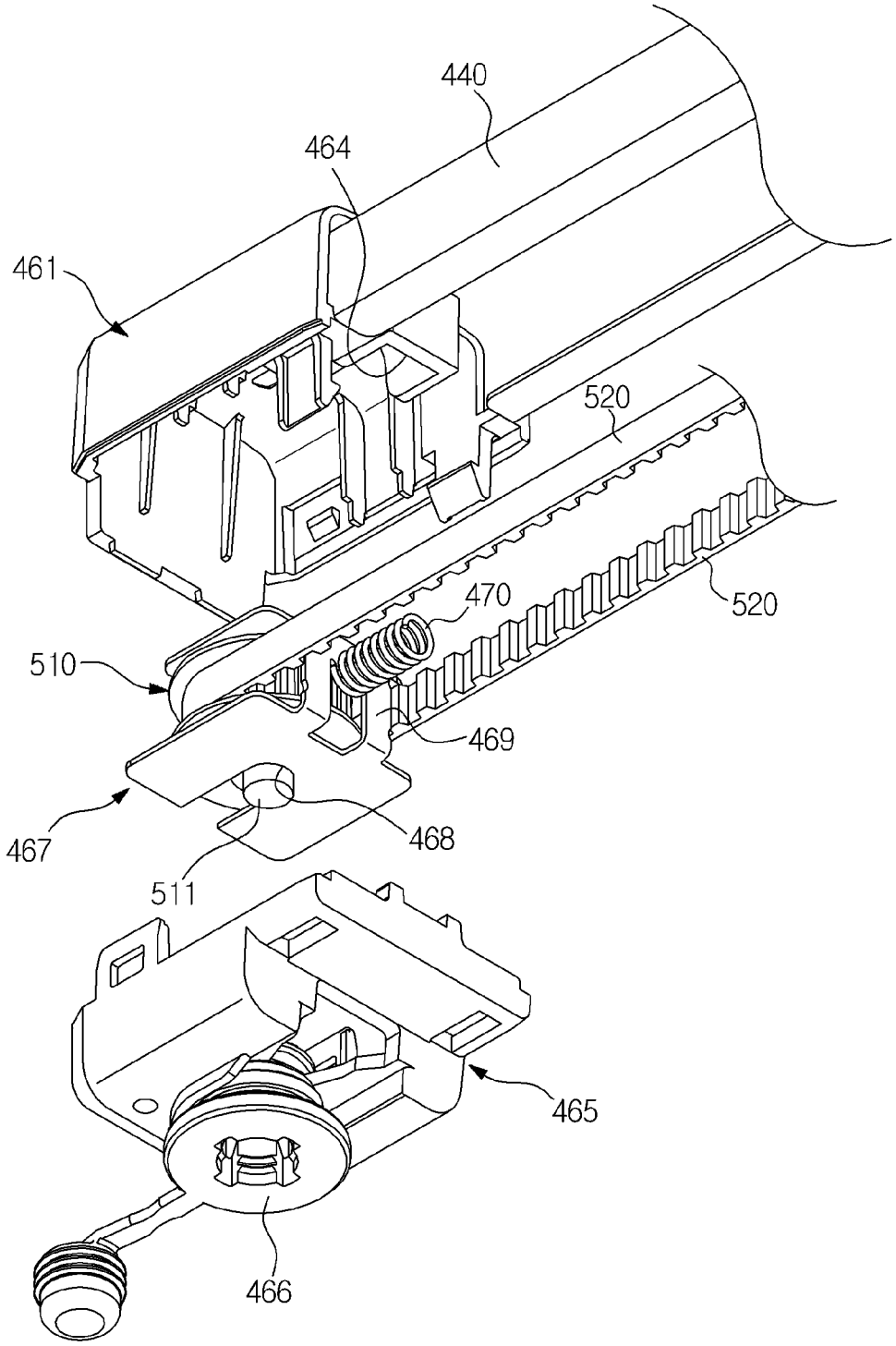
FIG. 26 is a view illustrating a rail, a belt, an idle pulley, and a front holder of the dish washing machine in FIG. 1.
Figure 27:
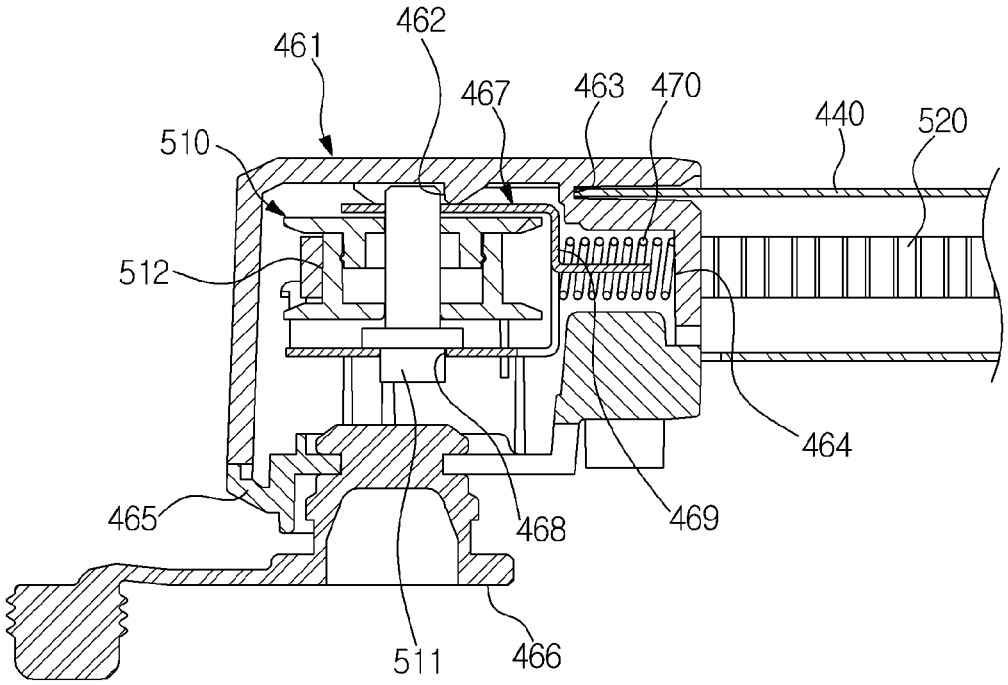
FIG. 27 is a cross-sectional view illustrating the rail, the belt, the idle pulley, and the front holder of the dish washing machine in FIG. 1.

FIG. 21 is a view illustrating the vane and the drive device of the dish washing machine in FIG. 1, a configuration of the drive device being illustrated as an exploded view. FIG. 22 is a view illustrating a belt and a belt holder of the dish washing machine in FIG. 1. FIG. 23 is a cross-sectional view illustrating a rail, a belt, a belt holder, and a vane holder of the dish washing machine in FIG. 1. FIG. 24 is a view illustrating a rail, a belt, a drive pulley, and a rear holder of the dish washing machine in FIG. 1. FIG. 25 is a cross-sectional view illustrating the rail, the belt, the drive pulley, and the rear holder of the dish washing machine in FIG. 1. FIG. 26 is a view illustrating a rail, a belt, an idle pulley, and a front holder of the dish washing machine in FIG. 1. FIG. 27 is a cross-sectional view illustrating the rail, the belt, the idle pulley, and the front holder of the dish washing machine in FIG. 1.

The vane and the drive device thereof of the dish washing machine according to an embodiment of the disclosure will be described with reference to FIGS. 21 to 27.

The dish washing machine 1 according to an embodiment of the disclosure may include the vane 400 which reflects the washing water sprayed from the stationary nozzles 330 and 340. The vane 400 may linearly reciprocate (move) in the spray direction of the washing water sprayed from the stationary nozzles 330 and 340 and/or in a direction which is opposite to a direction in which wash water is sprayed from the fixing spray nozzles 330 and 340.

The dish washing machine 1 according to an embodiment of the disclosure may include the drive device 420 which allows the vane 400 to linearly reciprocate.

The drive device 420 may include the motor 530 configured to generate a driving force, and the rail assembly 430 configured to guide movement of the vane 400.

The rail assembly 430 may include a rail 440 which guides movement of the vane 400 and has an inner space 441, a drive pulley 500 rotatably connected to the motor 530, a belt 520 which is rotatably connected to the drive pulley 500 and is arranged in the inner space 441 of the rail 440, an idle pulley 510 connected to the belt 520 so as to rotatably support the belt 520, a belt holder 480 which is coupled to the belt 520 and is arranged in the inner space 441 of the rail 440 so as to linearly reciprocate, a vane holder 490 which is coupled to the belt holder 480 to be arranged outside the rail 440 so as to linearly reciprocate and is coupled with the vane 400, a rear holder 450 which rotatably supports the drive pulley 500 and is coupled to a rear end portion of the rail 440, and a front holder 460 which rotatably supports the idle pulley 510 and is coupled to a front end portion of the rail 440.

The rail 440 may be made of a metal material. The rail 440 may be provided to extend longitudinally in the forward and rearward directions and may be disposed or positioned at a central portion (e.g., midway) between the left wall 33 and the right wall 34 of the washing tub 30.

The rail 440 may have an opening 445 formed at a substantially lower portion thereof and a tubular shape. That is, the rail 440 may include an inner space 441, an upper wall 442, a lower wall 444, both side walls 443, and a lower opening 445 formed on the lower wall 444. The lower opening 445 may extend from one end portion to the other end portion in a longitudinal direction of the rail 440.

By forming the rail 440 in a tubular shape described above, it may be possible to prevent a driving interruption of the belt 520 caused by contact between the belt 520 and the dishes in the washing tub 30 or a corrosion of the belt 520 caused by contact between the belt 520 and the washing water in the washing tub 30 when the belt 520 is arranged in the inner space 441 of the rail 440.

In addition, by forming the opening 445 on the lower wall 444 of the rail 440, it may be possible to transfer a driving force of the belt 520 to the vane 400 by connecting the belt 520 arranged in the inner space 441 of the rail 440 to the vane 400 provided outside the rail 440.

The belt 520 may be wound around the drive pulley 500 and the idle pulley 510 to form a closed curve, and may rotate in a rotation direction of the motor 530 when the motor 530 is driven. The belt 520 may be made of a resin material including aramid fiber in consideration of tensile strength and cost, for example.

A tooth portion 521 which transfers the driving force of the belt 520 to the belt holder 480 may be formed on an inside surface of the belt 520.

The belt holder 480 may be arranged in the inner space 441 of the rail 440, similarly to the belt 520. The belt holder 480 may be coupled to the tooth portion 521 of the belt 520 and move along with the belt 520. To this end, the belt holder 480 may have a tooth coupling portion 481 coupled to the tooth portion 521 of the belt 520.

In addition, the belt holder 480 may include legs 482 and 483 supported by the rail 440. The legs 482 and 483 may include at least one side leg 482 which laterally protrudes and is supported by the associated side wall 443 of the rail 440 and at least one lower leg 483 which protrudes downward and is supported by the lower wall 444 of the rail 440.

The side legs 482 may reduce noise and vibration due to collision and friction with the rail 440 during movement of the belt holder 480 and be provided to be elastically deformable such that the belt holder 480 is smoothly movable.

Each of the side legs 482 may be an elastic body such as a leaf spring. That is, the side leg 482 may include a curved plate which is elastically deformed between a released form and a compressed form.

In addition, the belt holder 480 may have a fastening portion 484 through which the belt holder 480 is coupled to the vane holder 490. The fastening portion 484 may include a fastening hole 485 into which a fastening member 496 may be inserted. The fastening member 496 may include one or more screws, for example. A fastening member may also include, for example, a bolt, a pin, a rivet, an anchor, an adhesive, and the like.

The vane holder 490 may be coupled to the belt holder 480 to move along with the belt holder 480 and may transfer the driving force of the belt holder 480 to the vane 400. The vane holder 490 may be provided to surround an outside surface of the rail 440.

The vane holder 490 may be coupled to the belt holder 480 through the lower opening 445 of the rail 440. To this end, the vane holder 490 may have a fastening hole 491 through which the vane holder 490 is coupled to the belt holder 480. Thus, the vane holder 490 may be coupled to the belt holder 480 by fastening the fastening member 496 to the fastening hole 491 of the vane holder 490 and the fastening hole 485 of the belt holder 480.

The fastening member 496 may go from the bottom to the top and may be sequentially fastened to the fastening hole 491 of the vane holder 490 and the fastening hole 485 of the belt holder 480.

Figure 30:
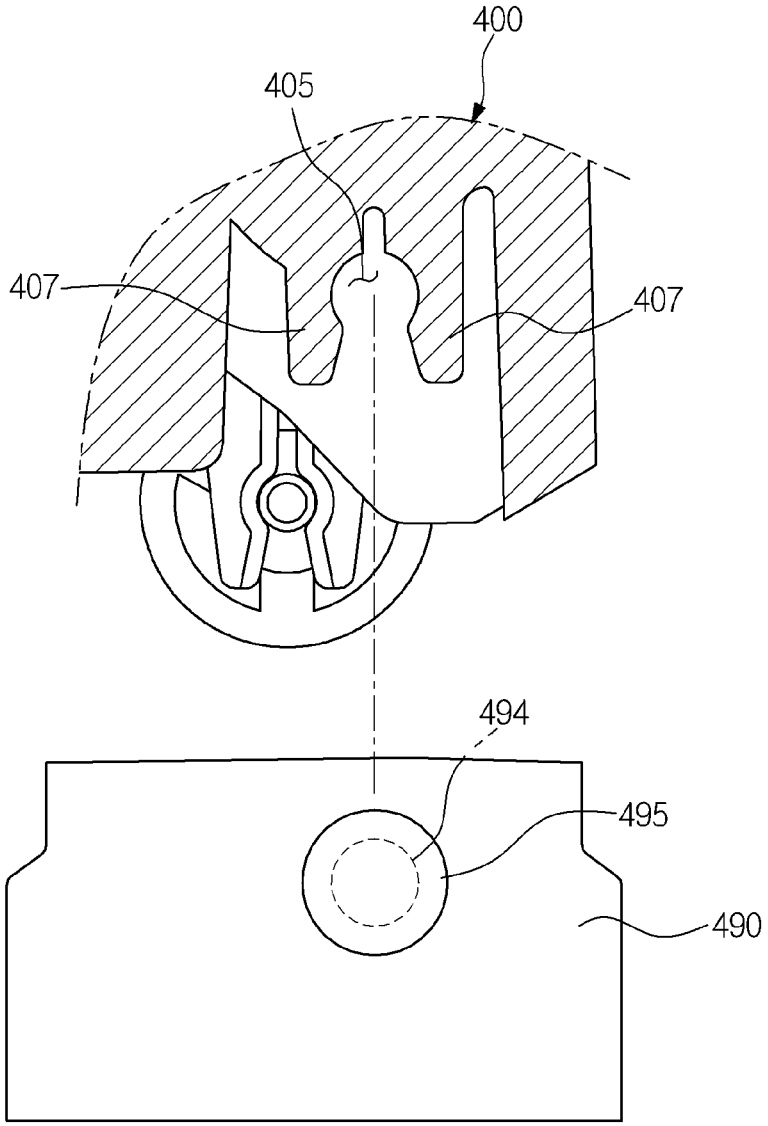
FIG. 30 is a partially enlarged view illustrating the vane and the vane holder of the dish washing machine in FIG. 1.

The vane holder 490 may be formed with a coupling protrusion portion 493 to which the vane 400 is detachably coupled. The coupling protrusion portion 493 may include a coupling axial portion 494 which laterally protrudes and a separation prevention portion 495 formed at an end portion of the coupling axial portion 494 so as to prevent separation of the vane 400. With reference to FIG. 30 the separation prevention portion 495 may have a greater diameter than coupling axial portion 494. The coupling protrusion portion 493 may be disposed on and protrude from one or both sides of the vane holder 490. The coupling protrusion portion 493 may protrude outward from the vane holder 490 toward the left and/or right sides of the washing tub 30.

The drive pulley 500 may include a rotary shaft 501, a shaft connection portion 503 connected to the drive shaft 531 of the motor 530 to receive a driving force, and a belt coupling portion 502 coupled to the belt 520.

The rear holder 450 may rotatably support the drive pulley 500 and may be coupled to the rear end portion of the rail 440. The rear holder 450 may include a pulley support surface 451 configured to support the rotary shaft 501 of the drive pulley 500, a rail support surface 452 configured to support the rear end portion of the rail 440, and a fastening hole 453 through which the rear holder 450 may be coupled to the bottom plate cover 600.

The idle pulley 510 may include a rotary shaft 511 and a belt coupling portion 512 coupled to the belt 520.

The front holder 460 may include a front top holder 461, a front bottom holder 465 coupled to a lower portion of the front top holder 461, and a pulley bracket 467 which is provided between the front top holder 461 and the front bottom holder 465 so as to be movable in the longitudinal direction of the rail 440 and rotatably supports the idle pulley 510.

The front top holder 461 may include a pulley support surface 462 configured to support the rotary shaft 511 of the idle pulley 510 and a rail support surface 463 configured to support the front end portion of the rail 440.

The front bottom holder 465 may be coupled to the lower portion of the front top holder 461 by a catching structure. The front bottom holder 465 may have a coupling protrusion 466 coupled to the bottom plate 35 of the washing tub 30.

The pulley bracket 467 may include a pulley support surface 468 configured to support the rotary shaft 511 of the idle pulley 510.

Meanwhile, the rail 440, the belt 520, the drive pulley 500, the rear holder 450, the idle pulley 510, and the front holder 460 may be mutually assembled by tension of belt 520.

That is, the drive pulley 500 may be pressed in a direction close to the rail 440 by the tension of the belt 520. The pressed force may be transferred to the rear holder 450 through the pulley support surface 451 of the rear holder 450. Consequently, the rear holder 450 may be closely coupled to the rear end portion of the rail 440.

In addition, the idle pulley 510 may be pressed in a direction close to the rail 440 by the tension of the belt 520. The pressed force may be transferred to the front holder 460 through the pulley support surface 462 of the front holder 460. Consequently, the front holder 460 may be closely coupled to the front end portion of the rail 440.

Meanwhile, the front holder 460 may further include an elastic member 470 used to maintain the tension of the belt 520. This is because the tension of the belt 520 is decreased by stretching of the belt when the belt 520 is thermally expanded by heat in the washing tub 30 and thus the vane 400 is not smoothly driven due to a decrease of the tension of the belt 520.

One end portion of the elastic member 470 may be supported by the front holder 460 and the other end portion of the elastic member 470 may be supported by the pulley bracket 467. To this end, the front holder 460 and the pulley bracket 467 may be formed with elastic member support surfaces 464 and 469, respectively.

The elastic member may be a compression spring. Since the front holder 460 is supported on the rail 440 by the rail support surface 463, the elastic force of the elastic member 470 may act on the pulley bracket 467. That is, the pulley bracket 467 may be pressed in a direction away from the rail 440 by the elastic force of the elastic member 470.

In this case, since the pulley bracket 467 is pressed in a direction close to the rail 440 by the tension of the belt 520, the pulley bracket 467 moves to a balanced position between the tension of the belt 520 and the elastic force of the elastic member 470.

That is, when the tension of the belt 520 is decreased by stretching thereof and the elastic force of the elastic member 470 is more increased than the tension of the belt 520, the pulley bracket 467 moves in a direction away from the rail 440 by the elastic force of the elastic member 470. In this case, the belt 520 is tightly pulled when the pulley bracket 467 moves in the direction away from the rail 440, and thus the tension of the belt 520 is recovered again.

Through such a configuration, since the belt 520 is pulled by movement of the pulley bracket 467 even though the belt 520 is stretched by thermal expansion, the tension of the belt 520 may be uniformly maintained and reliability of the drive device 420 may be enhanced.

An assembly sequence of the rail assembly 430 of the dish washing machine according to an embodiment of the disclosure will be described.

As shown in FIG. 22, the belt holder 480 may be coupled to the belt 520.

As shown in FIG. 23, the assembly of the belt 520 and the belt holder 480 may be arranged in the inner space 441 of the rail 440. Next, the vane holder 490 may be coupled to the assembly of the belt 520 and the belt holder 480 through the fastening member 496.

As shown in FIG. 24, the rear holder 450 may be assembled to the rear longitudinal end portion of the rail 440. Next, the drive pulley 500 is coupled to the belt 520.

As shown in FIG. 26, the front top holder 461 may be coupled to the front longitudinal end portion of the rail 440. Next, the belt 520, the idle pulley 510, the pulley bracket 467, and the elastic member 470 may be coupled to each other. Next, the assembly of the belt 520, the idle pulley 510, the pulley bracket 467, and the elastic member 470 may be inserted into the front top holder 461. Next, the front bottom holder 465 may be coupled to the front top holder 461.

Figure 28:
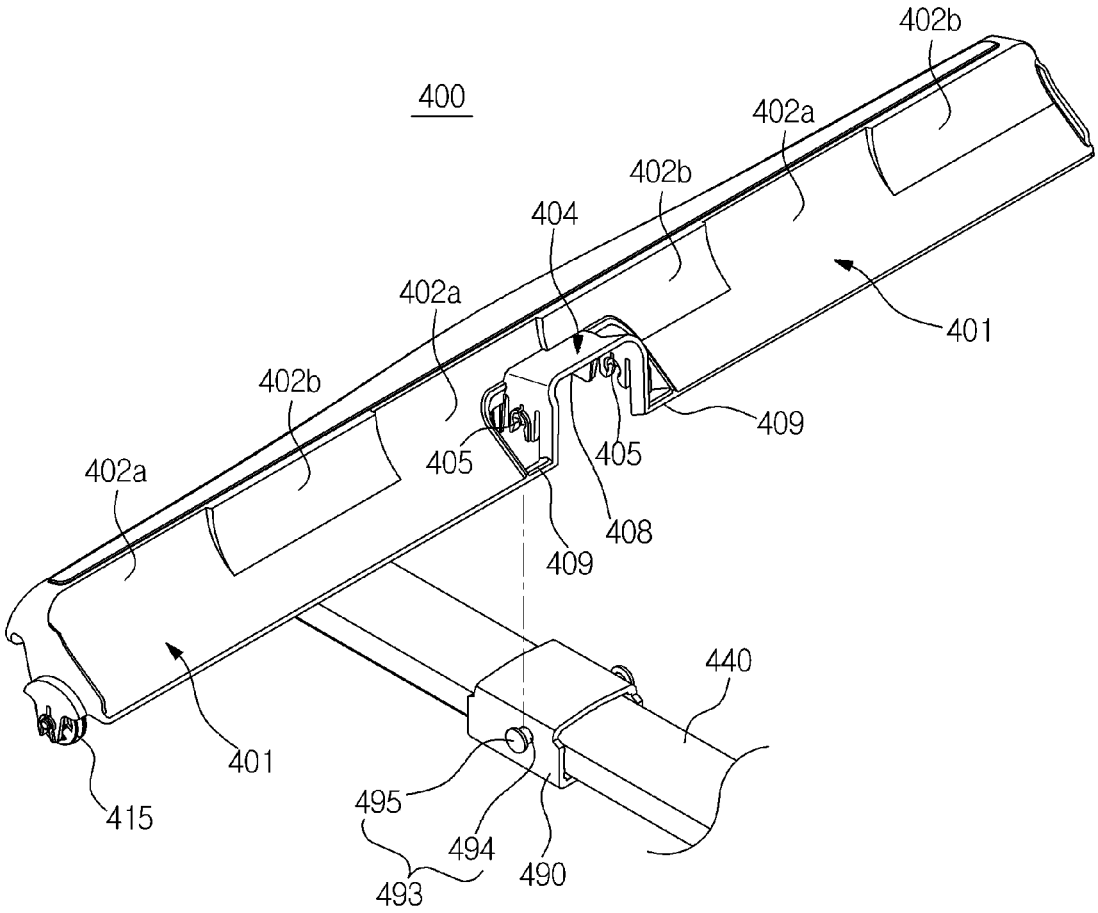
FIG. 28 is a view illustrating a vane and a vane holder of the dish washing machine in FIG. 1.
Figure 29:
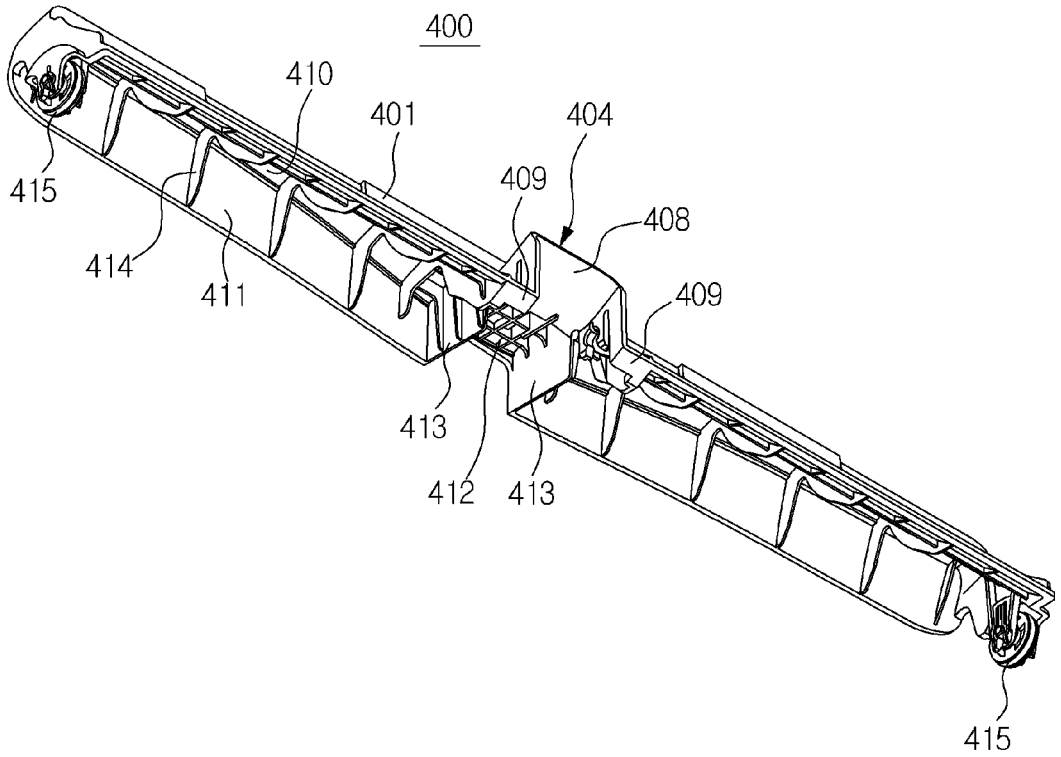
FIG. 29 is a perspective view illustrating the vane of the dish washing machine in FIG. 1.

FIG. 28 is a view illustrating the vane and the vane holder of the dish washing machine in FIG. 1. FIG. 29 is a perspective view illustrating the vane of the dish washing machine in FIG. 1. FIG. 30 is a partial enlarged view illustrating the vane and the vane holder of the dish washing machine in FIG. 1.

The vane according to an embodiment of the disclosure will be described with reference to FIGS. 28 to 30.

The vane 400 may be provided to extend longitudinally in a direction perpendicular to the rail 440.

The vane 400 may include a reflective portion 401 configured to reflect the washing water sprayed from the stationary nozzles 330 and 340, an upper support portion 410 bent from the reflective portion 401, a rear support portion 411 bent from the upper support portion 410, a cap portion 404 provided at a central longitudinal portion of the reflective portion 401, a rotation catching portion 409 provided so as to interfere with the rotation guide 610 (see FIG. 31) of the bottom plate cover 600, one or more reinforcement ribs 414 provided to reinforce strength of the reflective portion 401, the upper support portion 410, and the rear support portion 411, a horizontal support portion 412 supported by the upper surface of the vane holder 490, and a vertical support portion 413 supported by the side surface of the vane holder 490.

The reflective portion 401 may include reflective surfaces 402*a* and 402*b* provided to be inclined to reflect the washing water. The reflective surfaces 402*a* and 402*b* may include a reflective surface 402*a* and another reflective surface 402*b* which have different inclinations, such that reflected angles of the washing water differ from each other, and may be alternately arranged in the longitudinal direction. As shown in FIG. 28 there may be three reflective surfaces 402*b*, however the disclosure is not so limited. For example, there may be no reflective surfaces 402*b*, one, two, or more than three reflective surfaces 402*b*. Also, as shown in FIG. 28, reflective surfaces 402*b* may be disposed to have a substantially rectangular shape, and may be disposed in an upper portion of the reflective portion 401, such that the reflective surface 402*b* does not extend fully from a top portion of the reflective portion 401 to a bottom portion of the reflective portion 401. For example, reflective surface 402*b* may extend from a top portion of the reflective portion 401 to a central portion of the reflective portion 401, and reflective surface 402*a* may extend from the lower side of the reflective surface 402 to the bottom portion of the reflective portion 401 (i.e., the remaining portion of the reflective portion 401). However, the disclosure is not so limited, and the reflective surface 402*b* may be shaped differently and may extend from a top portion to the bottom portion of the reflective portion 401, or from the bottom portion to a central portion of the reflective portion 401, etc.

The cap portion 404 may include a coupling groove 405 through which the cap portion 404 is coupled to the vane holder 490, and a rotation stopper portion 408 which restricts a rotation range of the vane 400 when the vane 400 rotates by the rotation guide 610 of the bottom plate cover 600.

The coupling protrusion portion 493 of the vane holder 490 may be coupled to the coupling groove 405 of the vane 400. Specifically, the coupling axial portion 494 of the coupling protrusion portion 493 may be inserted into the coupling groove 405 of the vane 400. The coupling axial portion 494 may rotatably support the vane 400.

As shown in FIG. 30, the coupling groove 405 of the vane 400 may be formed by elastic hooks 407. The elastic hooks 407 may be elastically deformed in a direction away from each other in a process in which the coupling axial portion 494 of the vane holder 490 is inserted into or separated from the coupling groove 405 of the vane 400, and then recovered originally when the insertion or separation is completed. Through such a configuration, the vane 400 may be detachably mounted to the vane holder 490.

Rollers 415 used to smoothly move the vane 400 may be provided at both longitudinal end portions of the vane 400. The bottom plate 35 of the washing tub 30 may be provided with a roller support portion 39 (see FIG. 47) configured to support the rollers 415.

Figure 31:
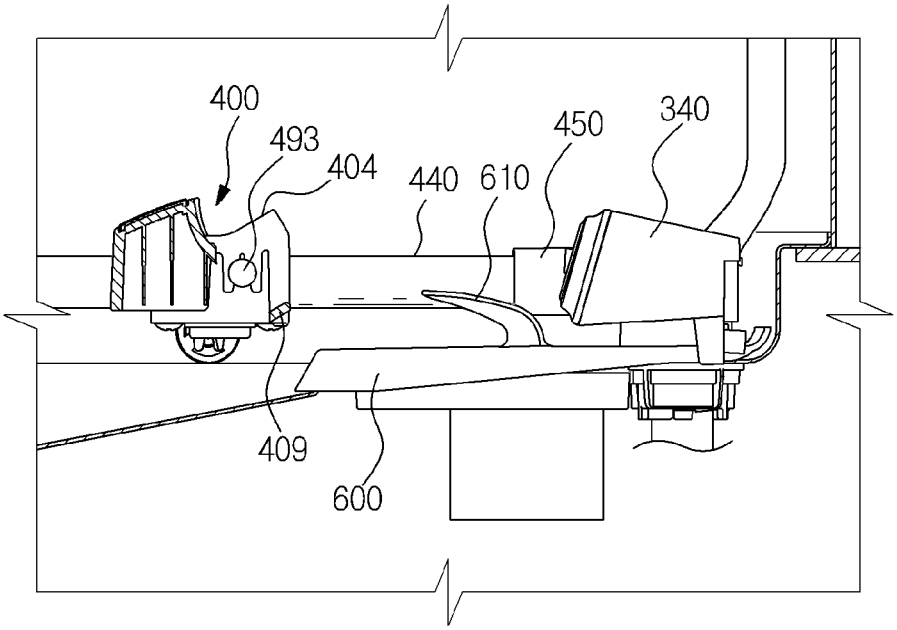
FIGS. 31 to 33 are views illustrating a rotation operation of the vane of the dish washing machine in FIG. 1.
Figure 32:
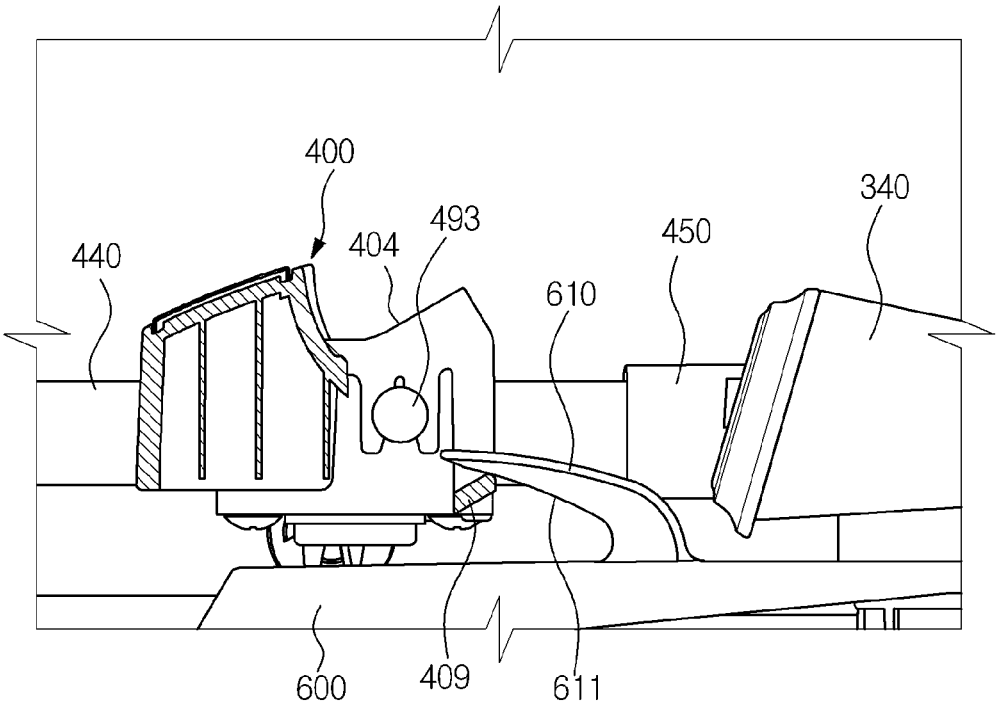
Figure 33:
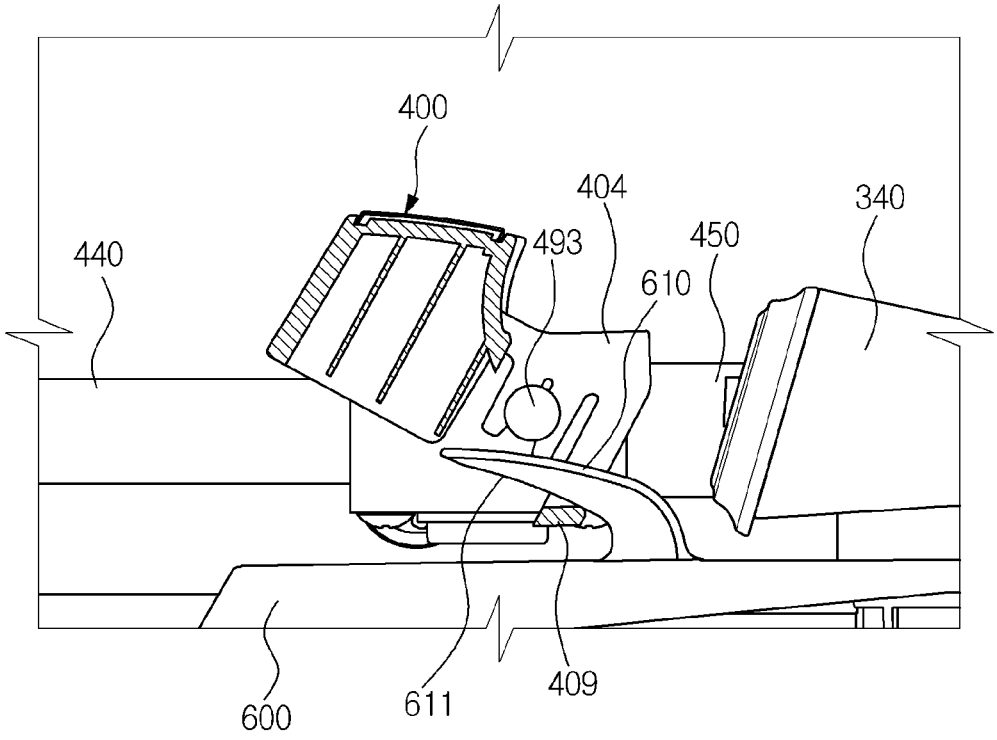
Figure 34:
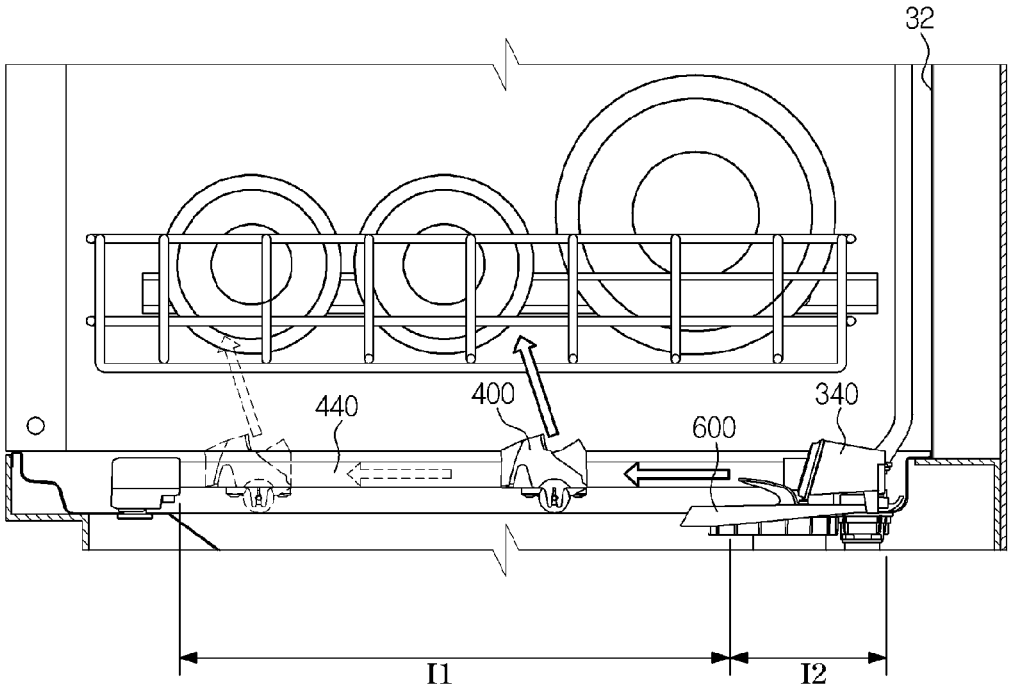
FIG. 34 is a view illustrating an operation in which the vane reflects washing water in a movement section of the vane of the dish washing machine in FIG. 1.
Figure 35:
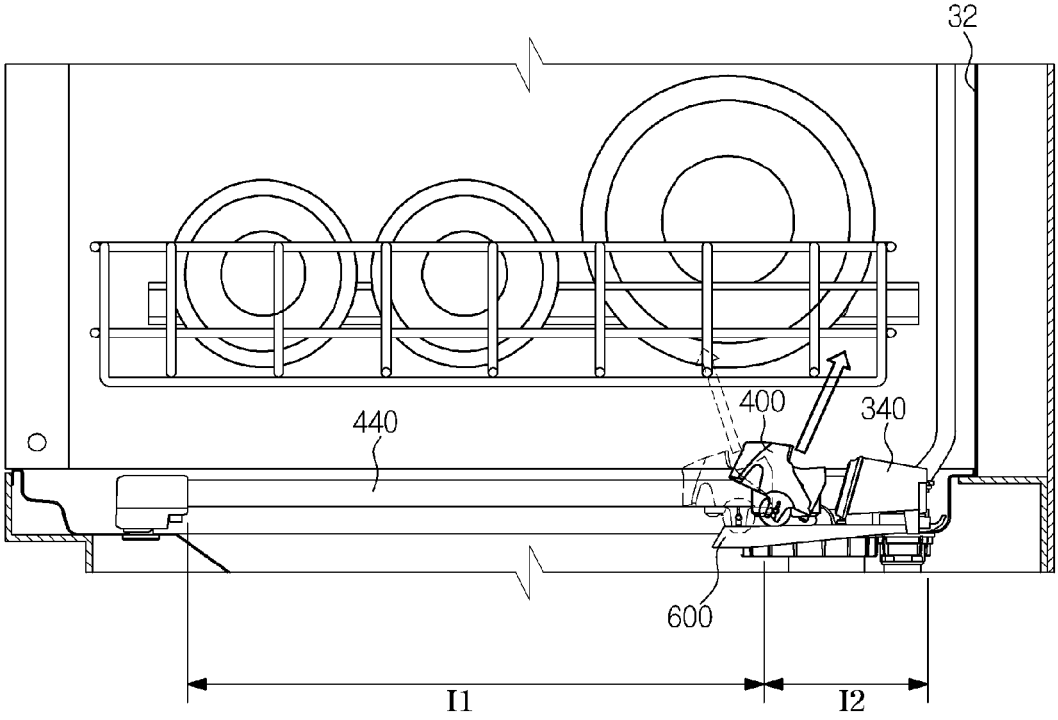
FIG. 35 is a view illustrating an operation in which the vane reflects washing water in a non-movement section of the vane of the dish washing machine in FIG. 1.

FIGS. 31 to 33 are views illustrating a rotation operation of the vane of the dish washing machine in FIG. 1. FIG. 34 is a view illustrating an operation in which the vane reflects the washing water in a movement section of the vane of the dish washing machine in FIG. 1. FIG. 35 is a view illustrating an operation in which the vane reflects the washing water in a non-movement section of the vane of the dish washing machine in FIG. 1.

The movement section, the non-movement section, and the rotation operation of the vane according to an embodiment of the disclosure will be described with reference to FIGS. 31 to 35.

In the dish washing machine 1 according to an embodiment of the disclosure, the vane 400 reflects the washing water sprayed from the stationary spray nozzles 330 and 340 toward the dishes. Since the stationary spray nozzles 330 and 340 spray the washing water in a substantially horizontal direction, the stationary spray nozzles 330 and 340 and the vane 400 may be located substantially in parallel with each other. Thus, the vane 400 may not be moved in a region in which the stationary spray nozzles 330 and 340 are arranged.

That is, the dish washing machine 1 may have a vane movement section I1 in which the vane 400 is movable and a vane non-movement section I2 in which the vane 400 is not movable (i.e., is restricted from being moved into).

The vane 400 of the dish washing machine 1 according to an embodiment of the disclosure may be rotatably provided (e.g., disposed at a predetermined angle) so as to wash the dishes stored in the vane non-movement section I2.

As described above, the bottom plate cover 600 may be formed with the rotation guide 610 protruding so as to guide movement of the vane 400, and the vane 400 may be formed with the rotation catching portion 409 so as to interfere with the rotation guide 610. The rotation catching portion 409 forms the rotary axis of the vane 400 and may be formed above the coupling protrusion portion 493 of the vane holder 490 which transfers the driving force to the vane 400.

The rotation guide 610 comes into contact with the rotation catching portion 409 and may include a guide surface 611 formed in a curved surface so as to smoothly rotate the vane 400.

When the rotation catching portion 409 of the vane 400 interferes with the guide surface 611 of the rotation guide 610 of the bottom plate cover 600 when the vane 400 reaches the vane non-movement section I2 from the vane movement section I1, the vane 400 rotates about the coupling protrusion portion 493 of the vane holder 490. For example, when the vane 400 moves toward the rear wall 32 and the rotation catching portion 409 of the vane 400 is interfered with the guide surface 611 of the rotation guide 610, the vane 400 may rotate forward or toward the rear wall 32. Due to the rotation of the vane 400, the direction or angle of the wash water which is reflected by the vane 400 may be changed compared to the direction or angle of the wash water which is reflected by the vane 400 before the rotation catching portion 409 of the vane 400 is interfered with by the guide surface 611 of the rotation guide 610. Thus, the washing water may be reflected toward the dishes in the non-movement section I2.

Figure 36:
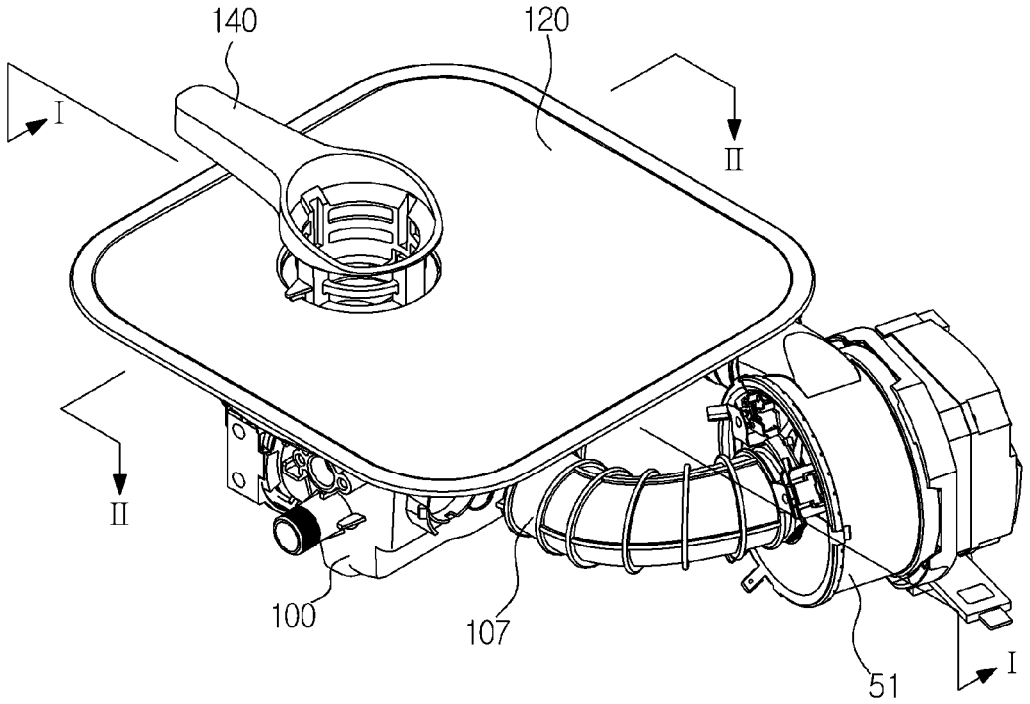
FIG. 36 is a view illustrating a sump, a coarse filter, and a fine filter of the dish washing machine in FIG. 1.
Figure 37:
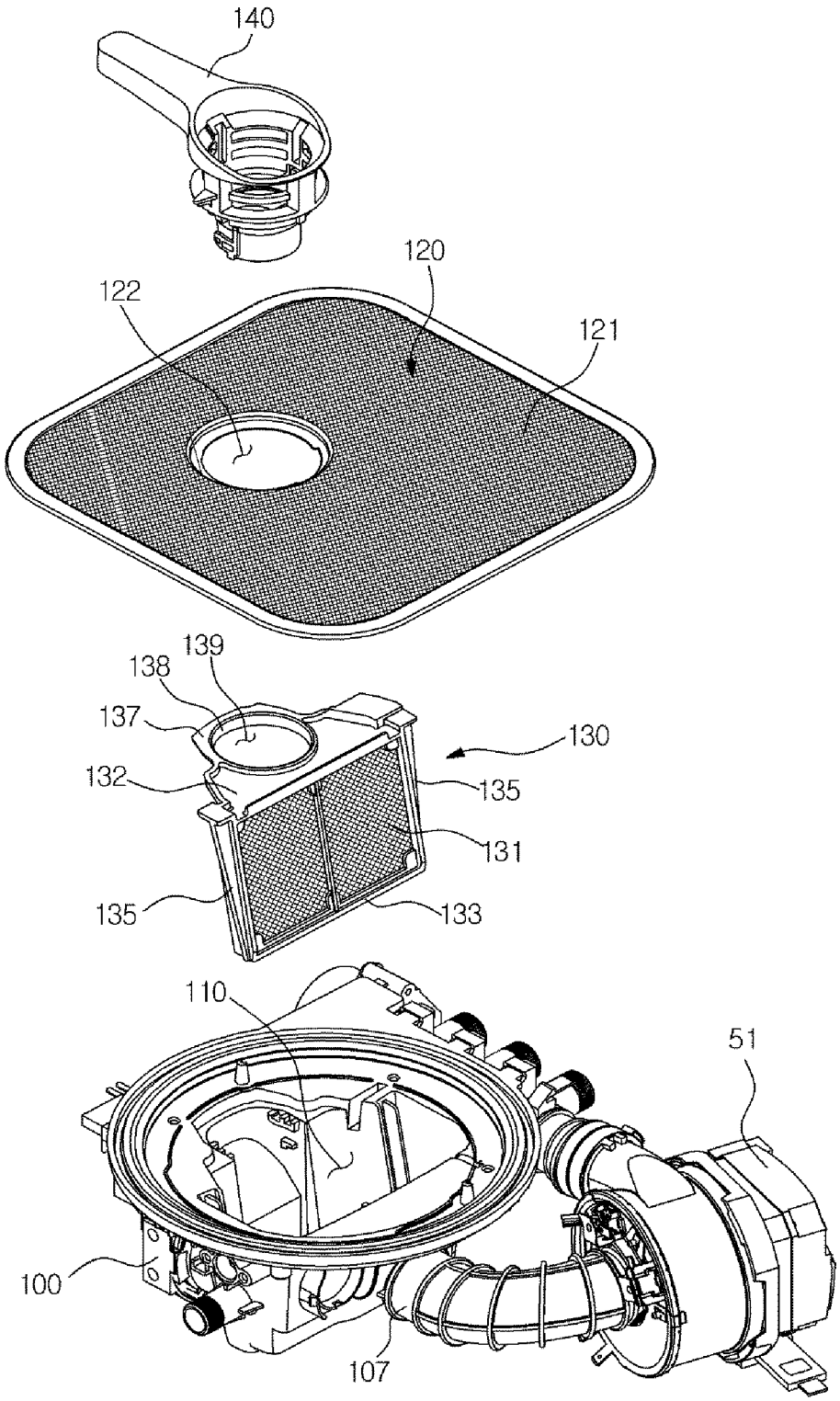
FIG. 37 is an exploded view illustrating a sump, a coarse filter, a fine filter, and a micro filter of the dish washing machine in FIG. 1.
Figure 38:
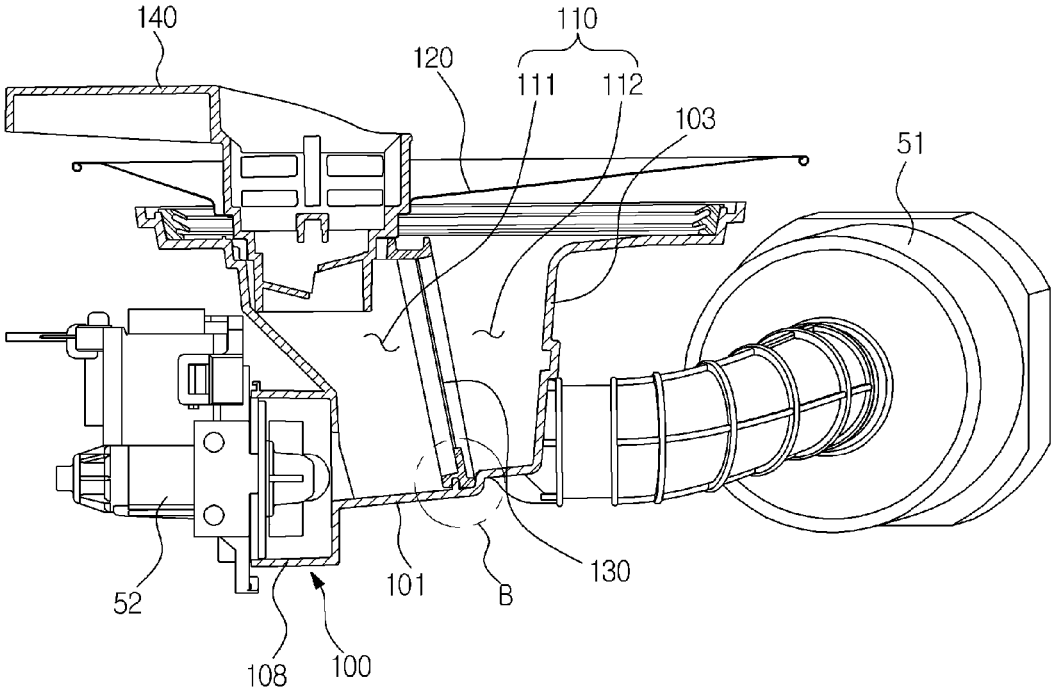
FIG. 38 is a cross-sectional view taken along line "I-I" in FIG. 36.
Figure 39:
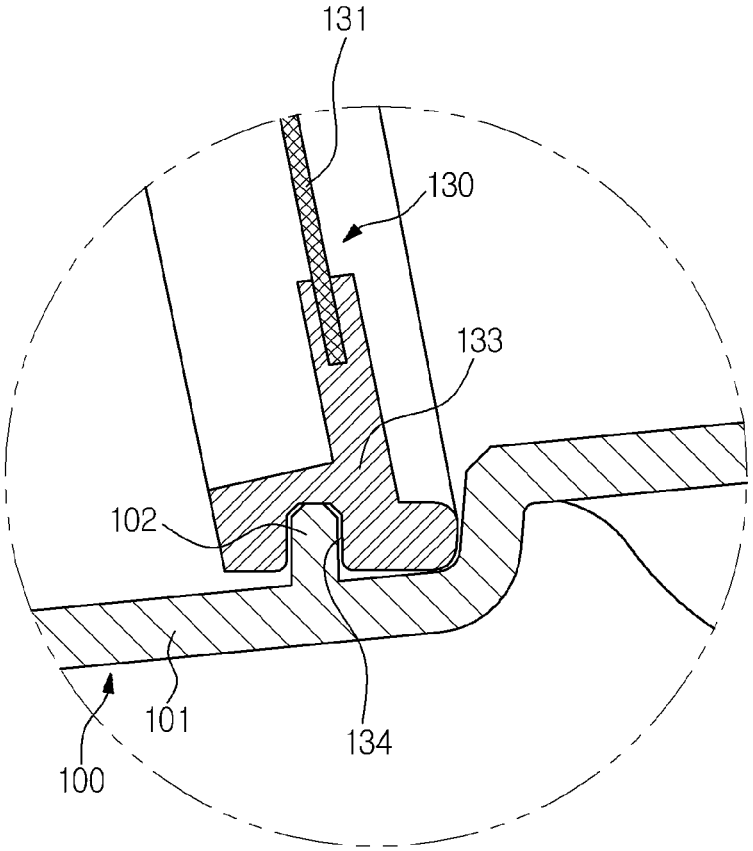
FIG. 39 is an enlarged view illustrating portion "B" in FIG. 38.
Figure 40:
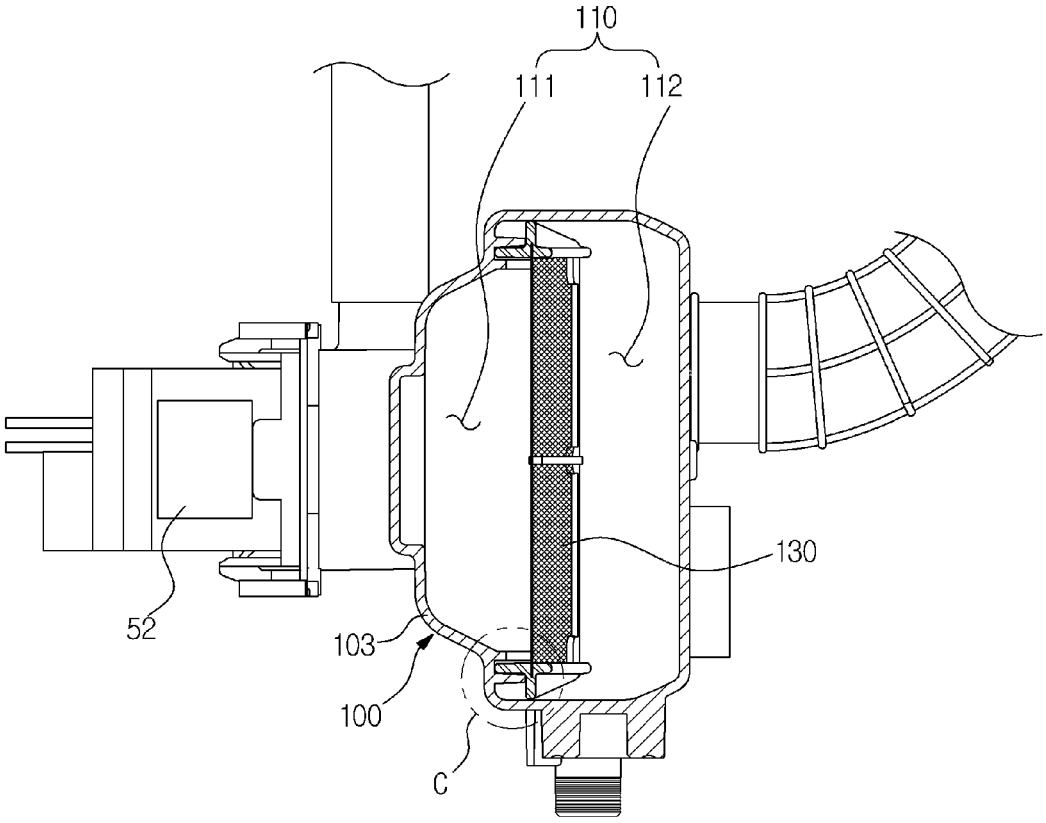
FIG. 40 is a cross-sectional view taken along line "II-II" in FIG. 38.
Figure 41:
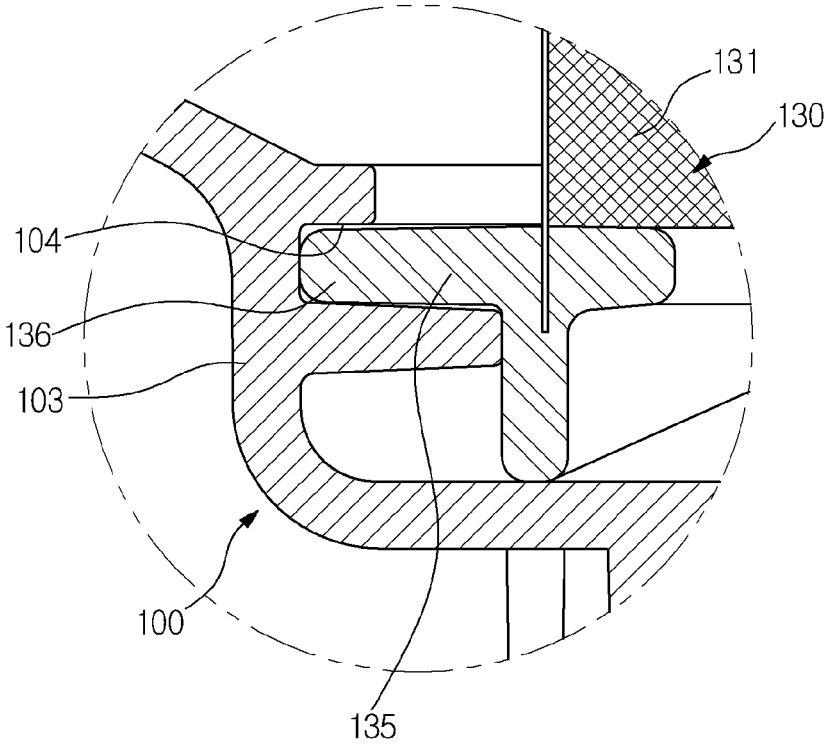
FIG. 41 is an enlarged view illustrating portion "C" in FIG. 40.
Figure 42:
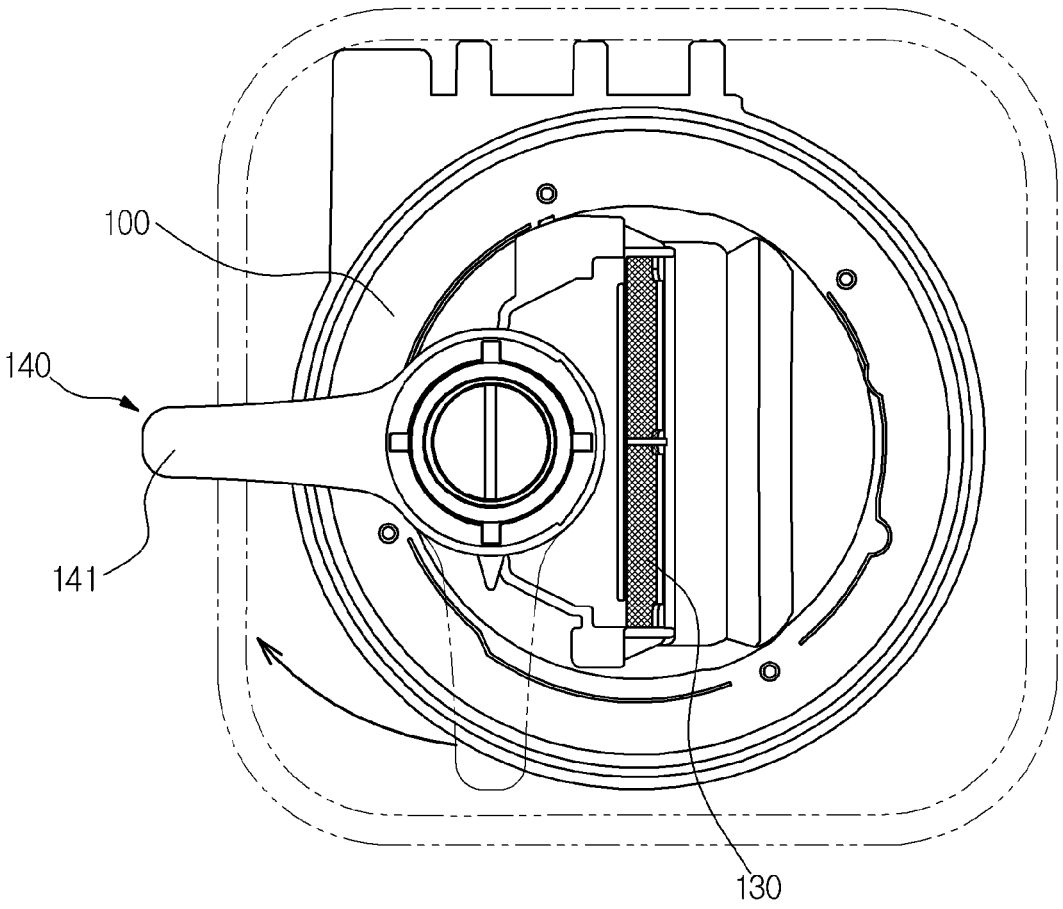
FIG. 42 is a top view illustrating the sump and the coarse filter of the dish washing machine in FIG. 1, and a locking operation of the coarse filter.
Figure 43:
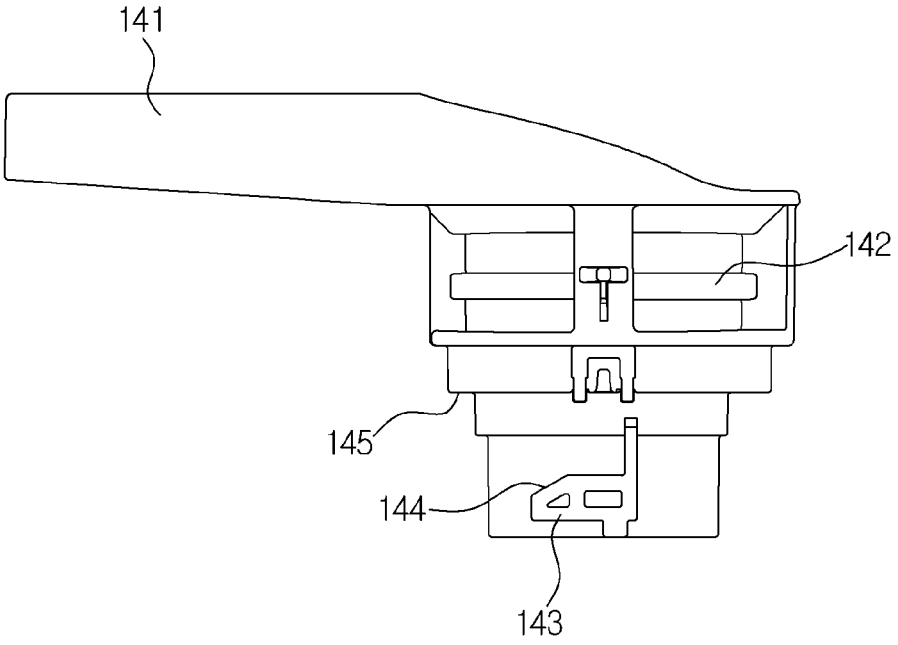
FIG. 43 is a side view illustrating the coarse filter of the dish washing machine in FIG. 1.
Figure 44:
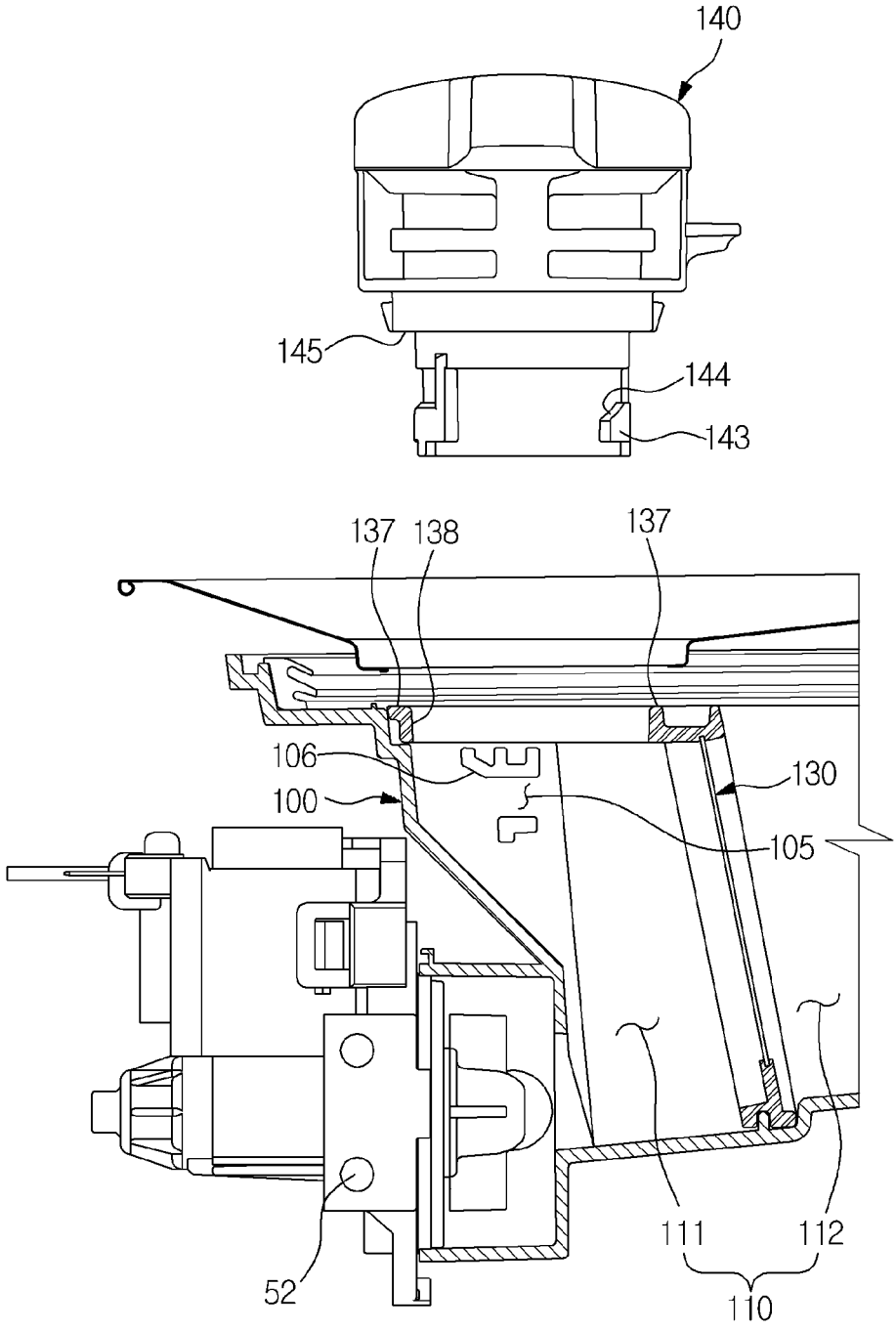
FIG. 44 is a view illustrating the sump and the coarse filter of the dish washing machine in FIG. 1, and the locking operation of the coarse filter.
Figure 45:
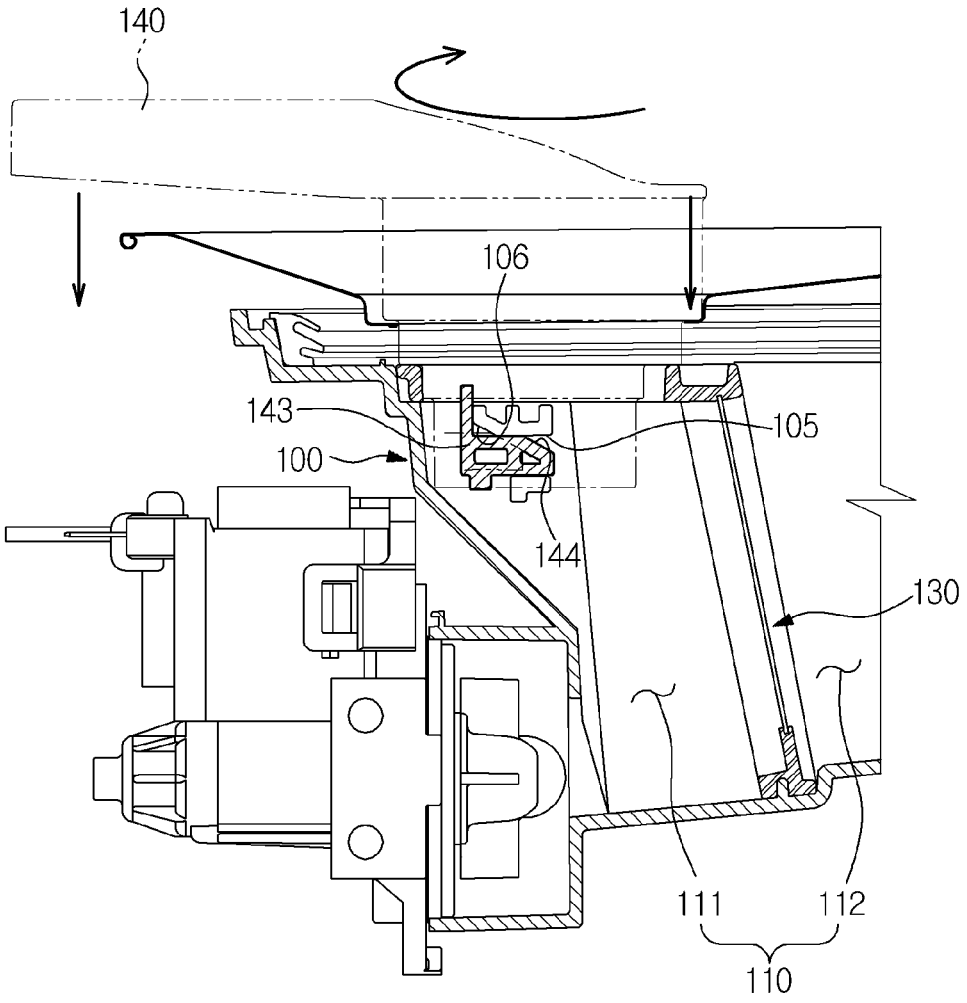
FIG. 45 is a cross-sectional view illustrating the sump, the coarse filter, and the micro filter of the dish washing machine in FIG. 1.
Figure 46:
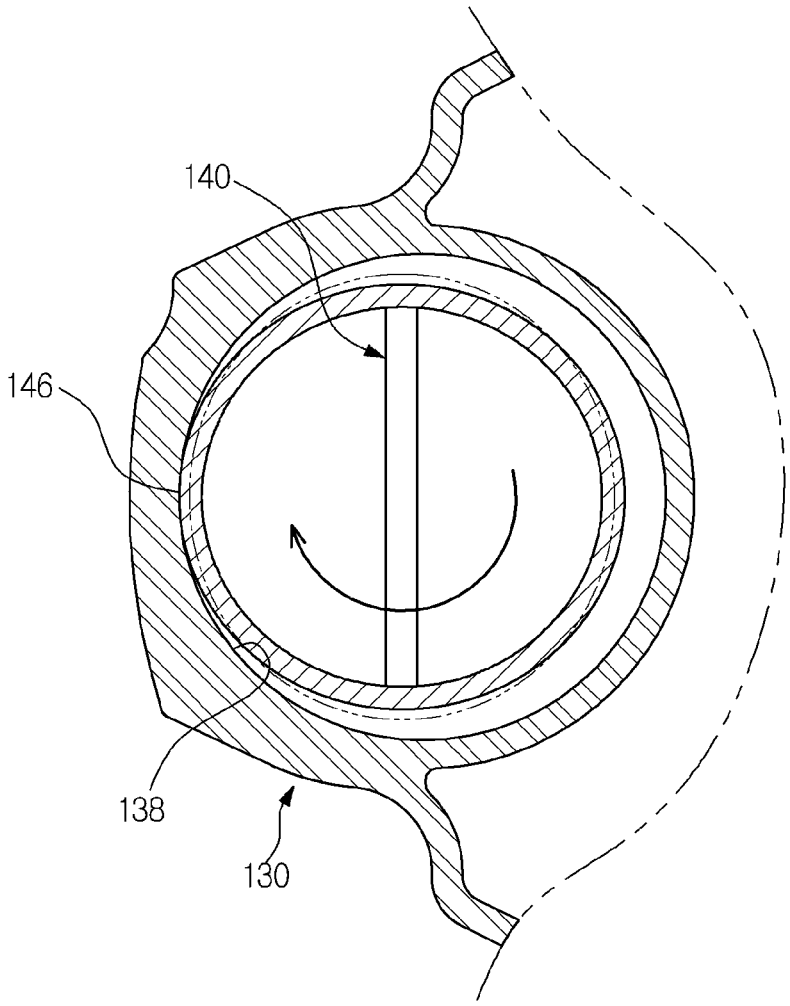
FIG. 46 is a partially enlarged top view illustrating the coarse filter and the micro filter of the dish washing machine in FIG. 1.
Figure 47:
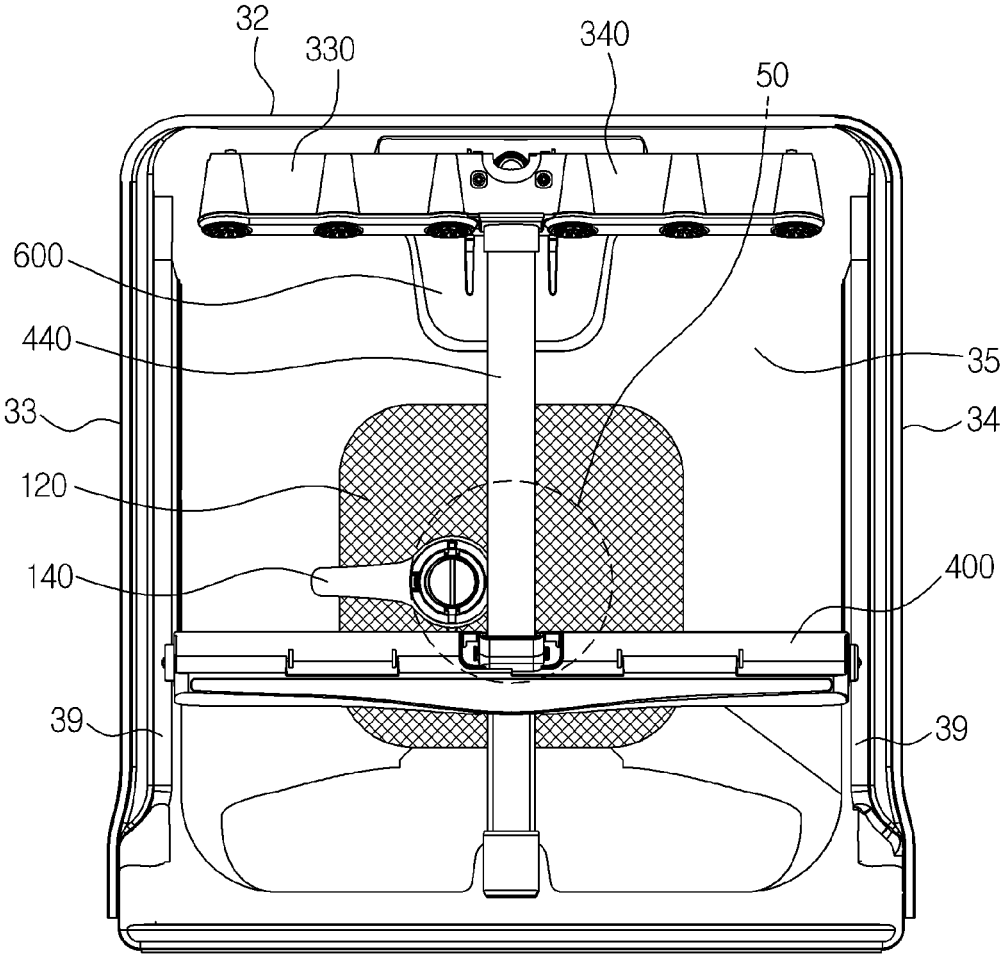
FIG. 47 is a top view illustrating a lower portion of the washing tub of the dish washing machine in FIG. 1.

FIG. 36 is a view illustrating a sump, a coarse filter, and a fine filter of the dish washing machine in FIG. 1. FIG. 37 is an exploded view illustrating a sump, a coarse filter, a fine filter, and a micro filter of the dish washing machine in FIG. 1. FIG. 38 is a cross-sectional view taken along line "I-I" in FIG. 36. FIG. 39 is an enlarged view illustrating portion "B" in FIG. 38. FIG. 40 is a cross-sectional view taken along line "II-II" in FIG. 38. FIG. 41 is an enlarged view illustrating portion "C" in FIG. 40. FIG. 42 is a top view illustrating the sump and the coarse filter of the dish washing machine in FIG. 1, and a locking operation of the coarse filter. FIG. 43 is a side view illustrating the coarse filter of the dish washing machine in FIG. 1. FIG. 44 is a view illustrating the sump and the coarse filter of the dish washing machine in FIG. 1, and the locking operation of the coarse filter. FIG. 45 is a cross-sectional view illustrating the sump, the coarse filter, and the micro filter of the dish washing machine in FIG. 1. FIG. 46 is a partial enlarged top view illustrating the coarse filter and the micro filter of the dish washing machine in FIG. 1. FIG. 47 is a top view illustrating the lower portion of the washing tub of the dish washing machine in FIG. 1.

The dish washing machine 1 according to an embodiment of the disclosure may include the sump 100 configured to store the washing water, the circulation pump 51 configured to circulate the washing water in the sump 100 to the spray nozzles 311, 313, 330, and 340, the drainage pump 52 configured to discharge the washing water in the sump 100 to the outside of the main body 10 together with contaminants, and filters 120, 130, and 140 configured to filter the contaminants contained in the washing water.

The bottom plate 35 of the washing tub 30 may be formed with a drainage hole 50 (see FIG. 47) used to discharge the washing water to the sump 100, and the bottom plate 35 of the washing tub 30 may be inclined toward the drainage hole 50 so as to guide the washing water toward the drainage hole 50 by self-weight thereof (i.e., due to the force of gravity).

The sump 100 may have a substantially hemispheric shape and an opened upper surface. The sump 100 may include a bottom portion 101, a side wall portion 103, a reservoir chamber 110 formed in the bottom portion 101 and the side wall portion 103 configured to store the washing water, a circulation port 107 connected to the circulation pump 51, and a drainage port 108 connected to the drainage pump 52.

The filters 120, 130, and 140 may include a fine filter 120 mounted to the drainage hole 50 of the bottom plate 35, and a coarse filter 140 and a micro filter 130 which are mounted to the sump 100.

The coarse filter 140 may have a substantially cylindrical shape. The coarse filter 140 may be mounted on an inside surface of the side wall portion 103 of the sump 100.

The coarse filter 140 may have a filter portion 142 to filter contaminants having a relatively larger size, and a handle 141 used to mount the coarse filter 140. The filter portion 142 of the coarse filter 140 may be formed on a circumferential surface of the coarse filter 140. filter and may be mounted to the sump 100. An upper portion of the coarse filter 140 protrudes toward the inside of the washing tub 30 and a lower portion thereof may protrude into or toward a contaminant collection chamber 111 of the sump 100.

The coarse filter 140 may pass through a through-hole 139 of the micro filter 130 and a through-hole 122 of the fine filter 120. The through-hole 122 of the fine filter 120 may be disposed in a central portion or center of the fine filter 120, or may be disposed offset from the center of the fine filter 120. The contaminant collection chamber 111 will be described later.

The fine filter 120 may have a filter portion 121 configured to filter contaminants having a relatively middle size or more, and a through-hole 122 through which the coarse filter 140 passes. The fine filter 120 may be substantially horizontally mounted on the drainage hole 50 of the bottom plate 35. The fine filter 120 may be inclined such that the washing water is guided toward the through-hole 122 by self-weight thereof (i.e., due to the force of gravity).

The washing water in the washing tub 30 may flow toward the coarse filter 140 along the inclination of the fine filter 120. However, a portion of the washing water and contaminants may pass through the filter portion 121 of the fine filter 120 and immediately flow to the reservoir chamber 110 of the sump 100.

The micro filter 130 may have a filter portion 131 which filters contaminants having a relatively small size or more and may have a flat shape, frames 132, 133, and 135 configured to support the filter portion 131, and a through-hole 139 through which the coarse filter 140 passes.

The frames 132, 133, and 135 may include an upper frame 132, a lower frame 133, and side frames 135. The micro filter 130 may be mounted to the sump 100 such that the lower frame 133 is pressed against the bottom portion of the sump 100 and the side frames 135 may be pressed against the side wall portion 103 of the sump 100.

The micro filter 130 may partition the reservoir chamber 110 of the sump 100 into a contaminant collection chamber 111 and a circulation chamber 112. The contaminant collection chamber 111 may be connected to the drainage pump 52 and the circulation chamber 112 may be connected to the circulation pump 51. As shown in FIG. 38 for example, the contaminant collection chamber 111 may be disposed closer to the drain pump 52 than the circulation chamber 112. The circulation chamber 112 may be disposed closer to the circulation pump 51 than the contaminant collection chamber 111.

As described above, since the lower portion of the coarse filter 140 protrudes to the contaminant collection chamber 111, the washing water passing through the coarse filter 140 and the contaminants contained in the washing water may be introduced into the contaminant collection chamber 111.

The washing water introduced into the contaminant collection chamber 111 may pass through the micro filter 130 and flow to the circulation chamber 112. However, the contaminants contained in the washing water introduced into the contaminant collection chamber 111 do not pass through the micro filter 130, and the contaminants are left in the contaminant collection chamber 111 without flowing to the circulation chamber 112.

The contaminants collected in the contaminant collection chamber 111 may be discharged to the outside of the main body 10 together with the washing water when the drainage pump 52 operates.

Meanwhile, the micro filter 130 is preferably in close contact with the bottom portion 101 and the side wall portion 103 of the sump 100 so as to prevent the contaminants in the contaminant collection chamber 111 from flowing to the circulation chamber 112 through a gap between the micro filter 130 and the sump 100.

To this end, the lower frame 133 of the micro filter 130 may be formed with a lower sealing groove 134, and each of the side frames 135 may be formed with a side sealing protrusion 136 such that it protrudes toward side wall portion 103. In order to correspond to such a configuration, the bottom portion 101 of the sump 100 may be formed with a lower sealing protrusion 102 inserted into the lower sealing groove 134, and the side wall portion 103 of the sump 100 may be formed with a side sealing groove 104 into which the side sealing protrusion 136 is inserted.

Through such lower and side protrusions and grooves, the sealing between the micro filter 130 and the sump 100 may be enhanced.

Meanwhile, the coarse filter 140 may be inserted into the sump 100 in the vertical downward direction, and then mounted to the sump 100 by rotation from an unlocked position to a locked position.

To this end, an outer peripheral surface of the coarse filter 140 may be formed with a mounting protrusion 143, and the inside surface of the side wall portion 103 of the sump 100 may be formed with a mounting groove 105 into which the mounting protrusion 143 is horizontally inserted when the coarse filter 140 rotates from the unlocked position to the locked position.

The mounting protrusion 143 may have an upward inclined surface 144 moved upward when the coarse filter 140 is rotated from the unlocked position to the locked position. The mounting groove 105 may have a downward inclined surface 106 moved downward when the coarse filter 140 is rotated from the unlocked position to the locked position.

Through such a structure, the coarse filter 140 may move downward while the upward inclined surface 144 of the mounting protrusion 143 slides on the downward inclined surface 106 of the mounting groove 105 when the coarse filter 140 rotates from the unlocked position to the locked position.

The coarse filter 140 may press the micro filter 130 downward while moving downward when the coarse filter 140 rotates from the unlocked position to the locked position. To this end, the coarse filter 140 may have a downward pressing surface 145 which is horizontally formed so as to press the micro filter 130 downward. The micro filter 130 may have a downward corresponding surface 137 which is horizontally formed (e.g., on a portion of the upper frame 132) so as to be pressed by the downward pressing surface 145.

As such, since the coarse filter 140 presses the micro filter 130 downward when the coarse filter 140 rotates from the unlocked position to the locked position, the sealing between the lower frame 133 of the micro filter 130 and the bottom portion 101 of the sump 100 may be further enhanced and lifting or displacement of the micro filter 130 may be prevented.

In addition, the coarse filter 140 may have a side pressing surface 146 formed by expanding a portion of the outer peripheral surface thereof outward in the radial direction so as to laterally press the micro filter 130 when the coarse filter 140 rotates from the unlocked position to the locked position. That is, the coarse filter 140 may have a bulged shape or an oval shape.

The micro filter 130 may have a side corresponding surface 138 which is laterally pressed by the side pressing surface 146. For example, side corresponding surface 138 may be disposed as or correspond to an inner wall of the upper frame 132 which forms through-hole 139.

Through such a configuration, since the micro filter 130 is laterally pressed when the coarse filter 140 rotates from the unlocked position to the locked position, the sealing between the side frame 135 of the micro filter 130 and the side wall portion 103 of the sump 100 may be further enhanced.

Meanwhile, the coarse filter 140 may be arranged to be biased toward one side wall of both side walls 33 and 34 of the washing tub 30, as shown in FIG. 47. That is, the coarse filter 140 may be arranged closer to the left wall 33 than the right wall 34. Alternatively, the coarse filter 140 may be disposed more closely to the right wall 34 than the left wall 33, for example. Additionally, the coarse filter 140 may be disposed more closely to the rear wall 32 than the door 11, for example, or vice versa. Through such arrangement of the coarse filter 140, the coarse filter 140 may be easily separated without interference with the rail 440 during separation of the coarse filter 140.

Hereinafter, a dish washing machine according to an embodiment of the disclosure will be described.

Figure 48:
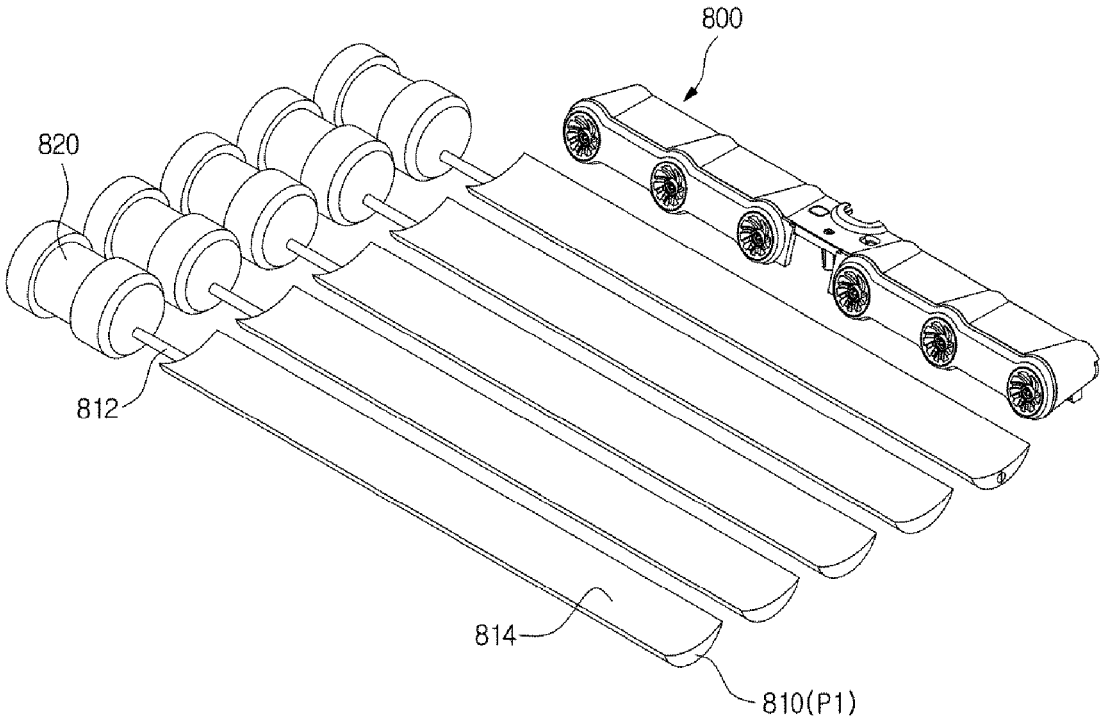
FIG. 48 is a perspective view illustrating a dish washing machine according to an embodiment of the disclosure.
Figure 49:
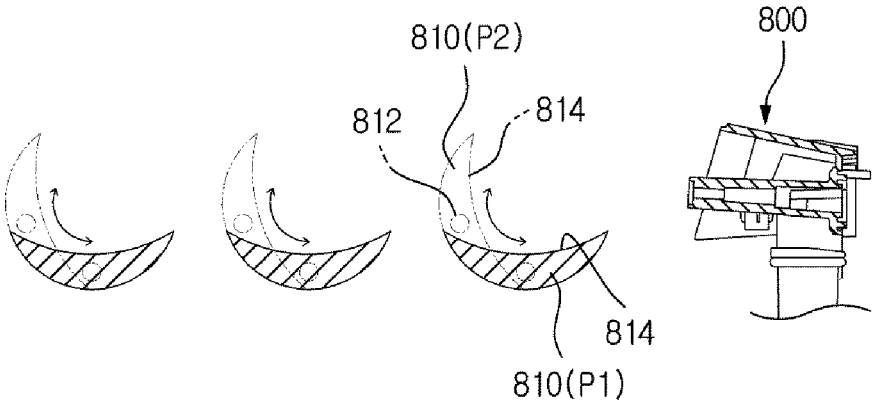
FIG. 49 is a cross-sectional view illustrating an operation of the dish washing machine according to the dish washing machine in FIG. 48.

FIG. 48 is a perspective view illustrating a dish washing machine according to an embodiment of the disclosure. FIG. 49 is a cross-sectional view illustrating an operation of the dish washing machine according to an embodiment of the disclosure.

Unlike the above-mentioned embodiment, vanes 810 may be rotatably arranged in a fixed state without moving along a rail in the embodiment.

A plurality of vanes 810 may be provided such that a direction of washing water sprayed from a stationary nozzle assembly 800 is changed by operating at least one of the vanes and thus the washing water may be sprayed toward baskets 12*a* and 12*b*.

That is, the plurality of vanes 810 may be rotatably provided and be arranged in parallel with one another with respect to a bottom plate 35 of a washing tub.

Each of the plurality of vanes 810 may include a reflective surface 814 configured to reflect the washing water sprayed from the stationary nozzle assembly 800. The vane 810 may be provided so as to rotate between a standby position P1 at which the reflective surface 814 is spaced from a progress direction of the washing water and a reflection position P2 at which the reflective surface 814 is arranged in the progress direction of the washing water by rotating the reflective surface from the standby position P1 such that the washing water is reflected toward the baskets 12*a* and 12*b*.

That is, the vane 810 may alternately rotate between the standby position P1 and the reflection position P2 and washes dishes that may be stored in the baskets 12*a* and 12*b* by changing the reflected position of the washing water. The vanes 810 may sequentially rotate between the standby position P1 and the reflection position P2 or may rotate between the standby position P1 and the reflection position P2 according to a fixed rule. The operation methods of the plurality of vanes 810 are not limited. Here, a reflection position may refer to a position of the vane which is capable of reflecting the washing water sprayed from the stationary nozzle assembly 800 toward the baskets. Further, there may be more than one reflection position and reflection position P2 is merely provided as an example.

Each of the plurality of vanes 810 may be operated by a drive portion 820.

The plurality of drive portions 820 may be formed so as to correspond to the plurality of vanes 810. The plurality of drive portions 820 may be respectively provided to correspond to the plurality of vanes 810, and each may be provided such that the associated vane 810 independently operates.

The plurality of drive portions 820 may be connected to respective rotary shafts 812 of the plurality of vanes 810 and each of the plurality of drive portions 820 may be individually controlled by a control unit (controller) (not shown). Thus, each of the plurality of vanes 810 may independently rotate between the standby position P1 and the reflection position P2.

Each of the drive portions 820 may include a motor. As shown in FIGS. 48 and 49, the number of vanes 810 which may be disposed in the washing tub may be determined according to how the vanes are distributed. For example, the vanes may be distributed from a position adjacent to the nozzle assembly 800 to the front of the washing tub (i.e., to the door), or may be distributed from a position adjacent to the nozzle assembly 800 to some other portion of the washing tub (e.g., a central portion of the washing tub). Also, the number of vanes may be determined according to the size of the reflective surfaces, vanes, etc. Also, the vanes may be evenly distributed at regular intervals or may be irregularly distributed at irregular intervals. Because each of the vanes 810 may independently rotate according to a command by the controller, the vanes may be rotated at a same or different speed from one another, some vanes may be rotated while others are not, etc. Also, it would be understood by one of ordinary skill in the art that drive portions 820 may be arranged on an opposite side of the dish washing machine. Also, it would be understood by one of ordinary skill in the art that drive portions 820 may be arranged on both sides of the dish washing machine such that drive portions on one side control some of the vanes, and drive portions on the other side control the remaining vanes. Also, it would be understood by one of ordinary skill in the art that drive portions 820 may be arranged on both sides of the dish washing machine such that drive portions on one side control vanes which extend from the one side to a central portion of the washing tub, and drive portions on the other side control vanes which extend from the other side to the central portion of the washing tub. Such an arrangement may enable the washing tub to be further divided into regions which may be washed differently (e.g., according to a command of the controller).

Hereinafter, a dish washing machine according to an embodiment of the disclosure will be described.

Figure 50:
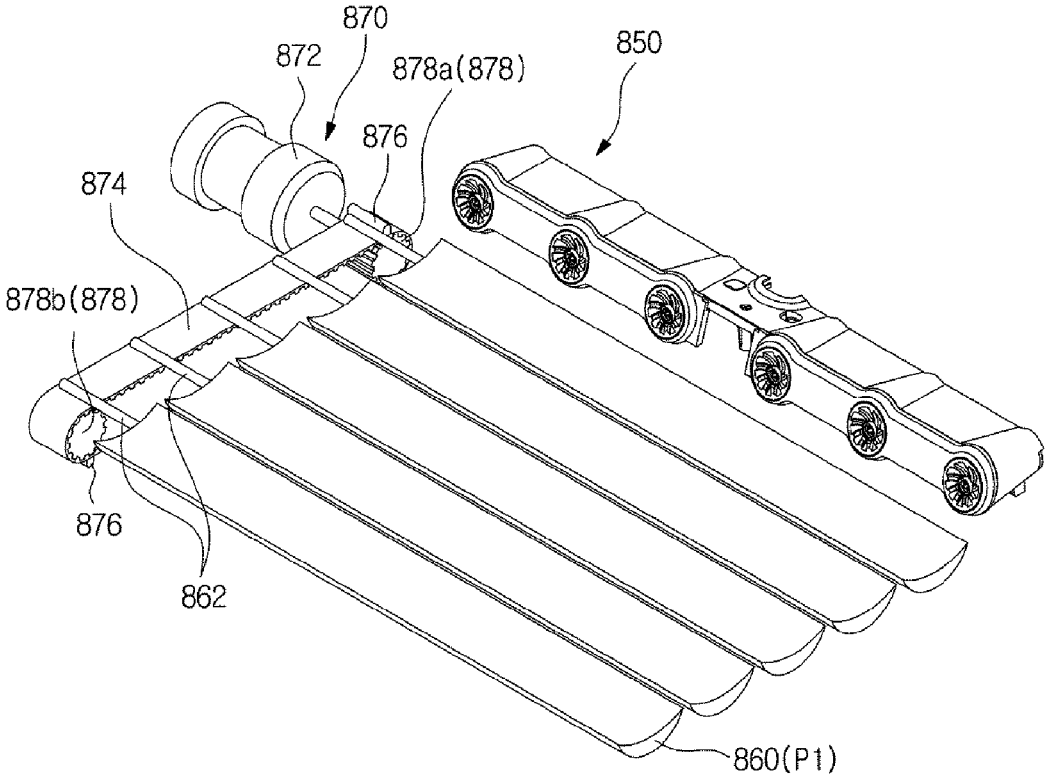
FIG. 50 is a perspective view illustrating a dish washing machine according to an embodiment of the disclosure.
Figure 51:
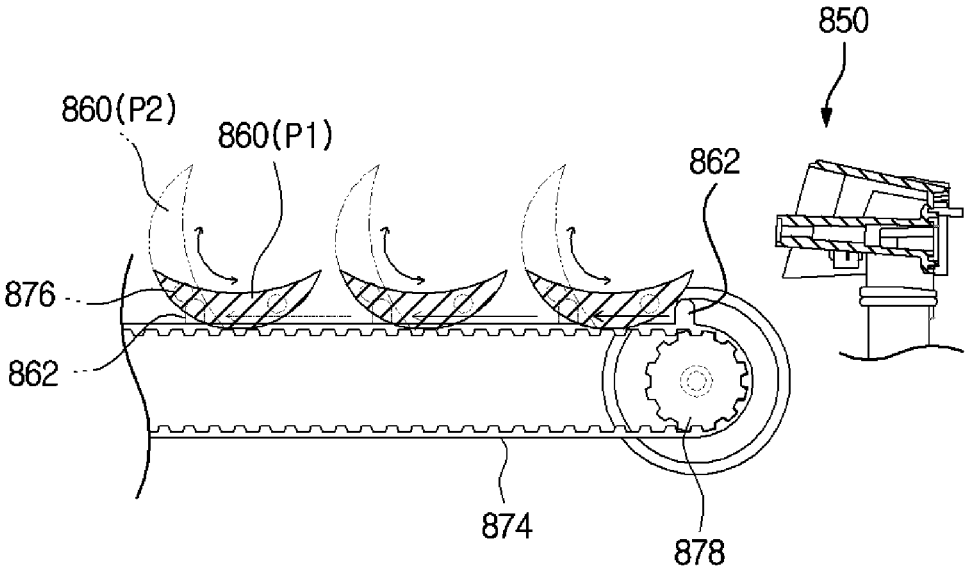
FIG. 51 is a cross-sectional view illustrating an operation of the dish washing machine according to the dish washing machine in FIG. 50.

FIG. 50 is a perspective view illustrating a dish washing machine according to an embodiment of the disclosure. FIG. 51 is a cross-sectional view illustrating an operation of the dish washing machine according to an embodiment of the disclosure.

Description of the same configurations as the above-mentioned embodiments will be omitted.

The embodiment shown in FIGS. 50-51 differs from the embodiment shown in FIGS. 48-49 in terms of a structure of a drive portion.

A plurality of vanes 860 may be provided such that a direction of washing water sprayed from a stationary nozzle assembly 850 may be changed by operating at least one of the vanes and thus the washing water may be sprayed toward baskets 12*a* and 12*b*.

The plurality of vanes 860 may operate by a drive portion 870.

The drive portion 870 may include a motor 872 configured to generate a driving force, a belt 874 which is rotatably connected to a pulley 878 used to rotate the vanes 860 by the driving force of the motor 872, and a pushing protrusion 876 provided on the belt 874.

The pulley 878 may include a drive pulley 878*a* and an idle pulley 878*b*. The drive pulley 878*a* and the idle pulley 878*b* may be arranged so as to come into contact with an inside surface of the belt 874 and be provided so as to rotate in the same direction. As shown in FIG. 50, the drive pulley 878*a* is closer to the nozzle assembly 850 than the idle pulley 878*b*, however an opposite arrangement may be possible where the motor is disposed at an opposite side of the washing tub.

The drive pulley 878*a* may be connected to the motor 872 and may rotate the belt 874 by receiving the driving force of the motor 872. The drive pulley 878*a* operates the belt 874 and the idle pulley 878*b* by the driving force transferred from the motor 872. In detail, the drive pulley 878*a* may be arranged at one side of the inside surface of the belt 874, the idle pulley 878*b* may be arranged at the other side thereof. Thus, the belt 874 and the idle pulley 878*b* may rotate together by rotation of the drive pulley 878*a*.

The pushing protrusion 876 may be provided on the belt 874.

The plurality of vanes 860 may be respectively provided with a plurality of protrusion portions 862 formed to longitudinally protrude. The pushing protrusion 876 may be provided on the belt 874 and may operate the plurality of vanes 860 by pushing the plurality of protrusion portions 862 while rotating along with the belt 874.

In detail, the pushing protrusion 876 may be provided on an outer peripheral surface of the belt 874 and may push at least one of the plurality of protrusion portions 862 while rotating when the belt 874 rotates. The associated vane 860 pushed by the pushing protrusion 876 may move from a standby position P1 to a reflection position P2. Here, a reflection position may refer to a position of the vane which is capable of reflecting the washing water sprayed from the stationary nozzle assembly 800 toward the baskets. Further, there may be more than one reflection position and reflection position P2 is merely provided as an example.

Since the pushing protrusion 876 moves along with the belt 874 when the belt 874 rotates, the pushing protrusion 876 may move according to a certain trajectory and may sequentially push the plurality of protrusion portions 862 arranged on the trajectory. Consequently, each of the plurality of vanes 860 sequentially moves from the standby position P1 to the reflection position P2. The vane 860 moved to the reflection position P2 by the pushing protrusion 876 may be moved to the standby position P1 by self-weight (i.e., due to the force of gravity) of the vane 860 again when the pushing protrusion 876 passes, so that the vane 860 returns to an original position. As shown in FIGS. 50 and 51, the number of vanes 860 which may be disposed in the washing tub may be determined according to how the vanes are distributed. For example, the vanes may be distributed from a position adjacent to the nozzle assembly 850 to the front of the washing tub (i.e., to the door), or may be distributed from a position adjacent to the nozzle assembly 850 to some other portion of the washing tub (e.g., a central portion of the washing tub). Also, the number of vanes may be determined according to the size of the reflective surfaces, vanes, etc. Also, the vanes may be evenly distributed at regular intervals or may be irregularly distributed at irregular intervals. Also, it would be understood by one of ordinary skill in the art that drive portion 870 may be arranged on an opposite side of the dish washing machine. Also, it would be understood by one of ordinary skill in the art that multiple drive portions 870 may be arranged on one or both sides of the dish washing machine such that drive portions on one side control some of the vanes, and drive portions on the other side control the remaining vanes. Also, it would be understood by one of ordinary skill in the art that drive portions 870 may be arranged on both sides of the dish washing machine such that drive portions on one side control vanes which extend from the one side to a central portion of the washing tub, and drive portions on the other side control vanes which extend from the other side to the central portion of the washing tub. Such an arrangement may enable the washing tub to be further divided into regions which may be washed differently (e.g., according to a command of the controller).

Hereinafter, a dish washing machine according to an embodiment of the disclosure will be described.

Figure 52:
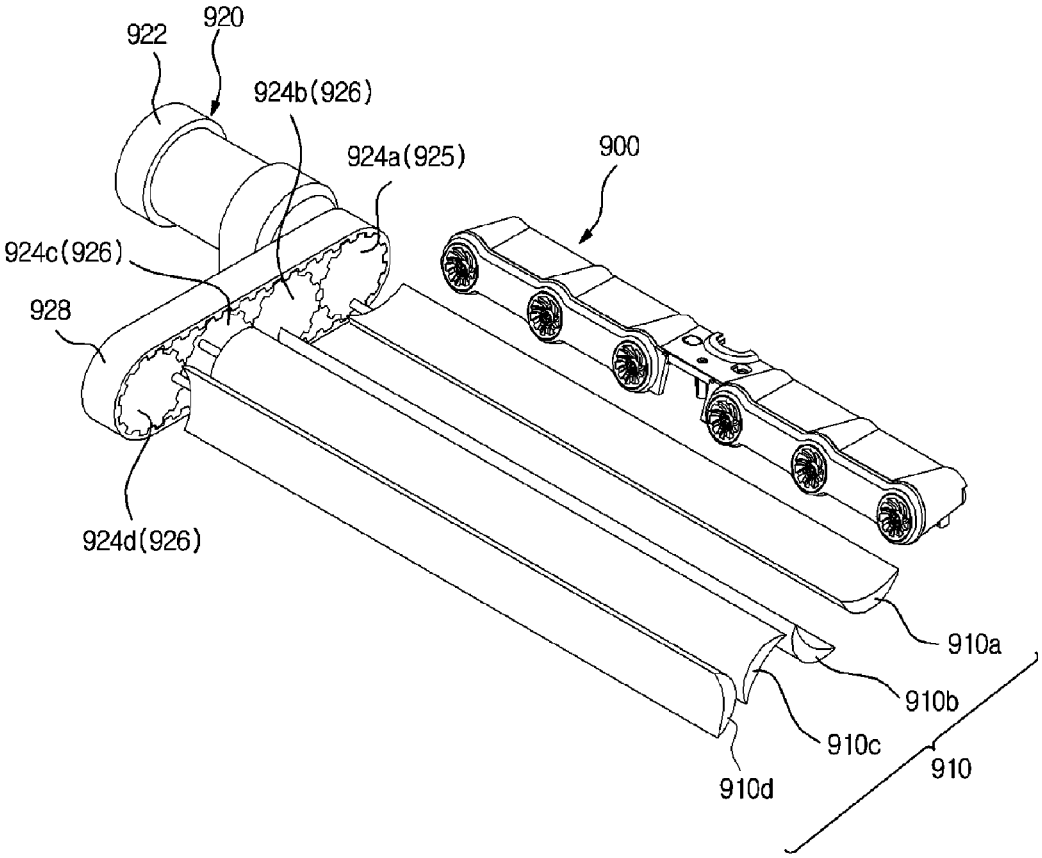
FIG. 52 is a perspective view illustrating a dish washing machine according to an embodiment of the disclosure.
Figure 53:
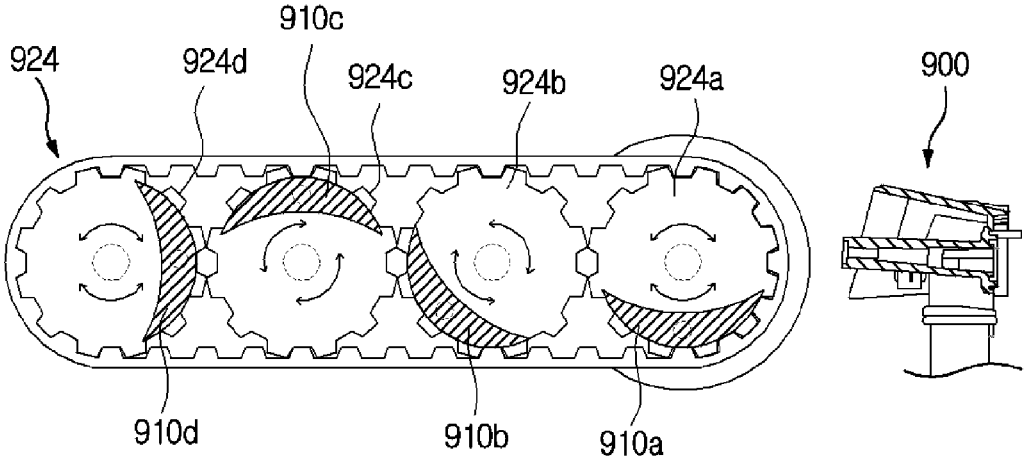
FIG. 53 is a cross-sectional view illustrating an operation of the dish washing machine according to the dish washing machine in FIG. 52.

FIG. 52 is a perspective view illustrating a dish washing machine according to an embodiment of the disclosure. FIG. 53 is a cross-sectional view illustrating an operation of the dish washing machine according to an embodiment of the disclosure.

Description of the same configurations as the above-mentioned embodiments will be omitted.

The embodiment shown in FIGS. 52 and 53 differs from the embodiment shown in FIGS. 50 and 51 in terms of a structure of a drive portion.

A plurality of vanes 910 may be provided such that a direction of washing water sprayed from a stationary nozzle assembly 900 is changed by operating at least one of the vanes and thus the washing water may be sprayed towards baskets 12*a* and 12*b*.

The plurality of vanes 910 may operate by a drive portion 920.

The drive portion 920 may include a motor 922 configured to generate a driving force, and a pulley 924 rotating by the driving force of the motor 922. The drive portion 920 may further include a belt 928 which is rotatably provided by the pulley 924.

The pulley 924 may include a drive pulley 925 and a plurality of idle pulleys 926. The drive pulley 925 and the idle pulleys 926 may be arranged so as to come into contact with an inside surface of the belt 928 and be provided so as to rotate in the same direction.

The drive pulley 925 may be connected to the motor 922 and may rotate the belt 928 by receiving the driving force of the motor 922. The drive pulley 925 operates the belt 928 and the plurality of idle pulleys 926 by the driving force received from the motor 922. In detail, the drive pulley 925 may be arranged at one side of the inside surface of the belt 928, and the plurality of idle pulleys 926 may be arranged up to the other side thereof.

Each end portion of the plurality of vanes 910 may be coupled to the pulley 924 and the plurality of vanes 910 may rotate along with the pulley 924 when the pulley 924 rotates.

In detail, the plurality of vanes 910 may be coupled to a plurality of pulleys 924 so as to have different phase differences.

The plurality of vanes 910 may include a first vane 910*a*, a second vane 910*b*, a third vane 910*c*, and a fourth vane 910*d*. The pulley 924 may include a first pulley 924*a*, a second pulley 924*b*, a third pulley 924*c*, and a fourth pulley 924*d* so as to correspond to the plurality of vanes 910.

Since the plurality of vanes 910 may be coupled to the plurality of pulleys 924 such that a center of each vane 910 is spaced apart from a center of rotation of each corresponding pulley of the plurality of pulleys 924 and have different phase differences, each vane 910 arranged at a reflection position may be changed according to rotation of the associated pulley 924.

In detail, the center of the first vane 910*a* may have an angle of 0° with respect to a reference horizontal plane, the center of the second vane 910*b* may have an angle of 90° with respect to the reference horizontal plane, the center of the third vane 910*c* may have an angle of 180° with respect to the reference horizontal plane, and the center of the fourth vane 910*d* may have an angle of 270° with respect to the reference horizontal plane.

When the drive pulley 925 rotates through such a configuration, the belt 928 and the plurality of idle pulleys 926 rotate and thus the first, second, third, and fourth vanes 910*a*, 910*b*, 910*c*, and 910*d* also rotate together. In this process, since the first to fourth vanes have different phase differences, at least one of the vanes may be provided so as to be located at a reflection position, at which the direction of the washing water is changed toward the baskets 12*a* and 12*b* when the drive pulley 925 rotates.

Although the four vanes 910 and pulleys 924 have been described to be provided for convenience in the embodiment, the disclosure is not limited thereto. For example, the vanes 910 and pulleys 924 may be used as long as a plurality of vanes and pulleys are provided. As shown in FIGS. 52 and 53, the number of vanes 910 which may be disposed in the washing tub may be determined according to how the vanes are distributed. For example, the vanes may be distributed from a position adjacent to the nozzle assembly 900 to the front of the washing tub (i.e., to the door), or may be distributed from a position adjacent to the nozzle assembly 900 to some other portion of the washing tub (e.g., a central portion of the washing tub). Also, the number of vanes may be determined according to the size of the reflective surfaces, vanes, etc. Also, the vanes may be evenly distributed at regular intervals or may be irregularly distributed at irregular intervals. Also, it would be understood by one of ordinary skill in the art that drive portion 920 may be arranged on an opposite side of the dish washing machine. Also, it would be understood by one of ordinary skill in the art that multiple drive portions 920 may be arranged on one or both sides of the dish washing machine such that drive portions on one side control some of the vanes, and drive portions on the other side control the remaining vanes. Also, it would be understood by one of ordinary skill in the art that drive portions 920 may be arranged on both sides of the dish washing machine such that drive portions on one side control vanes which extend from the one side to a central portion of the washing tub, and drive portions on the other side control vanes which extend from the other side to the central portion of the washing tub. Such an arrangement may enable the washing tub to be further divided into regions which may be washed differently (e.g., according to a command of the controller).

Hereinafter, a dish washing machine according to an embodiment of the disclosure will be described.

Figure 54:
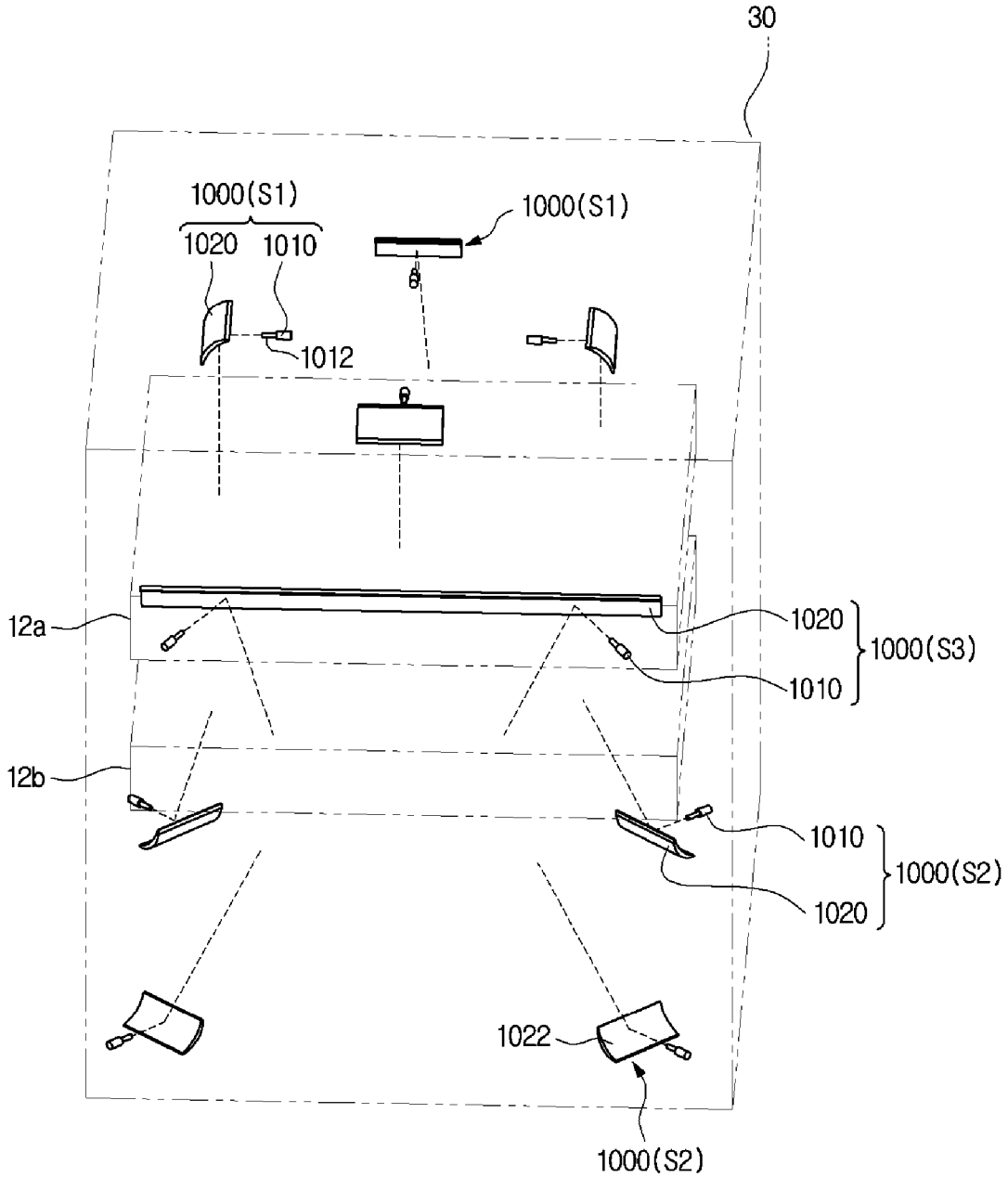
FIG. 54 is a perspective view illustrating a dish washing machine according to a fifth embodiment of the disclosure.

FIG. 54 is a perspective view illustrating a dish washing machine according to an embodiment of the disclosure Description of the same configurations as the above-mentioned embodiments will be omitted.

In accordance with an aspect of the disclosure, a plurality of stationary nozzles and a plurality of stationary reflective portions may be provided in the dish washing machine. Of course, the stationary nozzle assembly and the movable vane as previously described may also be applied to the embodiment shown in FIG. 54.

A plurality of washing mechanisms 1000 may be provided to wash dishes stored in baskets 12*a* and 12*b*.

Each of the washing mechanisms 1000 may include a stationary nozzle 1010 fixed into a washing tub to spray washing water and a stationary reflective portion 1020 provided to correspond to the stationary nozzle 1010.

The stationary nozzle 1010 may have a washing water spray hole 1012 to spray the washing water, and the washing water may be sprayed through the washing water spray hole 1012. The shape of the stationary nozzle 1010 is not limited, but the stationary nozzle 1010 may have one washing water spray hole 1012 in an embodiment.

The stationary reflective portion 1020 may be provided so as to correspond to the stationary nozzle 1010 and face toward the stationary nozzle such that when the washing water is received by the stationary reflective portion from the stationary nozzle, the washing water is reflected and directed toward the dishes stored in the baskets 12*a* and 12*b* by changing the direction of the washing water sprayed from the stationary nozzle 1010. That is, the stationary reflective portion 1020 may be arranged in a progress (spray) direction of the sprayed washing water. The shape of the stationary reflective portion 1020 is not limited. However, since the stationary nozzle 1010 has one washing water spray hole 1012, the stationary reflective portion 1020 may include a reflective surface 1022 having a width corresponding to the stationary nozzle. The vane 400 may be movably provided in an embodiment, but the stationary reflective portion 1020 may be provided to be rotatable on the spot without movement. This may be applied to all stationary reflective portions 1020 to be described later.

Each of the plurality of washing mechanisms 1000 may independently operate. The washing water supplied to each nozzle may be distributed by the distribution device 200 disclosed above. However, in an embodiment, the number of hoses connected to the distribution device 200 and the number of outlets of the distribution device 200 may be increased and the numbers may be controlled respectively. The configuration provided such that each of the plurality of washing mechanisms 1000 independently operates is not limited, and this may be applied to all of the plurality of washing mechanisms 1000 to be described later.

The plurality of washing mechanisms 1000 may be provided and arranged in the washing tub 30. The arrangement of the plurality of washing mechanisms 1000 is not limited. However, three arrangement states, for example, will be described below for an understanding of the disclosure.

The plurality of washing mechanisms 1000 having a first arrangement state S1 will be described.

In each of the plurality of washing mechanisms 1000, the stationary nozzle 1010 may be arranged at the center of washing tub to radially spray the washing water, and the stationary reflective portion 1020 may change the direction of the washing water sprayed from the stationary nozzle 1010 such that the washing water is directed toward the baskets 12*a* and 12*b*. For example, the washing mechanism 1000 may be arranged at the center of one or more side surfaces of the washing tub to radially spray the washing water.

The plurality of washing mechanisms 1000 having a second arrangement state S2 will be described.

In each of the plurality of washing mechanisms 1000, the stationary nozzle 1010 may be arranged at one or more corners of the washing tub to spray the washing water toward the inside of the washing tub, and the stationary reflective portion 1020 may change the direction of the washing water sprayed from the stationary nozzle 1010 such that the washing water is directed toward the baskets 12*a* and 12*b*. That is, the washing mechanism 1000 may be arranged at the one or more corner portions of the washing tub to spray the washing water toward the inside of the washing tub.

The plurality of washing mechanisms 1000 having a third arrangement state S3 will be described.

The plurality of baskets 12*a* and 12*b* are provided in the washing tub. In each of the plurality of washing mechanisms 1000, the stationary reflective portion 1020 may be arranged in at least one of the plurality of baskets 12*a* and 12*b* and may change the direction of the washing water to the other adjacent basket 12*a* or 12*b*.

The arrangement in which the stationary reflective portion 1020 is arranged in the plurality of baskets 12*a* and 12*b* is not limited. However, the stationary reflective portion 1020 may be arranged at a lower edge of the upper basket 12*a*, for example.

Thus, the stationary nozzle 1010 may be arranged at the lower portion or the side surface of washing tub to spray the washing water toward the stationary reflective portion 1020. The washing water sprayed from the stationary nozzle 1010 may be reflected by the stationary reflective portion 1020 to wash the dishes stored in at least one of the baskets (e.g., the lower basket 12*b*).

Although the three arrangement states of the plurality of washing mechanisms 1000, for example, have been described, the plurality of washing mechanisms 1000 may be arranged in any state, with it being desirable that the dead region which is not washed by the washing water may be eliminated in the washing tub.

Hereinafter, a dish washing machine according to an embodiment of the disclosure will be described.

Figure 55:
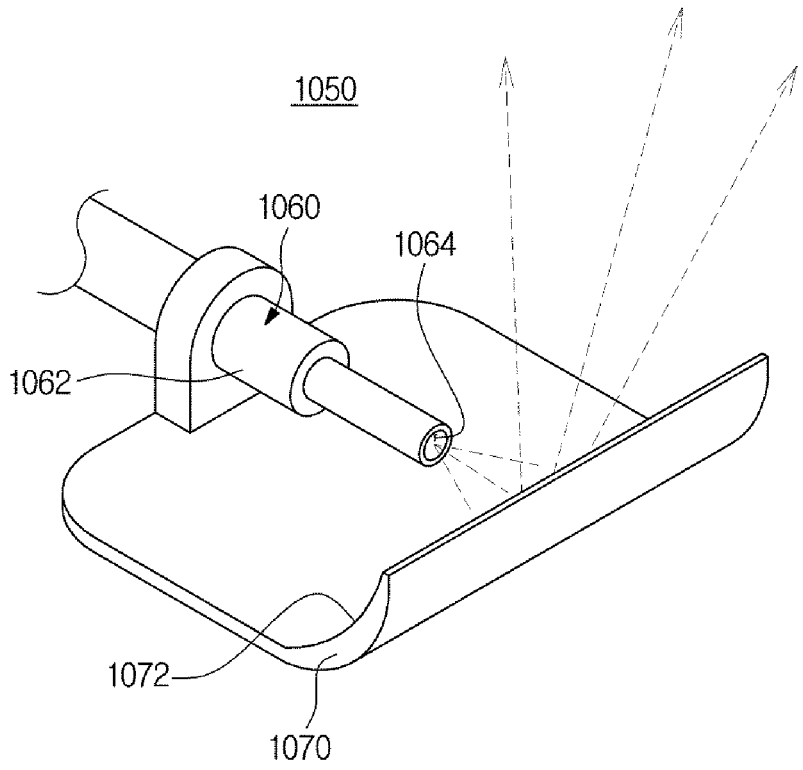
FIG. 55 is a perspective view illustrating a spray nozzle of a dish washing machine according to an embodiment of the disclosure.

FIG. 55 is a perspective view illustrating a spray nozzle of a dish washing machine according to an embodiment of the disclosure.

Description of the same configurations as the above-mentioned embodiments will be omitted.

The embodiment shown in FIG. 55 differs from the embodiment shown in FIG. 54 in terms of a configuration of a washing mechanism.

A plurality of washing mechanisms 1050 may be provided to wash dishes stored in baskets.

Each of the washing mechanisms 1050 may include a stationary nozzle 1060 fixed to a washing tub to spray washing water and a stationary reflective portion 1070 provided to correspond to the stationary nozzle 1060. In an embodiment, the stationary nozzle 1060 and the stationary reflective portion 1070 may be integrally formed.

The stationary nozzle 1060 may include a stationary nozzle body 1062 and a washing water spray hole 1064 to spray the washing water. The stationary reflective portion 1070 is formed to extend from the stationary nozzle body 1062 and an end portion thereof is arranged in a progress direction of the washing water sprayed through the washing water spray hole 1064.

In detail, the stationary reflective portion 1070 may include a reflective surface 1072 which is bent from the stationary nozzle body 1062 and changes the progress direction of the washing water sprayed through the washing water spray hole 1064.

Hereinafter, a dish washing machine according to an embodiment of the disclosure will be described.

Figure 56:
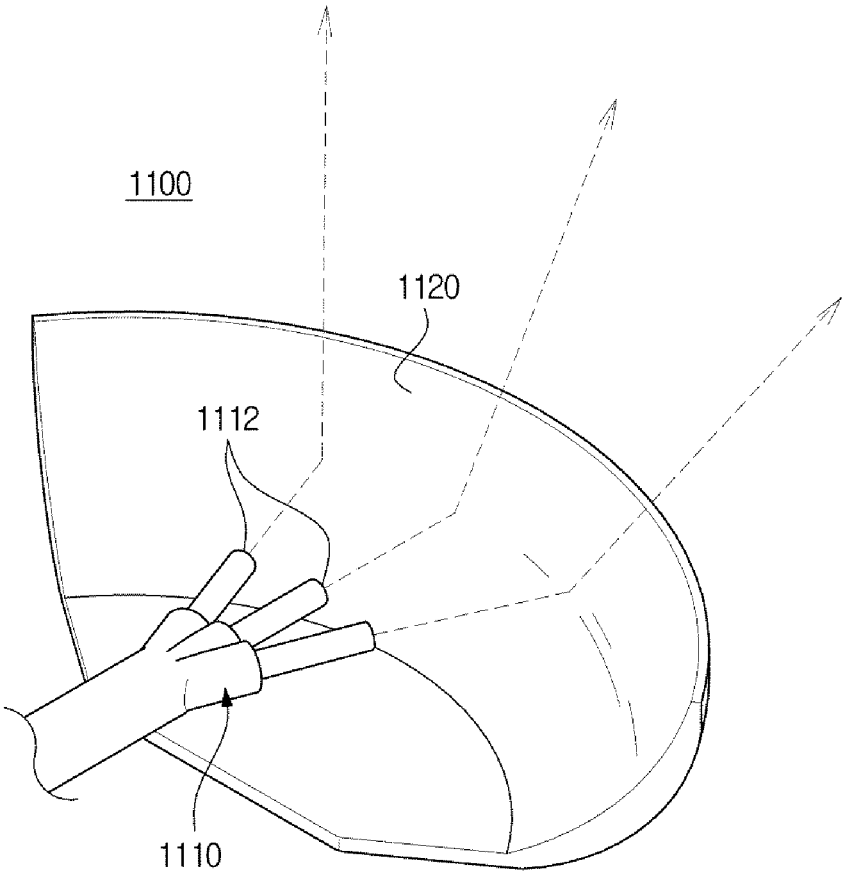
FIG. 56 is a perspective view illustrating a spray nozzle of a dish washing machine according to an embodiment of the disclosure.

FIG. 56 is a perspective view illustrating a spray nozzle of a dish washing machine according to an embodiment of the disclosure.

Description of the same configurations as the above-mentioned embodiments will be omitted.

The embodiment shown in FIG. 56 differs from the embodiment shown in FIG. 54 in terms of a configuration of a washing mechanism 1100.

A plurality of washing mechanisms 1100 may be provided to wash dishes stored in baskets.

Each of the washing mechanisms 1100 may include a stationary nozzle 1110 fixed to a washing tub to spray washing water and a stationary reflective portion 1120 provided to correspond to the stationary nozzle 1110.

The stationary nozzle 1110 may have a plurality of washing water spray holes 1112 configured to spray the washing water. In an embodiment, three washing water spray holes 1112 may be provided. However, the number of the washing water spray holes is not limited (e.g., the number of spray holes may be two, or more than three).

The plurality of washing water spray holes 1112 of the stationary nozzle 1110 may be spaced a predetermined angle from each other, and may enlarge a spray range of the washing water. For example, the spray holes may be spaced apart from one another by the same angle, or by a different angle. For example, the spray holes may have a same shape (e.g., a same diameter) from which water is sprayed, or may have a different shape (e.g., a different diameter).

The stationary reflective portion 1120 may have an arc cross-section in the horizontal direction to correspond to the plurality of washing water spray holes 1112, and may be vertically bent to reflect the washing water sprayed from the washing water spray holes 1112. That is, the end portion of the stationary reflective portion 1120 may have a bent fan shape.

Through such a configuration, the spray range of the washing water sprayed from the washing mechanism 1100 may be enlarged and thus more effective washing may be performed.

Hereinafter, a dish washing machine according to an embodiment of the disclosure will be described.

Figure 57:
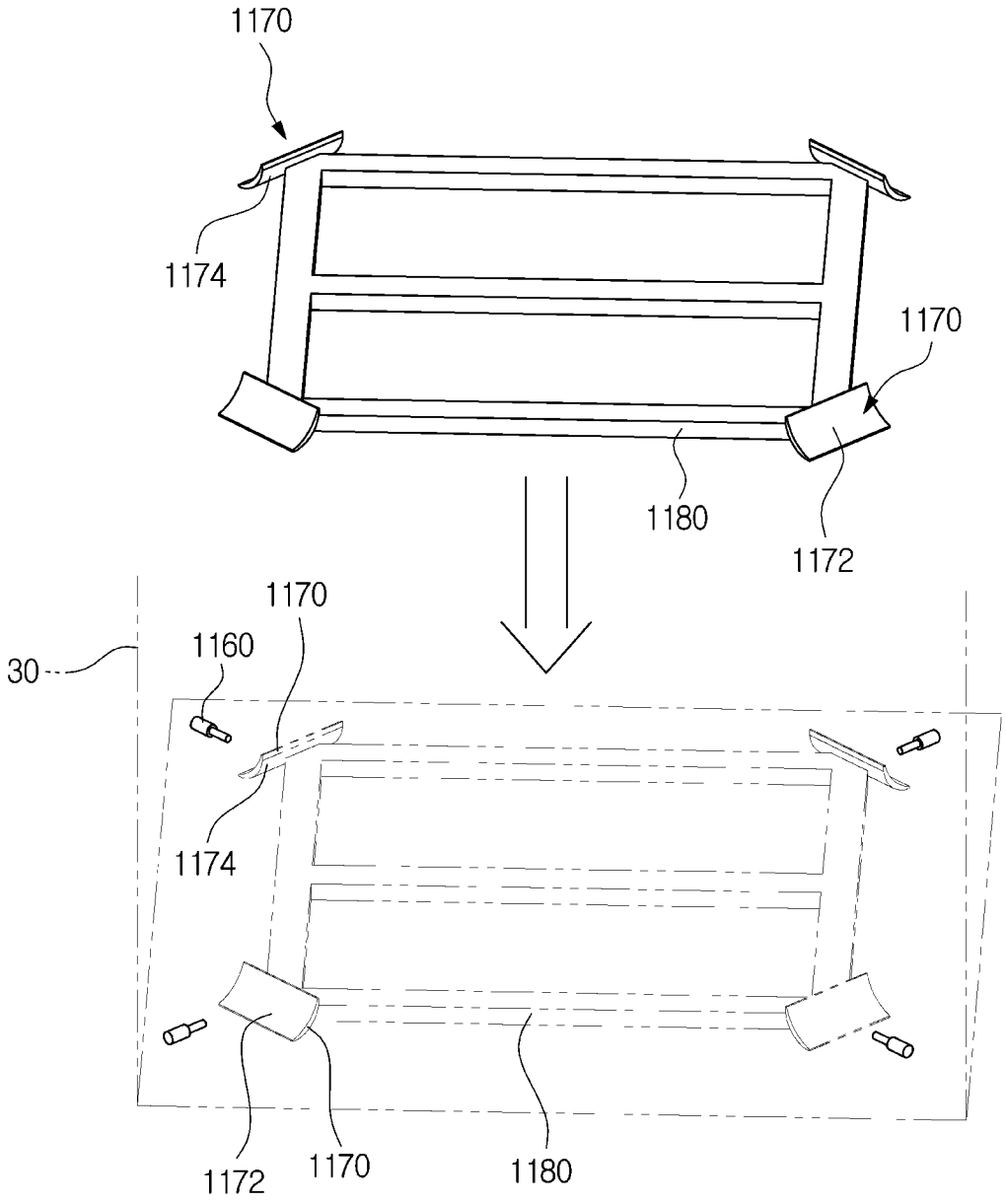
FIG. 57 is a view illustrating mounting of a settling frame of a dish washing machine according to an embodiment of the disclosure.

FIG. 57 is a view illustrating mounting of a settling frame of a dish washing machine according to an embodiment of the disclosure.

Description of the same configurations as the above-mentioned embodiments will be omitted.

The embodiment shown in FIG. 57 differs from the embodiment shown in FIG. 54 in terms of a configuration of a washing mechanism.

A plurality of washing mechanisms 1150 may be provided to wash dishes stored in baskets.

Each of the washing mechanisms 1150 may include a stationary nozzle 1160 fixed to a washing tub to spray washing water and a stationary reflective portion 1170 provided to correspond to the stationary nozzle 1160. The plurality of washing mechanisms 1150 may be provided, and thus the stationary reflective portion 1170 may be provided in plural numbers.

The washing mechanism 1150 may include a settling frame 1180 configured such that the plurality of stationary reflective portions 1170 are settled and supported.

The settling frame 1180 may be provided such that arrangement angles and arrangement states of the plurality of stationary reflective portions 1170 are uniformly provided in the washing tub. The shape of the settling frame 1180 is not limited. However, in an example embodiment, the settling frame 1180 may have a frame shape formed of wires so as not to disturb the pass and flow of the washing water.

Each of the stationary reflective portions 1170 may include a reflective surface 1172 to reflect the washing water sprayed from the stationary nozzle 1160, and a settling surface 1174 which is provided on a back surface thereof and is settled in the settling frame 1180. The shape of the settling surface 1174 is not limited, but the settling surface 1174 may be formed such that the stationary reflective portion 1170 is rotatable.

The settling frame 1180 may be provided to be separated from the washing tub. Through such a configuration, since the settling frame 1180 is separated from the washing tub in a state in which the stationary reflective portions 1170 are mounted to the settling frame 1180, maintenance may be performed in a separated state and thus convenience for work may be improved.

As is apparent from the above description, it may be possible to improve washing efficiency by minimizing a dead region of an object to be washed through a dish washing machine in accordance with various embodiments of the disclosure. In addition, it may be possible to intensively wash dishes by application of a plurality of washing mechanisms. Accordingly, it is possible to effectively wash the dishes.

The dish washing machine and operation thereof according to the above-described example embodiments may use one or more processors. For example, the controller may include one or more processors. For example, a processing device may be implemented using one or more general-purpose or special purpose computers, and may include, for example, one or more of a processor, a controller and an arithmetic logic unit, a central processing unit (CPU), a graphics processing unit (GPU), a digital signal processor (DSP), an image processor, a microcomputer, a field programmable array, a programmable logic unit, an application-specific integrated circuit (ASIC), a microprocessor or any other device capable of responding to and executing instructions in a defined manner.

Although embodiments of the disclosure have been shown and described, it would be appreciated by those skilled in the art that changes may be made to these embodiments without departing from the principles and spirit of the disclosure, the scope of which is defined in the claims and their equivalents.

What is claimed is:

1. A dish washing machine comprising:

a main body;

a washing tub disposed in the main body;

a basket disposed in the washing tub;

a stationary nozzle fixed to a side of the washing tub to spray washing water; and a plurality of vanes arranged to be parallel with respect to one another in a spraying direction of the stationary nozzle, at least one of the plurality of vanes being rotatable so that the washing water sprayed from the stationary nozzle is reflected toward the basket, wherein the plurality of vanes comprises a reflective surface used to reflect the washing water sprayed from the stationary nozzle; and the at least one vane is provided to rotate between a standby position at which the reflective surface is spaced apart from a progress direction of the washing water and a reflection position at which the reflective surface is arranged in the progress direction of the washing such that the washing water is reflected toward the basket.

2. The dish washing machine according to claim 1, wherein the plurality of vanes each independently operate from one another between the standby position and the reflection position.

3. The dish washing machine according to claim 1, further comprising a plurality of drive portions which are respectively coupled to the plurality of vanes so as to independently rotate each of the plurality of vanes.

4. The dish washing machine according to claim 1, further comprising a drive portion to drive the plurality of vanes, wherein the plurality of vanes comprise a plurality of protrusion portions protruding in longitudinal directions of the respective vanes, and the drive portion comprises:

a motor to generate a driving force;

a belt rotatably connected to a pulley to rotate the plurality of vanes by the driving force of the motor; and a pushing protrusion provided on the belt to sequentially rotate the plurality of vanes from the standby position to the reflection position by pushing at least one of the plurality of protrusion portions.

5. The dish washing machine according to claim 4, wherein the at least one vane rotated from the standby position to the reflection position by the pushing protrusion returns to the standby position due to self-weight thereof.

6. The dish washing machine according to claim 1, further comprising a drive portion to drive the plurality of vanes, wherein the drive portion comprises:

a motor to generate a driving force; and a belt rotatably connected to a plurality of pulleys to rotate the plurality of vanes by the driving force of the motor, and the plurality of vanes are rotatably coupled to the plurality of pulleys so as to have different phases.

7. The dish washing machine according to claim 6, wherein the plurality of pulleys comprise:

a drive pulley connected to the motor to receive the driving force; and a plurality of idle pulleys to receive the driving force from the drive pulley.

8. The dish washing machine according to claim 6, wherein the plurality of vanes are coupled to the plurality of pulleys such that an end portion of each vane is spaced apart from a center of rotation of each pulley.

9. The dish washing machine according to claim 1, wherein the plurality of vanes are arranged in a direction perpendicular to the spraying direction of the stationary nozzle.

10. A dish washing machine comprising:

a main body;

a washing tub disposed in the main body;

a stationary nozzle fixed to the washing tub to spray washing water;

vanes arranged to be parallel with respect to one another in a spray direction of the stationary nozzle and disposed such that a longitudinal axis of each of the vanes is perpendicular to the spray direction of the stationary nozzle; and a driving mechanism disposed at an end of at least one of the vanes to rotate the at least one vane such that a reflective portion of the at least one vane is configured to reflect washing water sprayed from the stationary nozzle, wherein the driving mechanism includes one or more of a motor, a belt, a driving pulley, and one or more idle pulleys, the at least one vane is rotated using the driving mechanism between a standby position and one or more reflection positions, the standby position corresponds to a position at which a reflective portion of a vane is offset from a direction of spray by the stationary nozzle so that the vane in the standby position does not reflect the washing water sprayed from the stationary nozzle, and the one or more reflection positions correspond to one or more positions at which a reflective portion of a vane is in the direction of spray by the stationary nozzle so that the vane in the one or more reflection positions reflects the washing water sprayed from the stationary nozzle.

11. The dish washing machine according to claim 10, wherein:

the vanes are independently rotated by the driving mechanism between the standby position and the one or more reflection positions such that a first vane is capable of being in the standby position, a second vane is capable of being in a first reflection position, and a third vane is capable of being in a second reflection position, simultaneously.

12. The dish washing machine according to claim 10, wherein:

the vanes are respectively rotated by the driving mechanism in sequence between the standby position and the one or more reflection positions.

* * * * *